US010431874B2

(12) United States Patent
Chen et al.

(10) Patent No.: US 10,431,874 B2
(45) Date of Patent: Oct. 1, 2019

(54) ANTENNA DEVICE AND ELECTRONIC DEVICE INCLUDING THE SAME

(71) Applicant: Samsung Electronics Co., Ltd., Suwon-si, Gyeonggi-do (KR)

(72) Inventors: Kuo-Cheng Chen, Taoyuan (TW); You-Chieh Chen, Taipei (TW); Ahmed Hussain, Suwon-si (KR); Hosaeng Kim, Anyang-si (KR); Yoon Jae Lee, Seoul (KR); Hyung Joo Lee, Seongnam-si (KR); Jinwoo Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 237 days.

(21) Appl. No.: 15/366,441

(22) Filed: Dec. 1, 2016

(65) Prior Publication Data

US 2017/0244153 A1 Aug. 24, 2017

Related U.S. Application Data

(60) Provisional application No. 62/297,517, filed on Feb. 19, 2016.

(30) Foreign Application Priority Data

Jul. 18, 2016 (KR) ..... 10-2016-0090734

(51) Int. Cl.

| | |
|---|---|
| ***H01Q 1/24*** | (2006.01) |
| ***H01Q 1/38*** | (2006.01) |
| ***H01Q 1/48*** | (2006.01) |
| ***H01Q 9/42*** | (2006.01) |
| ***H01Q 13/10*** | (2006.01) |
| ***H01Q 21/28*** | (2006.01) |

(52) U.S. Cl.

CPC ..... *H01Q 1/243* (2013.01); *H01Q 1/38* (2013.01); *H01Q 1/48* (2013.01); *H01Q 9/42* (2013.01); *H01Q 13/10* (2013.01); *H01Q 21/28* (2013.01)

(58) Field of Classification Search

CPC H01Q 1/243; H01Q 1/48; H01Q 9/42; H01Q 13/10; H01Q 13/28

USPC ..... 174/50.51

See application file for complete search history.

(56) References Cited

U.S. PATENT DOCUMENTS 8,270,914 B2 9/2012 Pascolini et al.
8,655,422 B2 * 2/2014 Stiehl ..... B29C 45/1676 361/730

* cited by examiner

*Primary Examiner* — Dhiru R Patel
(74) *Attorney, Agent, or Firm* — Jefferson IP Law, LLP

(57) ABSTRACT

An electronic device is provided. The electronic device includes a housing including a front face having a substantially rectangular shape and facing in a first direction, a rear face having a substantially rectangular shape and facing in a second direction that is opposite to the first direction, and first to fourth side face members that enclose a space between the front face and the rear face, wherein at least a portion of the first to fourth side face members is formed of a conductive material, a touch screen display exposed through the front face, and at least one wireless communication circuit arranged within the housing. The rear face includes a substantially flat conductive plate that constitutes a substantial portion of the rear face, and an elongated non-conductive strip that encloses the conductive plate when viewed from above the rear face, and extends along the first to fourth side face members.

20 Claims, 55 Drawing Sheets

(a)

(b)

ANTENNA DEVICE AND ELECTRONIC DEVICE INCLUDING THE SAME

CROSS-REFERENCE TO RELATED APPLICATION(S)

This application claims the benefit under 35 U.S.C. § 119(e) of a U.S. Provisional application filed on Feb. 19, 2016 in the U.S. Patent and Trademark Office and assigned Ser. No. 62/297,517, and under 35 U.S.C. § 119(a) of a Korean patent application filed on Jul. 18, 2016 in the Korean Intellectual Property Office and assigned Serial number 10-2016-0090734, the entire disclosure of each of which is hereby incorporated by reference.

TECHNICAL FIELD

The present disclosure relates to an electronic device that includes an antenna device. More particularly, the present disclosure relates to an antenna device that is capable of preventing the deterioration of performance of the antenna device.

BACKGROUND

Recently, as functional differences have been considerably reduced among electronic devices of respective manufacturers, the size of the electronic devices are being reduced in order to promote the purchase intention of consumers, and are being developed to increase the rigidity of the electronic devices, to strengthen the design aspect of the electronic devices, as well as to reduce the size of the electronic devices. As one aspect of such a trend, efforts have been made to: efficiently secure a space for disposing at least one antenna device that is provided for communication among the components of the electronic devices; prevent the degradation of the radiating performance of the antenna device in advance; and make the antenna device exhibit excellent performance.

Antenna devices used in an electronic device typically have an inverted-F antenna (IFA) or a monopole radiator as a basic structure, and the volume and number of the mounted antenna radiators may be determined based on the frequency, the bandwidth, and the kind of each service. For example, antenna devices typically use a low band of 700 MHz to 900 MHz, a mid band of 1,700 MHz to 2,100 MHz, and a high band of 2,300 MHz to 2,700 MHz as main communication bands. In addition, wireless communication services (e.g., Bluetooth (BT), global positioning system (GPS), and WI-FI) are used. While a plurality of antenna radiators are required in order to support the above-mentioned communication bands, it is unavoidable that a communication device has a restrictive antenna volume space. In order to overcome this problem, service bands, which are similar to each other in terms of frequency bands, are lumped with each other and are designed to be split to several antennas.

For example, in the case of antenna devices allocated to voice/data communication (e.g., general packet radio service (GPRS), wideband code division multiple access (WCDMA), or light-emitting diode (LED)) that is a main function of an electronic device for communication, by European standards, bands to be implemented may be implemented as 24 bands in total including $2^{nd}$ generation (2G) (global system for mobile communications (GSM850), extended GSM (EGSM), distributed control system (DCS), personal communication service (PCS)), WCDMA (B1, B2, B5, B8), and long term evolution (LTE) (B1, B2, B3, B4, B5, B7, B8, B12, B17, B18, B19, B20, B26, B38, B39, B40, B41). It is difficult to meet service providers' specifications and specific absorption rate (SAR) standards and to minimize the effects on the human body while implementing all the bands in one antenna device. Thus, service bands, of which the frequency bands are similar to each other over at least two regions, may be lumped with each other so as to implement an antenna device. As an example, 2G (GSM850, EGSM, DCS, PCS), WCDMA (B1, B2, B5, B8) and LTE (B1, B2, B3, B4, B5, B8, B12, B17, B18, B19, B20, B26, B39) may be implemented in one antenna, and an antenna for LTE (B7, B38, B40, B41) may be implemented in another antenna.

In addition, in the case where the exterior of an electronic device is formed of a metallic member (e.g., a metal bezel), the metallic member may be utilized as an antenna radiator, and may be designed as an antenna device, unlike an injection molded product made of a separate dielectric material.

For example, in the case where a metallic member used in the rim of an electronic device is utilized as an antenna radiator, an antenna device may be implemented so as to operate in a desired frequency band by isolating a specific position of the metallic member as a unit member by a split portion made of a dielectric material, and adjusting an electric length depending on the power feeding position of the unit member from a power feeding unit of a board.

When the metallic member is also used not only in a side face of an electronic device, but also in the front face or rear face of the electronic device, which is connected to the side face of the electronic device, a peripheral metallic member may act as an electric conductor, which may cause the deterioration of the radiation performance of the antenna device. A configuration, in which the metallic member is applied to the rear face of the electronic device, may cause a serious hand effect.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna device and an electronic device including the antenna device.

Another aspect of the present disclosure is to provide an antenna device that is capable of preventing the deterioration of performance of the antenna device even though a metallic member is applied to an exterior of the electronic device, and to provide an electronic device including the antenna device.

In accordance with an aspect of the present disclosure, an electronic device is provided. The electronic device includes a housing including a front face having a substantially rectangular shape and facing in a first direction, a rear face having a substantially rectangular shape and facing in a second direction that is opposite to the first direction, and first to fourth side face members that together enclose a space between the front face and the rear face, in which at least a portion of the first to fourth side face members is formed of a conductive material, a touch screen display exposed through the front face, and at least one wireless communication circuit arranged within the housing. The rear face includes a substantially flat conductive plate that constitutes a substantial portion of the rear face, and an elongated non-conductive strip that encloses the conductive plate when viewed from above the rear face, and extends along the first to fourth side face members.

In accordance with another aspect of the present disclosure, an electronic device is provided. The electronic device includes a housing including a front face having a substantially rectangular shape and facing in a first direction, a rear face having a substantially rectangular shape and facing in a second direction that is opposite to the first direction, and first to fourth side face members that together enclose a space between the front face and the rear face, in which the rear face includes a substantially flat conductive plate that forms a considerable portion of the rear face, a touch screen display exposed through the front face, and at least one wireless communication circuit arranged within the housing. Each of the first and third side face members has a first length in a third direction perpendicular to the first direction, and each of the second and fourth side face members has a second length, which is shorter than the first length, in a fourth direction perpendicular to the third direction. The first side face member includes a first conductive structure elongated in the third direction, a second conductive structure spaced apart from the first conductive structure, and elongated in the third direction, and a first non-conductive structure interposed between the first conductive structure and the second conductive structure, and elongated in the third direction. The second side face member includes a third conductive structure elongated in the fourth direction from the first conductive structure, a fourth conductive structure spaced apart from the third conductive structure, and elongated in the fourth direction from the second conductive structure, and a second non-conductive structure interposed between the third conductive structure and the fourth conductive structure, and elongated in the fourth direction from the first non-conductive structure.

In accordance with another aspect of the present disclosure, an electronic device is provided. The electronic device includes a housing including a front face having a substantially rectangular shape and facing in a first direction, a rear face having a substantially rectangular shape, facing in a second direction that is opposite to the first direction, and including a non-conductive material, and first to fourth side face members that together enclose a space between the front face and the rear face, in which at least a portion of the first to fourth side face members is formed of a conductive material, a touch screen display exposed through the front face, at least one wireless communication circuit arranged within the housing, a substantially flat conductive ground plane arranged within the housing, being substantially parallel to the rear face, and having an area substantially equal to an area of the rear face, and a non-conductive extension structure arranged within the housing, extending, when viewed from above the rear face, from the first side face member along the fourth side surface member, and enclosing a considerable portion of the ground plane when viewed from above the rear face. Each of the first and third side face members has a first length in a third direction perpendicular to the first direction, and each of the second and fourth side face members has a second length, which is shorter than the first length, in a fourth direction perpendicular to the third direction. The electronic device further includes a first conductive connection part configured to electrically connect a portion of the first side face member to the ground plane, and a second conductive connection part configured to electrically connect a portion of the third side face member to the ground plane.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
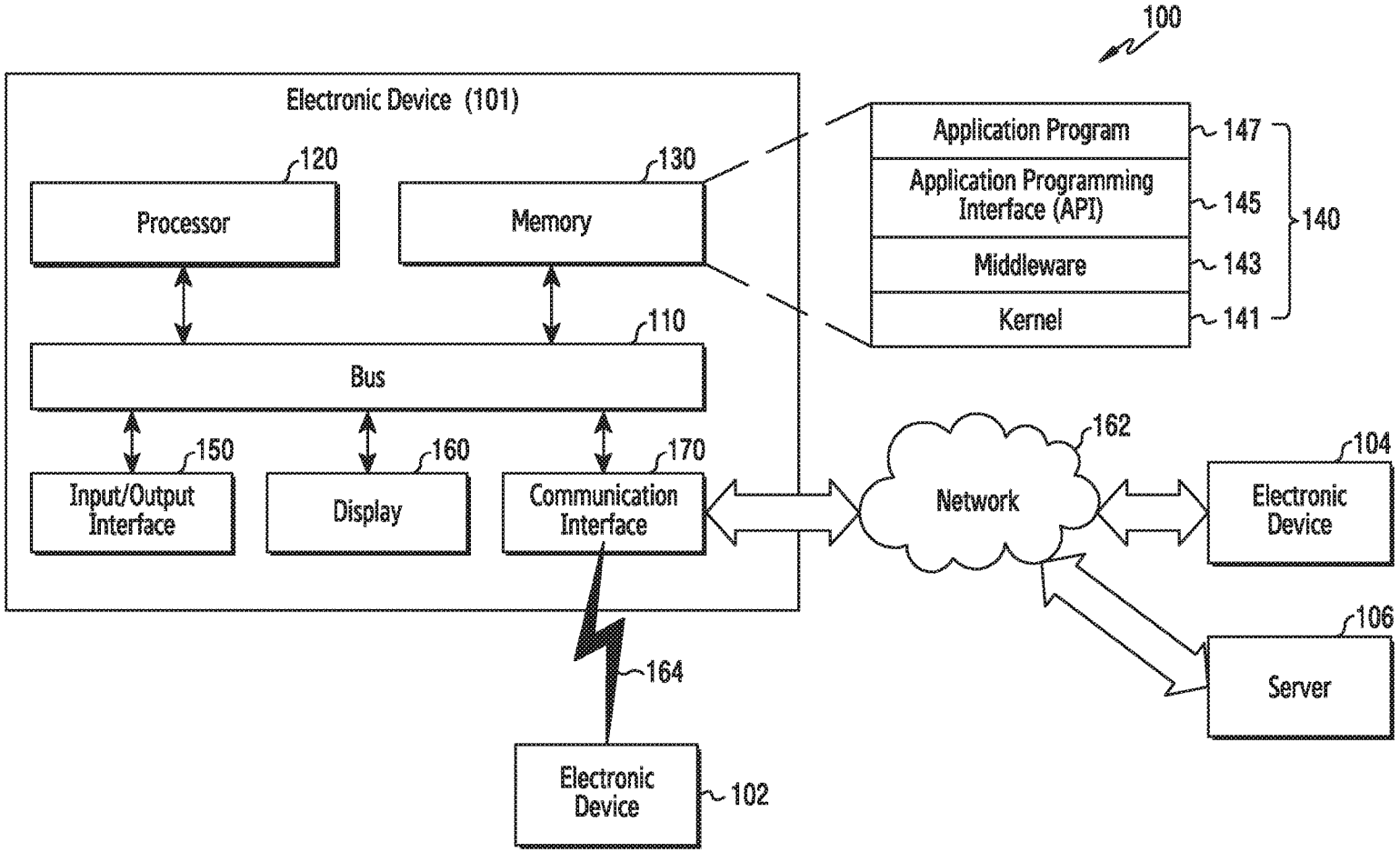
FIG. 1 is a view illustrating a network environment that includes an electronic device according to an embodiment of the present disclosure.

The following description with reference to the accompanying drawings is provided to assist in a comprehensive understanding of various embodiments of the present disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to their dictionary meanings, but are merely used to enable a clear and consistent understanding of the present disclosure. Accordingly, it should be apparent to those skilled in the art that the following description of various embodiments of the present disclosure is provided for illustrative purposes only and not for the purpose of limiting the present disclosure as defined by the appended claims and their equivalents.

It is to be understood that the singular forms "a," "an," and "the" include plural references unless the context clearly dictates otherwise. Thus, for example, reference to "a component surface" includes reference to one or more of such surfaces.

FIGS. 1, 2, 3A, 3B, 4, 5A, 5B, 6A, 6B, 6C, 6D, 7A, 7B, 7C, 8, 9A, 9B, 9C, 10, 11, 12, 13A, 13B, 14A to 14C, 15A to 15E, 16A to 16D, 17A to 17D, 18A to 18C, 19A to 19C, 20A to 20C, 21A to 21C, 22A to 22D, 23A to 23C, 24A to 24C, 25A to 25C, 26A to 26C, 27A to 27C, 28A to 28C, 29A to 29C, and 30A to 30C, discussed below, and the various embodiments used to describe the principles of the present disclosure are by way of illustration only and should not be construed in any way to limit the scope of the disclosure. Those skilled in the art will understand that the principles of the present disclosure may be implemented in any suitably arranged electronic device.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

The terms "include" and "may include" used herein are intended to indicate the presence of a corresponding function, operation, or constitutional element disclosed herein, and are not intended to limit the presence of one or more functions, operations, or constitutional elements. In addition, the terms "include" and "have" are intended to indicate that characteristics, numbers, operations, constitutional elements, and elements disclosed in the specification or combinations thereof exist. However, additional possibilities of one or more other characteristics, numbers, operations, constitutional elements, elements or combinations thereof may exist.

As used herein, the expression "or" includes any and all combinations of words enumerated together. For example, "A or B" may include either A or B, or may include both A and B.

Although expressions used in various embodiments of the present disclosure, such as "1st", "2nd", "first", "second" may be used to express various constituent elements of the various embodiments of the present disclosure, these expressions are not intended to limit the corresponding constituent elements. The above expressions are not intended to limit an order or an importance of the corresponding constituent elements. The above expressions may be used to distinguish one constituent element from another constituent element. For example, a first user device and the second user device are both user devices, and indicate different user devices. Similarly, a first constituent element may be referred to as a second constituent element, and the second constituent element may be referred to as the first constituent element without departing from the scope of the present disclosure.

When an element is mentioned as being "connected" to or "accessing" another element, this may mean that the element is directly connected to or accessing the other element, or there may be intervening elements present between the two elements. On the other hand, when an element is mentioned as being "directly connected" to or "directly accessing" another element, it is to be understood that there are no intervening elements present.

The term "module" as used herein may imply a unit including one of hardware, software, and firmware, or a combination thereof. The term "module" may be interchangeably used with terms, such as unit, logic, logical block, component, circuit, and the like. A module as described herein may be a minimum unit of an integrally constituted component or may be a part thereof. The module may be a minimum unit for performing one or more functions or may be a part thereof. The module may be mechanically or electrically implemented. For example, the module as described herein includes at least one of an application-specific integrated circuit (ASIC) chip, a field-programmable gate arrays (FPGAs), and a programmable-logic device, which are known or will be developed and which perform certain operations.

By the term "substantially" it is meant that the recited characteristic, parameter, or value need not be achieved exactly, but that deviations or variations, including, but not limited to, for example, tolerances, measurement errors, measurement accuracy limitations and other factors known to persons of ordinary skill in the art, may occur in amounts that do not preclude the effect the characteristic was intended to provide.

Unless otherwise defined, all terms, including technical and scientific terms, used herein have the same meaning as commonly understood by those of ordinary skill in the art to which various embodiments of the present disclosure belong. It will be further understood that terms, such as those defined in commonly used dictionaries, should be interpreted as having meanings that are consistent with their meaning in the context of the relevant art and the various embodiments of the present disclosure, and should not be interpreted in an idealized or overly formal sense unless expressly so defined herein.

An electronic device as used herein may be a device including, but not limited to, an antenna capable of performing a communication function in at least one frequency band. For example, the electronic device may be a smart phone, a tablet personal computer (PC), a mobile phone, a video phone, an e-book reader, a desktop PC, a laptop PC, a netbook computer, a personal digital assistant (PDA), a portable multimedia player (PMP), a moving picture experts group phase 1 or phase 2 (MPEG-1 or MPEG-2) audio layer 3 (MP3) player, a mobile medical device, a camera, and a wearable device (e.g., a head-mounted-device (HMD), such as electronic glasses, electronic clothes, an electronic bracelet, an electronic necklace, an electronic appcessory, an electronic tattoo, a smart watch, and the like).

The electronic device may be a smart home appliance having an antenna. For example, the smart home appliance may include at least one of a television (TV), a digital versatile disc (DVD) player, an audio player, a refrigerator, an air conditioner, a cleaner, an oven, a microwave oven, a washing machine, an air purifier, a set-top box, a TV box (e.g., Samsung HomeSync®, Apple TV®, or Google TV®), a game console, an electronic dictionary, an electronic key, a camcorder, and an electronic picture frame.

The electronic device including the antenna may be one of various medical devices (e.g., magnetic resonance angiography (MRA), magnetic resonance imaging (MRI), computed tomography (CT), imaging equipment, an ultrasonic instrument, and the like), a navigation device, a global positioning system (GPS) receiver, an event data recorder (EDR), a flight data recorder (FDR), a car infotainment device, electronic equipment for a ship (e.g., a vessel navigation device, a gyro compass, and the like), avionics, a security device, a car head unit, an industrial or domestic robot, an automatic teller machine (ATM), a point of sales (POS) device, and the like.

The electronic device may be part of at least one of an item of furniture or a building/structure including an antenna. The electronic device may be an electronic board, an electronic signature input device, a projector, or any of various measurement machines (e.g., water supply, electricity, gas, a propagation measurement machine, and the like).

The electronic device may be one or more combinations of the aforementioned various devices. In addition, the electronic device may be a flexible device. Moreover, the electronic device is not limited to the aforementioned devices.

Hereinafter, an electronic device according to various embodiments of the present disclosure will be described with reference to the accompanying drawings. The term 'user' used in the various embodiments may refer to a person who uses the electronic device or a device which uses the electronic device (e.g., an artificial intelligence (AI) electronic device).

FIG. 1 illustrates a view of a network environment including an electronic device according to an embodiment of the present disclosure.

Referring to FIG. 1, a network environment 100 includes an electronic device 101. The electronic device 101 includes a bus 110, a processor 120, a memory 130, an input/output interface 150, a display 160, and a communication interface 170. In various embodiments of the present disclosure, the electronic device 101 can omit at least one of the components or further include another component.

The bus 110 includes a circuit for connecting the components (e.g., the processor 120, the memory 130, the input/output interface 150, the display 160, and the communication interface 170) and delivering communications (e.g., a control message) therebetween.

The processor 120 includes one or more of a central processing unit (CPU), an application processor (AP), and a communication processor (CP). The processor 120 processes an operation or data on control of and/or communication with another component of the electronic device 101.

The processor 120, which is connected to the long term evolution (LTE) network, determines whether a call is connected over the circuit switched (CS) service network using caller identification information (e.g., a caller phone number) of the CS service network (e.g., the $2^{nd}$ generation (2G)/3rd generation (3G) network). For example, the processor 120 receives incoming call information (e.g., a CS notification message or a paging request message) of the CS service network over the long term evolution (LTE) network (e.g., circuit-switched fallback (CSFB)). The processor 120 being connected to the LTE network receives incoming call information (e.g., a paging request message) over the CS service network (e.g., single radio LTE (SRLTE)).

When receiving the incoming call information (e.g., a CS notification message or a paging request message) of the CS service network over the LTE network, the processor 120 obtains caller identification information from the incoming call information. The processor 120 displays the caller identification information on the display 160. The processor 120 determines whether to connect the call based on input information corresponding to the caller identification information displayed on the display 160. For example, when detecting input information corresponding to an incoming call rejection, through the input/output interface 150, the processor 120 restricts the voice call connection and maintains the LTE network connection. For example, when detecting input information corresponding to an incoming call acceptance, through the input/output interface 150, the processor 120 connects the voice call by connecting to the CS service network.

When receiving the incoming call information (e.g., a CS notification message or a paging request message) of the CS service network over the LTE network, the processor 120 obtains caller identification information from the incoming call information. The processor 120 determines whether to connect the call by comparing the caller identification information with a reception control list. For example, when the caller identification information is included in a first reception control list (e.g., a blacklist), the processor 120 restricts the voice call connection and maintains the connection to the LTE network. When the caller identification information is not included in the first reception control list (e.g., the blacklist), the processor 120 connects the voice call by connecting to the CS service network. When the caller identification information is included in a second reception control list (e.g., a white list), the processor 120 connects the voice call by connecting to the CS service network.

When receiving the incoming call information (e.g., a paging request message) of the CS service network over the LTE network, the processor 120 sends an incoming call response message (e.g., a paging response message) to the CS service network. The processor 120 suspends the LTE service and receives the caller identification information (e.g., a circuit-switched call (CC) setup message) from the CS service network. The processor 120 determines whether to connect the call by comparing the caller identification information with the reception control list. For example, when the caller identification information is included in the first reception control list (e.g., the blacklist), the processor 120 restricts the voice call connection and resumes the LTE network connection. When the caller identification information is not included in the first reception control list (e.g., the blacklist), the processor 120 connects the voice call by connecting to the CS service network. For example, when the caller identification information is included in the second reception control list (e.g., the white list), the processor 120 connects the voice call by connecting to the CS service network.

The memory 130 can include volatile and/or nonvolatile memory. The memory 130 stores commands or data (e.g., the reception control list) relating to at least another component of the electronic device 101. The memory 130 may store software and/or a program 140. The program 140 may include a kernel 141, middleware 143, an application programming interface (API) 145, and/or application programs (or "applications") 147. At least some of the kernel 141, the middleware 143, and the API 145 may be referred to as an operating system (OS).

The kernel 141 controls or manages system resources (e.g., the bus 110, the processor 120, or the memory 130) used for performing an operation or function implemented by the other programs (e.g., the middleware 143, the API 145, or the applications 147). Furthermore, the kernel 141 provides an interface through which the middleware 143, the API 145, or the applications 147 connects the individual elements of the electronic device 101 to control or manage the system resources.

The middleware 143 functions as an intermediary for allowing the API 145 or the applications 147 to communicate with the kernel 141 to exchange data.

In addition, the middleware 143 processes one or more task requests received from the applications 147 according to priorities thereof. For example, the middleware 143 assigns priorities for using the system resources (e.g., the bus 110, the processor 120, the memory 130, etc.) of the electronic device 101, to at least one of the applications 147. For example, the middleware 143 may perform scheduling or load balancing on the one or more task requests by processing the one or more task requests according to the priorities assigned thereto.

The API 145 is an interface through which the applications 147 control functions provided from the kernel 141 or the middleware 143, and may include at least one interface or function (e.g., an instruction) for file control, window control, image processing, text control, etc.

The input/output interface 150 functions as an interface that transfers instructions or data input from a user or another external device to the other element(s) of the electronic device 101. Furthermore, the input/output interface 150 outputs the instructions or data received from the other element(s) of the electronic device 101 to the user or an external electronic device.

The display 160 may include a liquid crystal display (LCD), a light emitting diode (LED) display, an organic LED (OLED) display, a micro electro mechanical system (MEMS) display, an electronic paper display, etc. The display 160 displays various types of content (e.g., text, images, videos, icons, symbols, etc.) for the user. The display 160 may include a touch screen and receive, for example, a touch, a gesture, proximity, a hovering input, etc., using an electronic pen or the user's body part. The display 160 may display a web page.

The communication interface 170 can establish a communication between the electronic device 101 and an external electronic device (e.g., a first external electronic device 102, a second external electronic device 104, or a server 106). For example, the communication interface 170 can communicate with the first external electronic device 102, the second external electronic device 104, or the server 106 in connection to the network 162 through wireless communication or wired communication or via a short-range communication 164. For example, the wireless communication can conform to a cellular communication protocol including at least one of LTE, LTE-advanced (LTE-A), code division multiple access (CDMA), wideband CDMA (WCDMA), universal mobile telecommunication system (UMTS), wireless broadband (WiBro), and global system for mobile communications (GSM).

The wired communication can include at least one of universal serial bus (USB), high definition multimedia interface (HDMI), recommended standard 232 (RS-232), and plain old telephone service (POTS).

The network 162 can include at least one of telecommunications networks, for example, a computer network (e.g., local area network (LAN) or wide area network (WAN)), internet, and a telephone network.

The electronic device 101 provides the LTE service in the single radio environment by use of at least one module functionally or physically separated from the processor 120.

Each of the first and second external electronic devices 102 and 104 may be a type of device that is the same as or different from the electronic device 101. According to an embodiment of the present disclosure, the server 106 may include a group of one or more servers. All or some of the operations to be executed by the electronic device 101 may be executed by another electronic device or a plurality of other electronic devices (e.g., the electronic devices 102 and 104 or the server 106). In the case where the electronic device 101 may perform a certain function or service automatically or by request, the electronic device 101 may request some functions that are associated therewith from the other electronic devices (e.g., the electronic devices 102 and 104 or the server 106) instead of or in addition to executing the function or service by itself. The other electronic devices (e.g., the electronic devices 102 and 104 or the server 106) may execute the requested functions or additional functions, and may transmit the results to the electronic device 101. The electronic device 101 may provide the requested functions or services by processing the received results. For this purpose, for example, a cloud computing technique, a distributed computing technique, or a client-server computing technique may be used.

Various embodiments of the present disclosure will be described with reference to a display that includes a bent or curved area and is applied to a housing of an electronic device, in which a non-metal member and a metal member (e.g., a metal bezel) are formed through dual injection molding, but are not limited thereto. For example, the display may be applied to a housing, in which a metal member or a non-metal member is formed of a single material.

Figure 2:
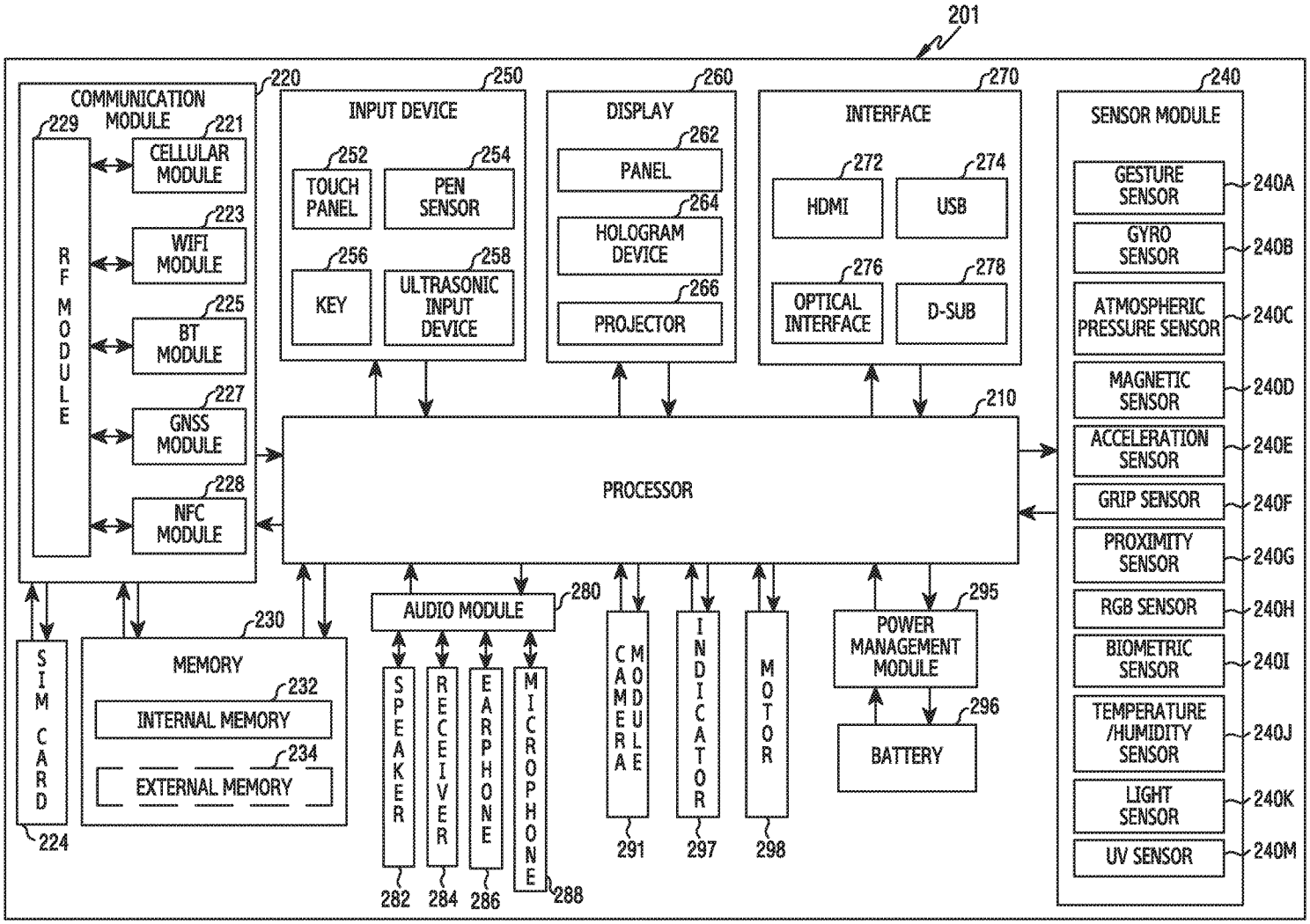
FIG. 2 is a block diagram of an electronic device according to an embodiment of the present disclosure.

FIG. 2 illustrates a diagram of a configuration of an electronic device according to an embodiment of the present disclosure.

Referring to FIG. 2, a configuration of the electronic device 201 is provided. The electronic device 201 may include all or some of the components described with reference to the electronic device 101 of FIG. 1. The electronic device 201 includes at least one AP 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The AP 210 controls a plurality of hardware or software elements connected to the AP 210 by driving an OS or an application program. The AP 210 processes a variety of data, including multimedia data, and performs arithmetic operations. The AP 210 may be implemented, for example, with a system on chip (SoC). The AP 210 may further include a graphical processing unit (GPU).

The communication module 220 performs data transmission/reception in communication between the external electronic device 104 or the server 106 which may be connected with the electronic device 201 through the network 162. The communication module 220 includes a cellular module 221, a Wi-Fi module 223, a BT module 225, a global navigation satellite system (GNSS) or GPS module 227, a near field communication (NFC) module 228, and a radio frequency (RF) module 229.

The cellular module 221 provides a voice call, a video call, a text service, an internet service, and the like, through a communication network (e.g., LTE, LTE-A, CDMA, WCDMA, UMTS, WiBro, and GSM, and the like). In addition, the cellular module 221 identifies and authenticates the electronic device 201 within the communication network by using the SIM card 224. The cellular module 221 may perform at least some of functions that can be provided by the AP 210. For example, the cellular module 221 may perform at least some of multimedia control functions.

The cellular module 221 includes a CP. Further, the cellular module 221 may be implemented, for example, with an SoC. Although elements, such as the cellular module 221 (e.g., the CP), the memory 230, and the power management module 295 are illustrated as separate elements with respect to the AP 210 in FIG. 2, the AP 210 may also be implemented such that at least one part (e.g., the cellular module 221) of the aforementioned elements is included in the AP 210.

The AP 210 or the cellular module 221 loads an instruction or data, which is received from each non-volatile memory connected thereto or at least one of different elements, to a volatile memory and processes the instruction or data. In addition, the AP 210 or the cellular module 221 stores data, which is received from at least one of different elements or generated by at least one of different elements, into the non-volatile memory.

Each of the Wi-Fi module 223, the BT module 225, the GNSS module 227, and the NFC module 228 includes a processor for processing data transmitted/received through a corresponding module. Although the cellular module 221, the Wi-Fi module 223, the BT module 225, the GNSS module 227, and the NFC module 228 are illustrated in FIG. 2 as separate blocks, at least some (e.g., two or more) of the cellular module 221, the Wi-Fi module 223, the BT module 225, the GNSS module 227, and the NFC module 228 may be included in one integrated chip (IC) or IC package. For example, at least some of processors corresponding to the cellular module 221, the Wi-Fi module 223, the BT module 225, the GNSS module 227, and the NFC module 228 (e.g., a communication processor corresponding to the cellular module 221 and a Wi-Fi processor corresponding to the Wi-Fi module 223) may be implemented with an SoC.

The RF module 229 transmits/receives data, such as an RF signal. The RF module 229 may include a transceiver, a power amp module (PAM), a frequency filter, a low noise amplifier (LNA), and the like. In addition, the RF module 229 may further include a component for transmitting/receiving a radio wave on a free space in wireless communication, for example, a conductor, a conducting wire, and the like. Although it is illustrated in FIG. 2 that the cellular module 221, the Wi-Fi module 223, the BT module 225, the GNSS module 227, and the NFC module 228 share one RF module 229, at least one of the cellular module 221, the Wi-Fi module 223, the BT module 225, the GNSS module 227, the NFC module 228 may transmit/receive an RF signal via a separate RF module.

The SIM card 224 may be inserted into a slot formed at a specific location of the electronic device 201. The SIM card 224 includes unique identification information (e.g., an integrated circuit card identifier (ICCID)) or subscriber information (e.g., an international mobile subscriber identity (IMSI)).

The memory 230 includes an internal memory 232 or an external memory 234.

The internal memory 232 may include at least one of a volatile memory (e.g., a dynamic random access memory (DRAM), a static RAM (SRAM), a synchronous dynamic RAM (SDRAM), and the like) or a non-volatile memory (e.g., a one time programmable read only memory (OTPROM), a programmable ROM (PROM), an erasable and programmable ROM (EPROM), an electrically erasable and programmable ROM (EEPROM), a mask ROM, a flash ROM, a not and (NAND) flash memory, a not or (NOR) flash memory, and the like). The internal memory 232 may be a solid state drive (SSD).

The external memory 234 may include a flash drive, and may further include, for example, compact flash (CF), secure digital (SD), micro-SD, mini-SD, extreme digital (xD), memory stick, and the like. The external memory 234 may be operatively coupled to the electronic device 201 via various interfaces.

The electronic device 201 may further include a storage unit (or a storage medium), such as a hard drive.

The sensor module 240 measures a physical quantity or detects an operation state of the electronic device 201, and converts the measured or detected information into an electric signal. The sensor module 240 includes, for example, at least one of a gesture sensor 240A, a gyro sensor 240B, a barometric pressure sensor or air sensor 240C, a magnetic sensor 240D, an acceleration sensor 240E, a grip sensor 240F, a proximity sensor 240G, a color sensor 240H (e.g., a red, green, blue (RGB) sensor), a biometric sensor 240I, a temperature/humidity sensor 240J, an illumination/illuminance sensor 240K and an ultraviolet (UV) sensor 240M.

Additionally or alternatively, the sensor module 240 may include, for example, an E-node sensor, an electromyography (EMG) sensor, an electroencephalogram (EEG) sensor, an electrocardiogram (ECG) sensor, a fingerprint sensor, and the like.

The sensor module 240 may further include a control circuit for controlling at least one or more sensors included therein.

The input device 250 includes a touch panel 252, a (digital) pen sensor 254, a key 256, or an ultrasonic input unit 258.

The touch panel 252 recognizes a touch input by using at least one of an electrostatic type configuration, a pressure-sensitive type configuration, and an ultrasonic type configuration. The touch panel 252 may further include a control circuit. In the instance where the touch panel is of the electrostatic type, not only is physical contact recognition possible, but proximity recognition is also possible. The touch penal 252 may further include a tactile layer, which provides the user with a tactile reaction.

The (digital) pen sensor 254 may include a recognition sheet which is a part of the touch panel or is separated from the touch panel. The key 256 may include a physical button, an optical key, or a keypad. The ultrasonic input device 258 may detect ultrasonic waves generated by an input tool through the microphone 288, and may confirm data corresponding to the detected ultrasonic waves.

The (digital) pen sensor 254 may be implemented by using the same or similar method of receiving a touch input of the user or by using an additional sheet for recognition.

The key 256 may be a physical button, an optical key, a keypad, or a touch key.

The ultrasonic input unit 258 is a device by which the electronic device 201 detects a reflected sound wave through a microphone 288 and is capable of radio recognition. For example, an ultrasonic signal, which may be generated by using a pen, may be reflected off an object and detected by the microphone 288.

The electronic device 201 may use the communication module 220 to receive a user input from an external device (e.g., a computer or a server) connected thereto.

The display 260 includes a panel 262, a hologram 264, or a projector 266.

The panel 262 may be an LCD, an active-matrix organic light-emitting diode (AM-OLED), and the like. The panel 262 may be implemented in a flexible, transparent, or wearable manner. The panel 262 may be constructed as one module with the touch panel 252.

The hologram device 264 uses an interference of light and displays a stereoscopic image in the air.

The projector 266 displays an image by projecting a light beam onto a screen. The screen may be located inside or outside the electronic device 201.

The display 260 may further include a control circuit for controlling the panel 262, the hologram device 264, or the projector 266.

The interface 270 may include an HDMI 272, a USB 274, an optical communication interface 276, or a D-subminiature (D-sub) 278. The interface 270 may be included, for example, in the communication interface 160 of FIG. 1. Additionally or alternatively, the interface 270 may include, for example, mobile high-definition link (MHL), SD/multimedia card (MMC) or infrared data association (IrDA).

The audio module 280 bilaterally converts a sound and an electric signal. At least some elements of the audio module 280 may be included in the input/output interface 150 of FIG. 1. The audio module 280 converts sound information which is input or output through a speaker 282, a receiver 284, an earphone 286, the microphone 288, and the like.

The speaker 282 may output a signal of an audible frequency band and a signal of an ultrasonic frequency band. Reflected waves of an ultrasonic signal emitted from the speaker 282 may be received, or a signal of an external audible frequency band may also be received.

The camera module 291 is a device for image and video capturing, and may include one or more image sensors (e.g., a front sensor or a rear sensor), a lens, an image signal processor (ISP), or a flash (e.g., an LED or a xenon lamp). In certain instances, it may prove advantageous to include two or more camera modules.

The power management module 295 manages power of the electronic device 201. The power management module 295 may include a power management integrated circuit (PMIC), a charger IC, or a battery gauge.

The PMIC may be placed inside an IC or SoC semiconductor. Charging is classified into wired charging and wireless charging. The charger IC charges a battery, and prevents an over-voltage or over-current flow from a charger. The charger IC includes a charger IC for at least one of the wired charging and the wireless charging.

The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge may measure a residual quantity of the battery 296 and a voltage, current, and temperature during charging. The battery 296 stores or generates electricity and supplies power to the electronic device 201 by using the stored or generated electricity. The battery 296 may include a rechargeable battery or a solar battery.

The indicator 297 indicates a specific state, such as a booting state, a message state, a charging state, and the like, of the electronic device 201 or a part thereof (e.g., the AP 210).

The motor 298 converts an electric signal into a mechanical vibration.

The electronic device 201 includes a processing unit (e.g., a GPU) for supporting mobile TV. The processing unit for supporting mobile TV processes media data according to a protocol of, for example, digital multimedia broadcasting (DMB), digital video broadcasting (DVB), media flow, and the like.

Each of the aforementioned elements of the electronic device 201 may consist of one or more components, and names thereof may vary depending on a type of the electronic device 201. The electronic device 201 may include at least one of the aforementioned elements. Some of the elements may be omitted, or additional other elements may be further included. In addition, some of the elements of the electronic device 201 may be combined and constructed as one entity, so as to equally perform functions of corresponding elements before combination.

At least some parts of a device (e.g., modules or functions thereof) or method (e.g., operations) may be implemented with an instruction stored in a computer-readable storage media for example. The instruction may be executed by the processor 210, to perform a function corresponding to the instruction. The computer-readable storage media may be the memory 230. At least some parts of the programming module may be implemented (e.g., executed) by the processor 210. At least some parts of the programming module may include modules, programs, routines, a set of instructions, processes, and the like, for performing one or more functions.

While a bar type electronic device is illustrated as an electronic device according to various embodiments of the present disclosure in the drawings, and is described below, the present disclosure is not limited thereto. For example, an antenna device may also be applied to a foldable-type electronic device that includes a first body and a second body pivotally installed to first body.

Figure 3A:
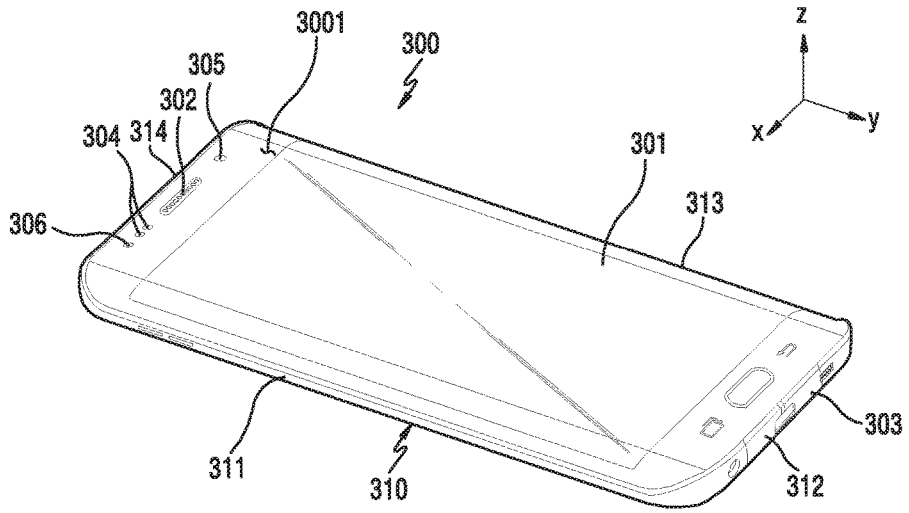
FIGS. 3A and 3B are perspective views illustrating the front side and rear side of an electronic device according to an embodiment of the present disclosure.
Figure 3B:
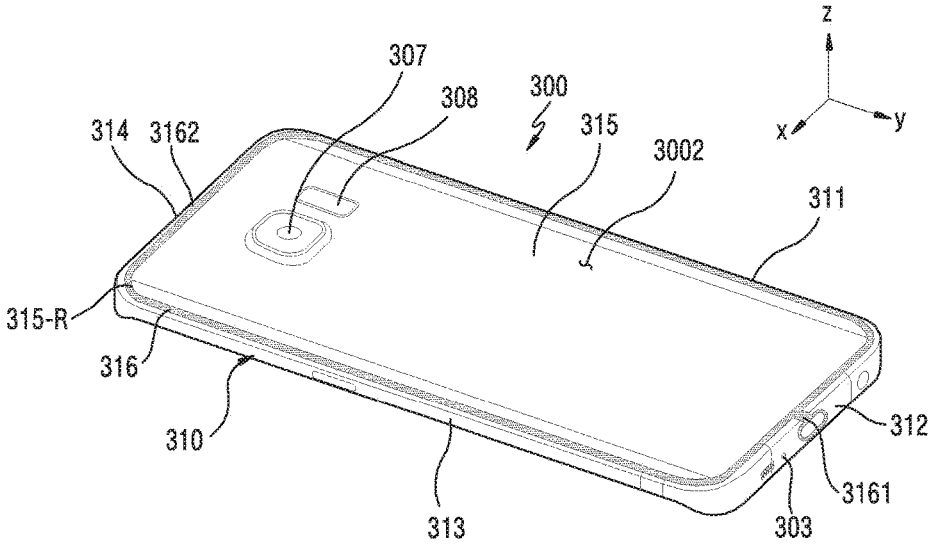

FIGS. 3A and 3B are perspective views illustrating the front side and rear side of an electronic device according to various embodiments of the present disclosure.

Referring to FIGS. 3A and 3B, a display 301 may be provided on the front face 3001 of the electronic device 300. A speaker device 302 may be installed above the display 301 so as to receive a voice of a counterpart. A microphone device 303 may be installed below the display 301 so as to transmit a voice of the user of the electronic device. According to one embodiment, the display 301 may include a touch screen device that includes a touch sensor. The display may include a pressure-sensitive touch screen device that includes a touch sensor and a force sensor that is sensitive to touch pressure.

According to various embodiments of the present disclosure, components for conducting various functions of the electronic device 300 may be arranged around the speaker device 302. The components may include one or more sensor modules 304. The sensor modules 304 may include at least one of an illuminance sensor (e.g., an optical sensor), a proximity sensor, an infrared sensor, and an ultrasonic sensor. The components may include a camera device 305. The components may include an LED indicator 306 configured to inform the user of the status information of the electronic device 300. Components may also be disposed on the rear face 3002 of the electronic device 300. The components may include at least one of another camera device 307, various sensor modules (e.g., a heart rate sensor, an illuminance sensor, and an ultrasonic sensor), and a lighting 308.

The electronic device 300 may include a housing 310 made of a metallic material. The housing 310 may be disposed to expand over a rim of the electronic device 300 and the rear face of the electronic device 300, which is connected to the rim. At least a portion of the housing 310 may be defined by the thickness of the electronic device 300 along the rim of the electronic device 300, and may be formed in a loop shape. Without being limited thereto, however, the housing 310 may be formed to serve as at least a portion of the thickness of the electronic device 300. The housing 310 may be disposed in such a manner in which first to fourth side face members 311 to 314 extend. The first to fourth side face members 311 to 314 may extend along the rim of a conductive plate 315 disposed in the entire region of the rear face 3002 as a part of the housing 310. When viewed from above the rear face 3002 of the electronic device 300, the housing 310 may include a non-conductive strip 316 that encloses the conductive plate 315 and extends along the first to fourth side face members 311 to 314. The first to fourth side face members 311 to 314 and the conductive plate 315 may be integrally formed by the non-conductive strip 316. The non-conductive strip 316 may be coupled to the housing 310, which is made of a metallic material, through an insert molding. Without being limited thereto, however, the non-conductive strip 316 may be coupled to the housing 310, which is made of a metallic material, through a mechanical assembly method.

The first to fourth side face members 311 to 314 of the housing 310 may be maintained in a state in which the whole or at least a partial region of the first to fourth side face members 311 to 314 are electrically disconnected from the conductive plate 315 by the non-conductive strip 316. In addition, at least one of the first to fourth side face members 311 to 314 of the housing 310 may be configured to be electrically separated from each other by the non-conductive strip 316 in at least one location. For example, when a portion of the non-conductive strip 316 extends toward at least one of the first to fourth side face members 311 to 314 so as to be disposed between two regions of the corresponding side face member, which are spaced apart from each other, the corresponding side face member may be maintained in the state of being split into unit members. As a portion of the non-conductive strip 316 arranged along the rim 313-R of the conductive plate 315 extends toward the side face members, the first to fourth side face members 311 to 314 may be split into various numbers of portions, respectively. The housing 310 may be split into two portions by a first protrusion 3161 extending from the non-conductive strip 316 toward the second side face member 312 and a second protrusion 3162 extending from the non-conductive strip 316 toward the fourth side face member 314. Without being limited thereto, however, the housing 310 may be split into two or more portions depending on the number of protrusions. The protrusions may be made of the same material as the non-conductive strip 316 to extend from the non-conductive strip 316, but are not limited thereto. For example, the protrusions may be replaced by non-conductive additional members for splitting the housing 310 made of a metallic material.

Among the first to fourth side face members 311 to 314, at least one side face member, of which at least a partial region is electrically disconnected by the non-conductive strip 316, may operate as an antenna radiator. Each of the side face members 311 to 314 may be implemented to operate in at least one desired frequency band by properly designing a power feeding position and/or a ground position.

As illustrated in FIG. 3B, the non-conductive strip 316 may be arranged along the rim 315-R of the rear face 3002 of the electronic device 300, but the present disclosure is not limited thereto. For example, an opaque painting layer may be on at least one of the first to fourth side face members 311 to 314, the conductive plate 315, the non-conductive strip 316, and the top surface of each of the protrusions 3161 and 3162 such that the entire housing may be implemented as if it is formed of one material.

Even if the greater part of the rear face 3002 of the electronic device 300 is replaced by the conductive plate 315, the side face members 311 to 314 may operate as antenna radiators by a slit formed in at least a partial region along the rim 315-R and/or the non-conductive strip 316 filled in the slit. When the overall region of the rear face 3002 of the electronic device 300 is made of the conductive plate 315 (e.g., a metal), it may contribute to the reinforcement of rigidity and the improvement of external design of the electronic device 300.

Figure 4:
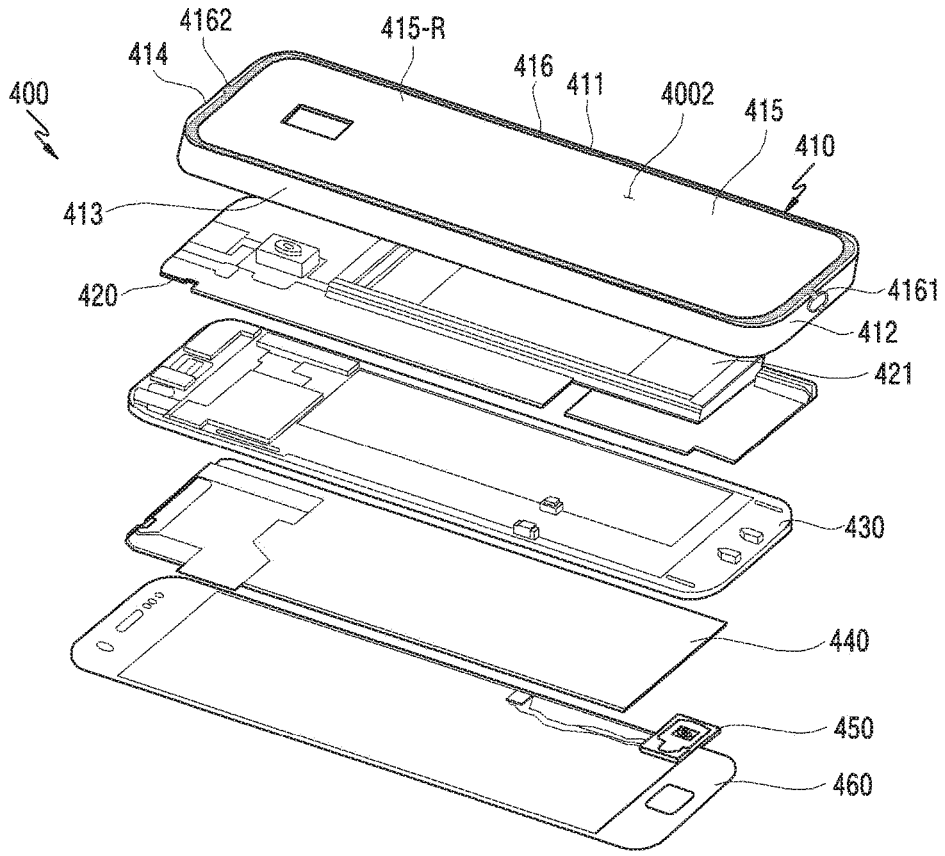
FIG. 4 is an exploded perspective view illustrating an electronic device according to an embodiment of the present disclosure.

FIG. 4 is an exploded perspective view illustrating an electronic device according to various embodiments of the present disclosure.

Referring to FIG. 4, the electronic device 400 of FIG. 4 may be an embodiment of an electronic device that is similar to, or different from, the electronic device 300 of FIGS. 3A and 3B.

Referring to FIG. 4, the electronic device 400 may include a housing 410, a battery 421 disposed inside the housing 410, at least one board 420 (e.g., a main board and/or a sub board), a bracket 430, a display 440, and a window 460.

The housing 410 may be formed in such a manner in which first to fourth side face members 411 to 414 extend along the rim 415-R of a conductive plate 415 that is disposed on a greater portion of a rear face 4002. A non-conductive strip 416 may be interposed on at least a partial region along the rim 415-R of the conductive plate 415. The non-conductive strip 416 may protrude toward a side face member to split the corresponding side face member into two or more portions such that the portions are electrically insulated from each other. The housing 410 may be split into two portions by a first protrusion 4161 extending from the non-conductive strip 416 toward the second side face member 412 and a second protrusion 4162 extending from the non-conductive strip 416 toward the fourth side face member 414.

The side face members 411 to 414, which are split into respective regions by the non-conductive strip 416, and the protrusions 4161 and 4162 may be used as at least one antenna radiator. The board 420 may include a wireless communication circuit, and is connected to at least one region of the side face members 411 to 414 from the wireless communication circuit such that the corresponding one of the side face members 411 to 414 may be used as an antenna radiator that operates in at least one frequency band. At least a portion of the conductive plate 415 and/or the side face members 411 to 414 may be electrically connected to a ground region of the board 420. The board 420 may be configured such that connection pads of the board 420 (e.g., a power feeding pad and/or a ground pad) come in natural contact with one or more connection pieces protruding from the housing 410 when the board 420 is assembled to the housing 410. Without being limited thereto, however, the board 420 and the housing 410 may be electrically connected to each other by a separate electric connection member (e.g., a C-clip, a conductive tape, or a conductive pad).

The bracket 430 may be formed of a non-conductive material (e.g., a synthetic resin), a conductive material (e.g., a metal), or a combination thereof (e.g., through a mechanical assembly or injection molding). The bracket 430 may be electrically connected to the ground region of the board 420 when it is assembled. As indicated by reference numeral 450, a key button (e.g., a home button) may be additionally included to protrude to the outside of the window 460, but the present disclosure is not limited thereto. For example, the key button is exposed to the outside of the electronic device 400, and may include key buttons that perform various functions (e.g., a volume control function and a wake-up function).

Hereinafter, a configuration of a housing according to various embodiments of the present disclosure will be described in detail.

Figure 5A:
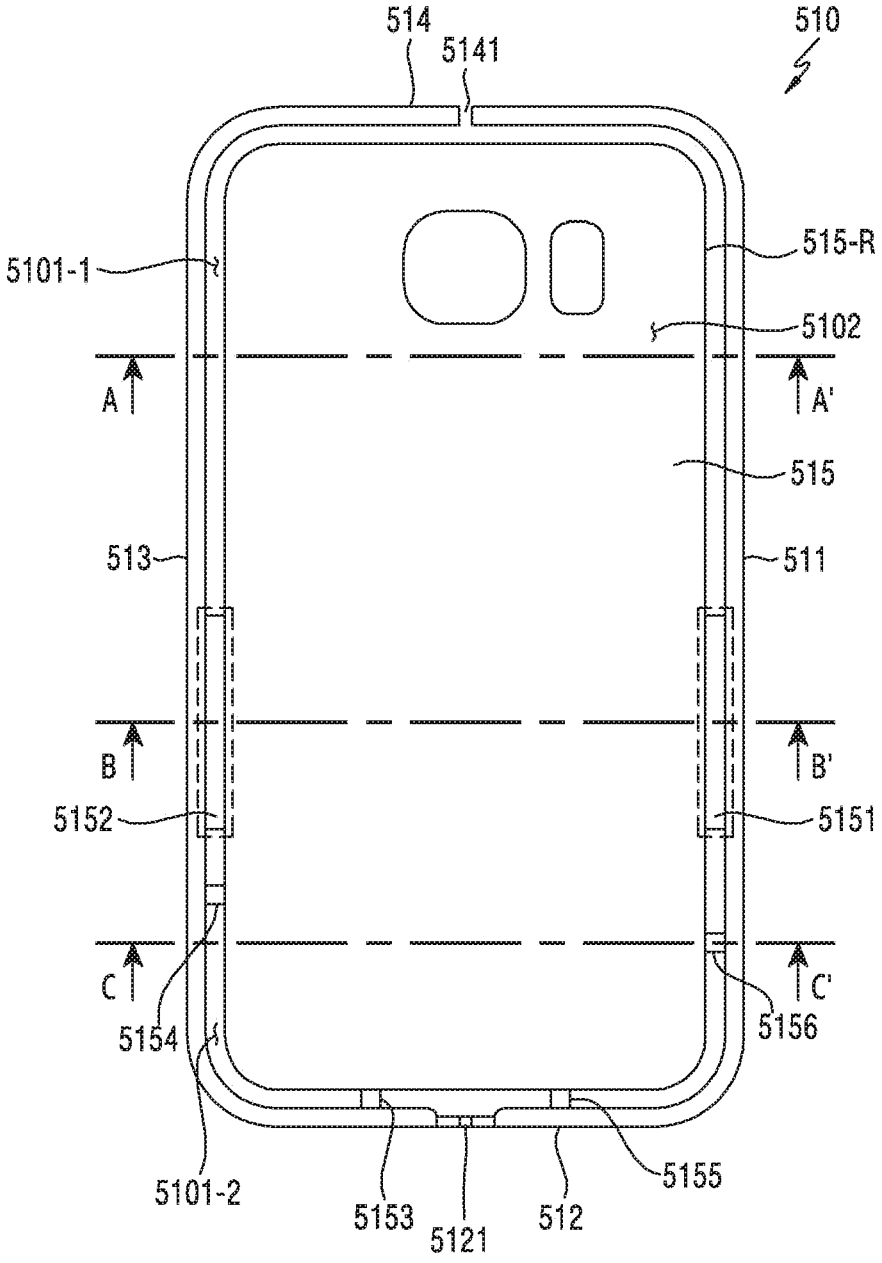
FIG. 5A is a view illustrating a configuration of a housing according to an embodiment of the present disclosure.

FIG. 5A is a view illustrating a configuration of a housing according to an embodiment of the present disclosure.

Figure 5B:
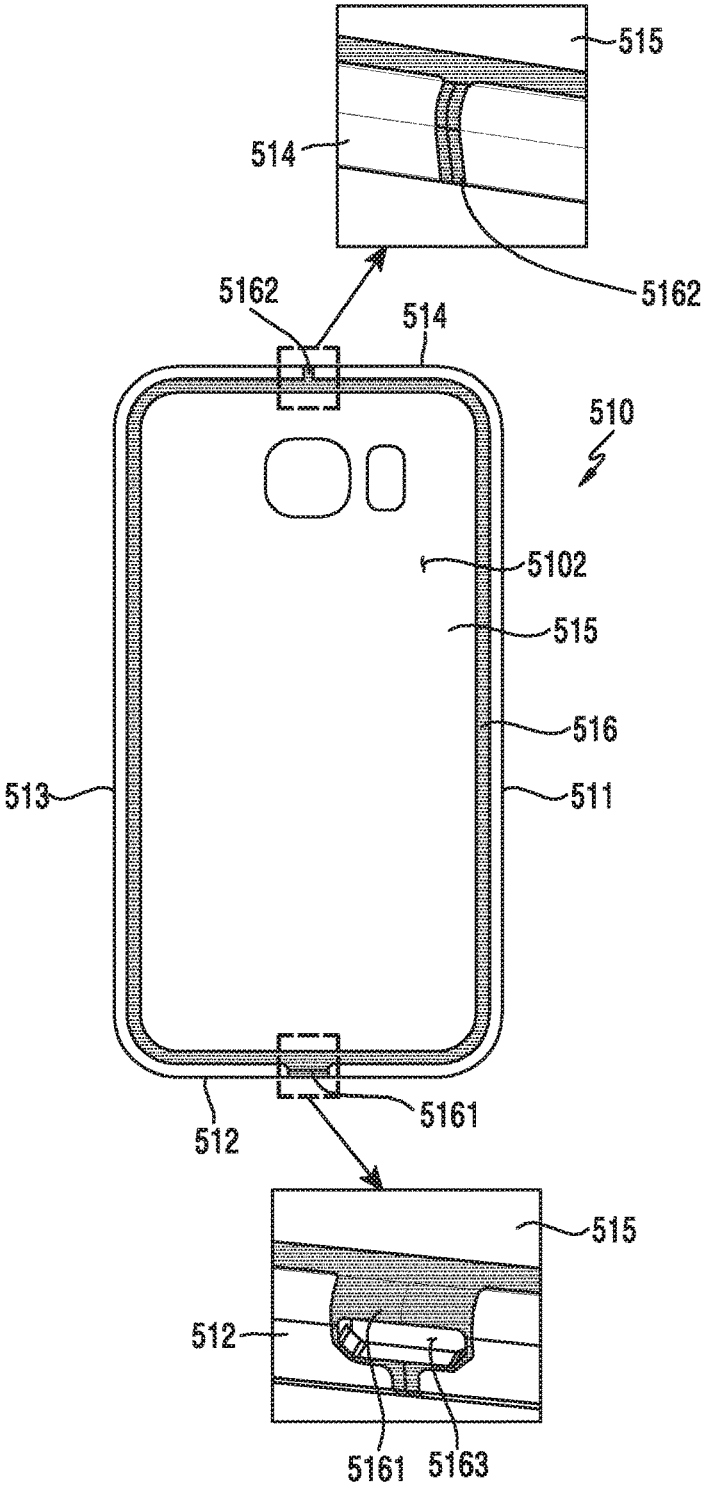
FIG. 5B is a view illustrating a configuration of a housing, to which a non-conductive strip is applied, according to an embodiment of the present disclosure.

FIG. 5B is a view illustrating a configuration of the housing, to which a non-conductive strip is applied, according to an embodiment of the present disclosure.

Referring to FIGS. 5A and 5B, the housing 510 of FIGS. 5A and 5B may be an embodiment of a housing that is similar to, or different from, the housing 310 of FIG. 3A or the housing 410 of FIG. 4.

The housing 510 is illustrated as viewed from above the rear face 5102. The housing 510 may include a front face having a substantially rectangular shape and facing in a first direction, the rear face 5102 having a substantially rectangular shape and facing in a second direction that is opposite to the first direction, and first to fourth side face members 511 to 514 that enclose together a space between the front face and the rear face 5102. According to one embodiment, at least a portion of the rear face 5102 and/or the side face members 511 to 514 may be formed of a conductive material.

One or more slits 5101-1 and 5101-2 that are separated from the side faces 511 to 514 may be formed along the rim 515-R of the conductive plate 515. The housing 510 may include a first conductive connection part 5151 that electrically connects a portion of the first side face member 511 to the conductive plate 515, and a second conductive connection part 5152 that electrically connects a portion of the third side face member 513 to the conductive plate 515. Accordingly, the housing 510 may be formed in such a manner in which the conductive plate 515 and the side face members 511 to 514 are maintained in a physically separated state by the slits 5101-1 and 5101-2 in the overall region, but may be formed to be connected to each other via the first and second conductive connection part 5151 and 5152. The slits 5101-1 and 5101-2 may be split into two slits (e.g., the first slit 5101-1 and the second slit 5101-2) by the first and second conductive connection parts 5151 and 5152 that physically connect the first side face member 511 and the third side face member 513 to the metal plate 515, respectively.

The housing 510 may include a first split portion 5121 formed in order to split the second side face member 512 along the second slit 5101-2 and a second split portion 5141 formed in order to split the fourth side face member 514 along the first slit 5101. The slits 5101-1 and 5101-2 and the first and second split portions 5121 and 5141 may be filled with the non-conductive strip 516, as illustrated in FIG. 5B. At least one of the side face members 511, 512, 513, and 514 may include at least one connection piece 5153, 5154, 5155, or 5156 that protrudes to the inside of the housing 510 (e.g., toward the conductive plate). According to one embodiment, the connection pieces 5153 to 5156 may include power feeding pieces 5153 and 5155, which are electrically connected to a power feeding unit of the board disposed inside the housing 510, and ground pieces 5154 and 5156, which are electrically connected to a ground unit of the board. The power feeding pieces 5153 and 5155 may protrude while maintaining the state of being electrically insulated from the conductive plate 515, and the ground pieces 5154 and 5156 may be physically connected to the conductive plate 515.

The first and second conductive connection parts 5151 and 5152 and the connection pieces 5153 to 5156 may be formed to be lower than the conductive plate 515 when viewed from above the rear face 5102 of the housing 510. Thus, when the non-conductive strip 516 is filled in the first and second split portions 5121 and 5141 and the slits 5101-1 and 5101-2, the first and second conductive connection parts 5151 and 5152 and the connection pieces 5153 to 5156 may not be visually exposed to the rear face 5102 of the housing 510.

As illustrated in FIG. 5B, the housing 510 may include a first protrusion 5161 that is filled in the first split portion 5121 formed in the second side face member 512 and extends from the non-conductive strip 516. The first protrusion 5161 has a port hole 5163 configured to accommodate an interface connector port. The housing 510 may include a second protrusion 5162 that is filled in the fourth split portion 5141 formed in the fourth side face member 514 and extends from the non-conductive strip 516. The second side face member 512 is split by the first protrusion 5161, and the fourth side face member 514 may be split by the second protrusion 5162.

Figure 6A:
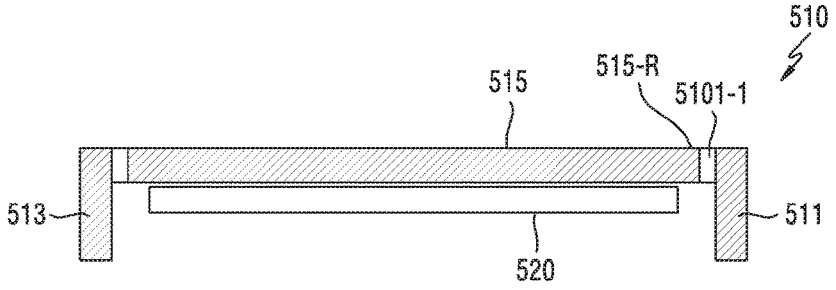
FIG. 6A is a sectional view taken along line A-A' of FIG. 5A according to an embodiment of the present disclosure.

FIG. 6A is a sectional view taken along line A-A' of FIG. 5A according to an embodiment of the present disclosure.

Referring to FIG. 6A, the first side face member 511 and the third side face member 513 may be formed to be physically or electrically split in at least a partial region by the first slit 5101-1 formed along the rim 515-R of the conductive plate 515 and having a predetermined width, and the corresponding slit 5101-1 may be filled with a non-conductive strip.

Figure 6B:
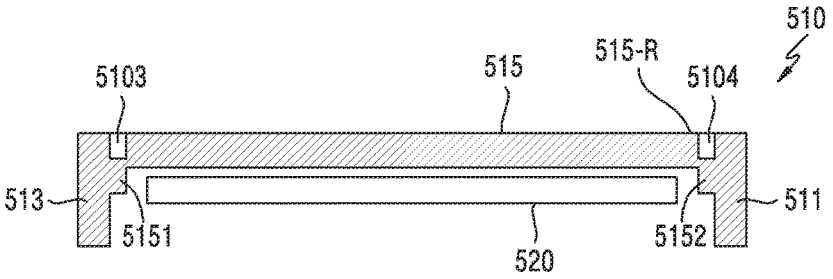
FIG. 6B is a sectional view taken along line B-B' of FIG. 5A according to an embodiment of the present disclosure.

FIG. 6B is a sectional view taken along line B-B' of FIG. 5A according to an embodiment of the present disclosure.

Referring to FIG. 6B, the first side face member 511 is connected to the conductive plate by the first electric connection part 5151, and the third side face member 513 may be connected to the conductive plate 515 by the second electric connection part 5152. The first and second connection parts 5151 and 5152 have seating recesses 5103 and 5104 that are formed to have a surface lower than the top surface of the conductive plate 515. Thus, even if the non-conductive strip is filled along the slits 5101-1 and 5101-2, a non-conductive strip of a continuous closed loop shape may be formed along the rim 515-R of the conductive plate 515 when viewed from the rear side of the housing 510. This may improve the beauty of the external appearance of the electronic device, and may guide smooth coating of an opaque painting layer or a transparent painting layer that may be coated on the upper portion of the electronic device.

Figure 6C:
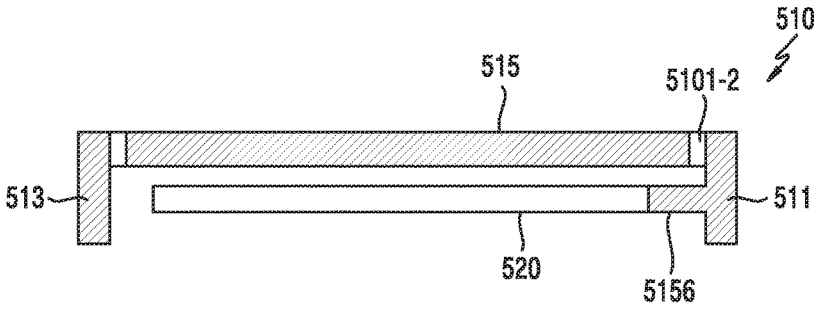
FIG. 6C is a sectional view taken along line C-C' of FIG. 5A according to an embodiment of the present disclosure.

FIG. 6C is a sectional view taken along line C-C' of FIG. 5A according to an embodiment of the present disclosure.

Referring to FIG. 6C, a connection piece 5156 may be formed to protrude from the first side face member 511 to the inside of the housing 510. The connection piece 5156 is not connected to the conductive plate 515, but may be electrically connected to the board 520. Without being limited thereto, however, the connection piece 5156 may be formed to be physically connected to the conductive plate 515 that is electrically connected to a ground region of the board 520.

Figure 6D:
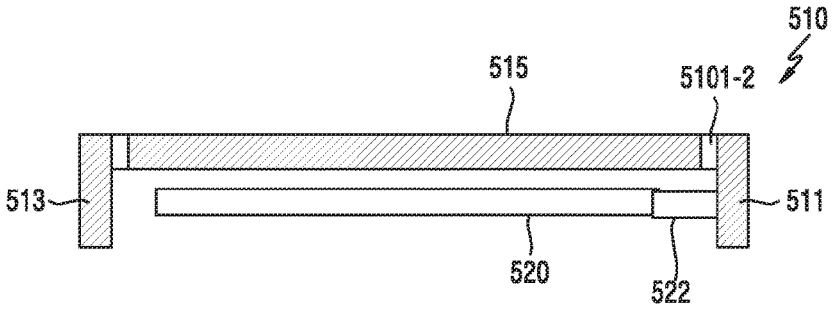
FIG. 6D is a sectional view illustrating a state in which a side face member is electrically connected to a board according to an embodiment of the present disclosure.

FIG. 6D is a sectional view illustrating a state in which a side face member is electrically connected to a board according to an embodiments of the present disclosure.

Referring to FIG. 6D, the first side face member 511 and the board 520 may be electrically connected to each other through a flexible electric connection member 522. The flexible electric member 522 may include a C-clip, a conductive tape, or a conductive pad.

Figure 7A:
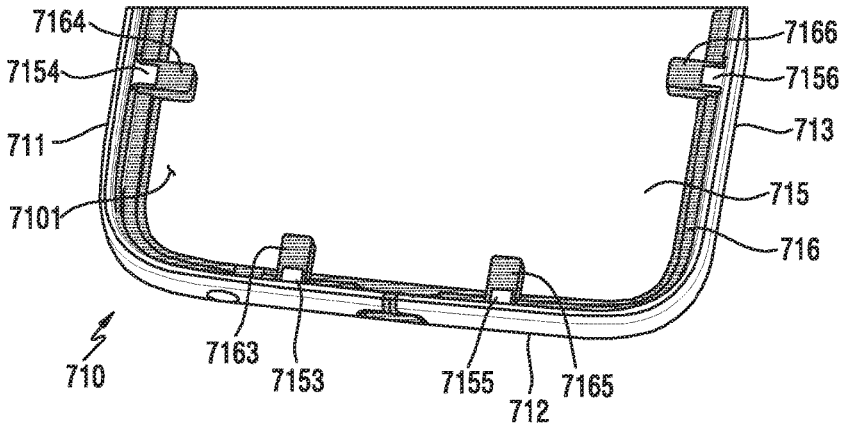
FIG. 7A is a perspective view illustrating a state in which a non-conductive strip is applied to a slit of a housing according to an embodiment of the present disclosure.

FIG. 7A is a perspective view illustrating a state in which a non-conductive strip is applied to a slit of a housing according to an embodiment of the present disclosure.

Figure 7B:
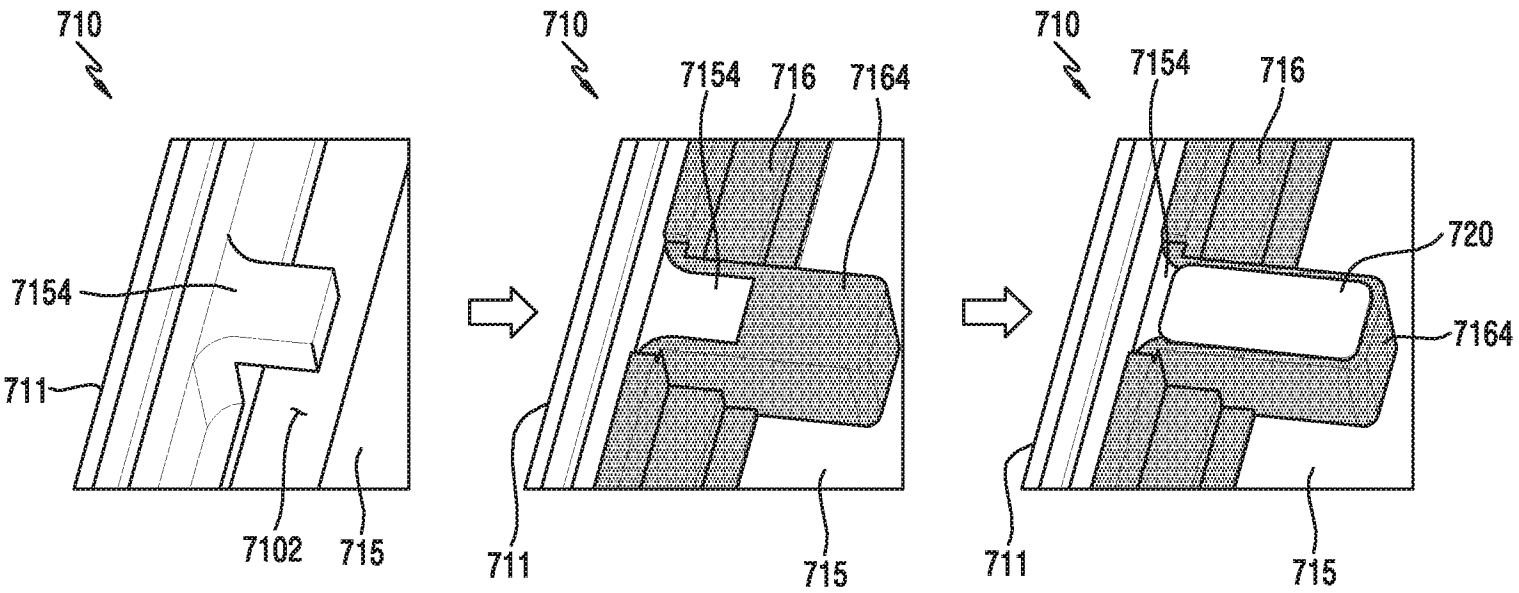
FIG. 7B is a perspective view illustrating an assembly sequence of a connection piece of the housing according to an embodiment of the present disclosure and the non-conductive strip.

FIG. 7B is a perspective view illustrating an assembly operation of a connection piece of the housing according to an embodiment of the present disclosure and the non-conductive strip.

Figure 7C:
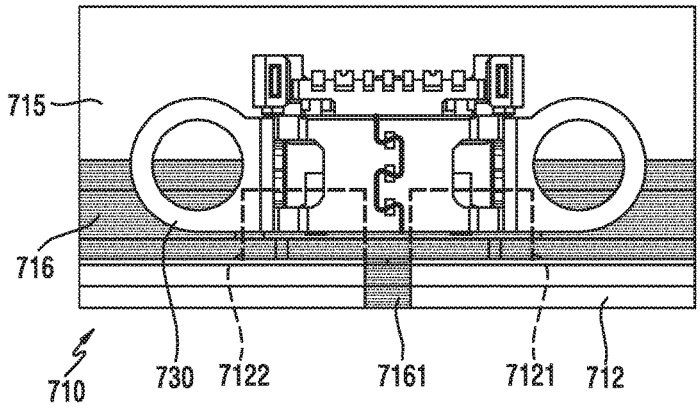
FIG. 7C is a view illustrating an assembly relationship of the non-conductive strip in the vicinity of an interface connector port according to an embodiment of the present disclosure.

FIG. 7C is a view illustrating an assembly relationship of the non-conductive strip in the vicinity of an interface connector port according to an embodiment of the present disclosure.

Referring to FIGS. 7A to 7C, the housing 710 of FIGS. 7A to 7C may be a housing that is similar to, or different from, the housing 310 of FIG. 3A, the housing 410 of FIG. 4, or the housing 510 of FIGS. 5A to 5B and 6A to 6D.

FIGS. 7A and 7B illustrate perspective views when viewed from above the front face of the housing. Although the figures illustrate a connective relationship between at least one of the connection pieces 7153 to 7156, which extend to the inside (toward the conductive plate) from a partial region of the second side face member 712 and the first and second side face members 711 and 713 of the housing 710, and the non-conductive strip 716, the present disclosure is not limited thereto. For example, at least one of the connection pieces 7153 to 7156 may also be formed to extend from the remaining region (not illustrated) of the first and third side face members 711 and 713 and a region of the fourth side face member (not illustrated) of the housing 710, which is arranged in the direction opposite to the second side face member 712.

Referring to FIGS. 7A and 7B, the housing 710 may include a conductive plate 715 including a greater region of the rear face 7101, and first to third side face members 711 to 713, which are formed along the rim of the conductive plate 715, and may also include a non-conductive strip 716 filled in a slit 7102 between the conductive plate 715 and the first to third side face members 711 to 713. The first to third side face members 711 to 713 may include connection pieces 7153 to 7156 that are formed to protrude to the inside of the housing 710. The connection pieces 7153 to 7156 may be electrically connected to a board that is disposed inside the housing 710. The connection pieces 7153 to 7156 may include a power feeding piece or a ground piece for the side face members 711 to 713, and may be used as antenna radiators.

The connection pieces 7153 to 7156 may be coupled together when the non-conductive strip 716 is injection molded. The connection pieces 7153 to 7156 may include extension pieces 7163 to 7166, respectively, which are formed to extend from the non-conductive strip 716 in such a manner of enclosing the connection pieces 7153 to 7156 in order to include the lengths of the connection pieces 7153 to 7156. The inward lengths of the connection pieces 7153 to 7156 may be limited according to a processing (e.g., CNC cutting) method. For example, when the CNC cutting method is used, the connection pieces 7153 to 7156 may extends inwardly only within the width of the slit 7102 of the housing 710. In order to increase the connection pieces 7153 to 7156 to be equal to, or longer than, the width of the slit 7102 of the housing 710, the extension pieces 7163 to 7166, which are integrally formed when injection molding the non-conductive strip 716, may be arranged, and the conductive connection pad 720 may be attached thereon. The connection pieces 7153 to 7156, which protrude inwardly from the side face members 711 to 713 in a manner in which the conductive connection pad 720 is in contact with the corresponding connection part of the board, may be electrically connected to the board.

Referring to FIG. 7C, the housing 710 may include a non-conductive strip 716 interposed between the conductive plate 715 and the second side face member 712. The non-conductive strip 716 may include a first protrusion 7161 that protrudes toward the second side face member. The second side face member 712, which is made of a metallic material, may maintain the state split by the first protrusion 7161 extending from the non-conductive strip 716, and thus, may be vulnerable in rigidity. In order to reinforce the rigidity, the second side face member 712 may include at least one reinforcing piece 7121 and 7122, which is formed in the vicinity of the first protrusion 7161 to extend toward the non-conductive strip 716. When the non-conductive strip 716 is insert-molded with an interface connector port 730 on the second side face member 712, the rigidity in the vicinity of the first protrusion 7161 may be reinforced by the reinforcing piece 7121.

Figure 8:
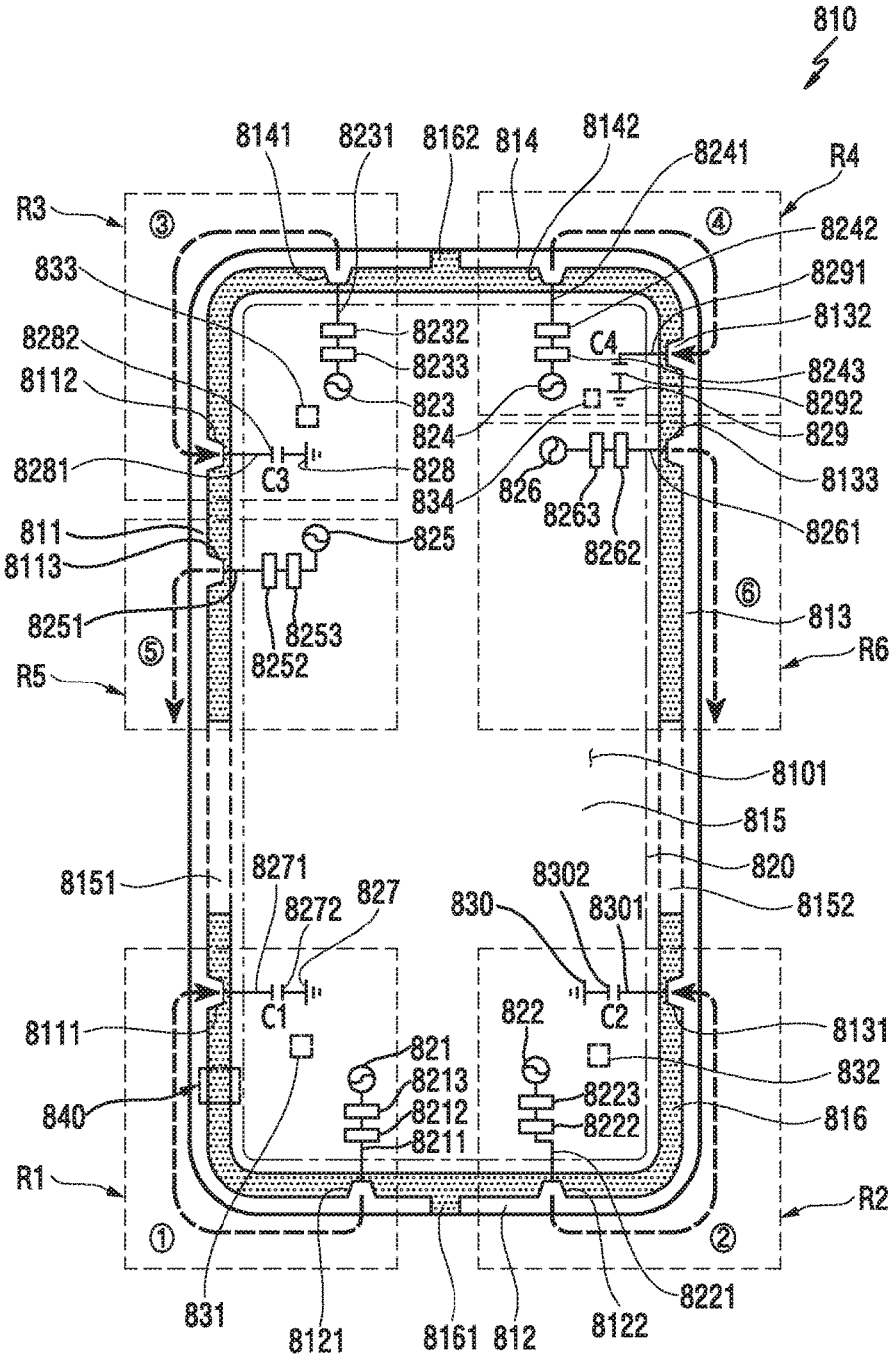
FIG. 8 is a view illustrating an electric connection relationship between a housing used as an antenna radiator and a board according to an embodiment of the present disclosure.

FIG. 8 is a view illustrating an electric connection relationship between a housing used as an antenna radiator and a board according to an embodiment of the present disclosure.

Referring to FIG. 8, the housing 810 of FIG. 8 may be an embodiment of a housing that is similar to, or different from, the housing 310 of FIG. 3A, the housing 410 of FIG. 4, the housing 510 of FIGS. 5A to 5B and 6A to 6D, or the housing 710 of FIGS. 7A to 7C.

Referring to FIG. 8, the housing 810 may include, a metal plate 815 that occupies a greater portion of the rear face, and first to fourth side face members 811 to 814 that extend in a manner of enclosing the rim of the metal plate 815 when viewed from the rear side of the housing 810.

When viewed from above the rear face 8101 of the electronic device, the housing 810 may include a non-conductive strip 816 that encloses a greater portion of the conductive plate 815 and extends along the first to fourth side face members 811 to 814. The non-conductive strip 816 may be coupled to the housing 810 made of a metallic material through an insert molding. Without being limited thereto, however, the non-conductive strip 816 may be coupled to the housing 810 made of a metallic material through a mechanical assembly method.

The housing 810 may include a first conductive connection part 8151 that electrically connects a portion of the first side face member 811 to the conductive plate 815, and a second conductive connection part 8152 that electrically connects a portion of the third side face member 813 to the conductive plate 815. The housing 810 may be formed in such a manner in which the conductive plate 815 and the side face members 811 to 814 are maintained in a physically separated state by the slits in the overall region, but may be formed to be connected to each other via the first and second conductive connection part 8151 and 8152.

The first to fourth side face members 811 to 814 of the housing 810 may be maintained in a state in which the whole or at least a partial region of the first to fourth side face members 811 to 814 are electrically disconnected from the conductive plate 815 by the non-conductive strip 816. At least one of the first to fourth side face members 811 to 814 of the housing 810 may be configured to be electrically separated by the non-conductive strip 816 in at least one location. For example, when a portion of the non-conductive strip 816 extends toward at least one of the first to fourth side face members 811 to 814 so as to be disposed between two regions of the corresponding side face member, which are spaced apart from each other, the corresponding side face member may be split into electrically separated portions. As a portion of the non-conductive strip 816 arranged along the rim of the conductive plate 815 extends toward the side face members, the first to fourth side face members 811 to 814 may be split into a plurality of portions.

The housing 810 may be separated into two portions by a first protrusion 8161 extending from the non-conductive strip 816 toward the second side face member 812 and a second protrusion 8162 extending from the non-conductive strip 816 toward the fourth side face member 814. Without being limited thereto, however, the housing 810 may be split into two or more portions depending on the number of protrusions. The protrusions may be made of the same material as the non-conductive strip 816 to extend from the non-conductive strip 816, but are not limited thereto. For example, the protrusions may be replaced by non-conductive additional members for splitting the housing 810 made of a metallic material.

The side face members 811 to 814 of the housing 810 may operate as a plurality of antenna units R1 to R6 by being split by the non-conductive strip 816 and the first and second protrusions 8161 and 8162 and then being fed with power at a plurality of positions. The left region of the second side face member 812 split by the first protrusion 8161 may operate as the first antenna unit R1 together with a partial region of the first side face member 811. The right region of the second side face member 812 split by the first protrusion 8161 may operate as the second antenna unit R2 together with a partial region of the third side face member 813. The left region of the fourth side face member 814 split by the second protrusion 8162 may operate as the third antenna unit R3 together with a partial region of the first side face member 811. The right region of the fourth side face member 814 split by the second protrusion 8162 may operate as the fourth antenna unit R4 together with a partial region of the third side face member 813. A portion of the first side face member 811 may operate as a fifth antenna unit R5 separately from the third antenna unit R3. A portion of the third side face member 813 may operate as a sixth antenna unit R6 separately from the fourth antenna unit R4.

In each of the antenna units R1 to R6, at least a portion of each of the side face members 811 to 814 may be electrically connected (e.g., fed with power and/or grounded) to the board 820 in a non-conductive strip region in which the conductive connection parts do not exist. Each of the antenna units R1 to R6 may also operate in at least one band. The first antenna unit R1 may operate in a low band and a mid band, or may operate in a low band and a high band. The second antenna unit R2 may operate in a mid band and a high band. The third antenna unit R3 may operate in a low band, a mid band, and a high band. The fourth antenna unit R4 may operate in a GPS band, a mid band, and a WiFi1 band. The fifth antenna unit R5 may operate in a high (4 MIMO) band. According to one embodiment, the sixth antenna unit R6 may operate in a WiFi2 band. The respective antenna units may operate complementarily or individually.

The first antenna unit R1 may include a first power feeding piece 8121, which protrudes to the inside of the housing 810 from the second side face member 812 and is electrically connected to the first power feeding unit 821, and a first ground piece 8111, which protrudes to the inside of the housing 810 from the first side face member 811 and is electrically connected to the first ground unit 827 of the board 820. The board 820 may be directly electrically connected to the housing 810 through the first power feeding piece 8121 and the first ground piece 8111. The electronic device may further include a flexible electric connection member (e.g., a C-clip, a conductive tape, or a conductive pattern), and the board 820 may be electrically connected to the housing 810 through the first power feeding piece 8121, the first ground piece 8111, and the flexible electric connection member.

The first power feeding piece 8121 disposed in the second side face member 812 may be electrically connected to an electric path 8211 (e.g., a pattern and a conductive pad formed on the board) electrically connected to the first power feeding unit 821 of the board 820. Because the board 820 may be configured to be directly electrically contacted with the housing 810 made of a metallic material, the electric path 8211 may further include an electric shock prevention circuit 8212 configured to prevent electric shock and to perform ElectroStatic Discharge (ESD), and a matching circuit 8213 configured to tune the first antenna unit R1 to a desired frequency band.

The first ground piece 8111, which is spaced from the first power feeding piece 8121 and disposed in the first side face member 811, may be electrically connected to an electric path 8271 (e.g., a pattern and a conductive pad formed on the board) electrically connected to the first ground unit 827 of the board 820. Because the board 820 may be configured to be directly electrically contacted with the housing 810 made of a metallic material, the electric path 8271 may further include an electric shock prevention circuit 8272 (e.g., a capacitor) in order to prevent electric shock and to perform electrostatic discharge.

The first antenna unit R1 may operate as an antenna radiator that includes a radiation current path (region ① of FIG. 8) in the form of being grounded to the board 820 through the first power feeding piece 8121 of the second side face member 812 and the first ground piece 8111 of the first side face member 811.

Figure 9A:
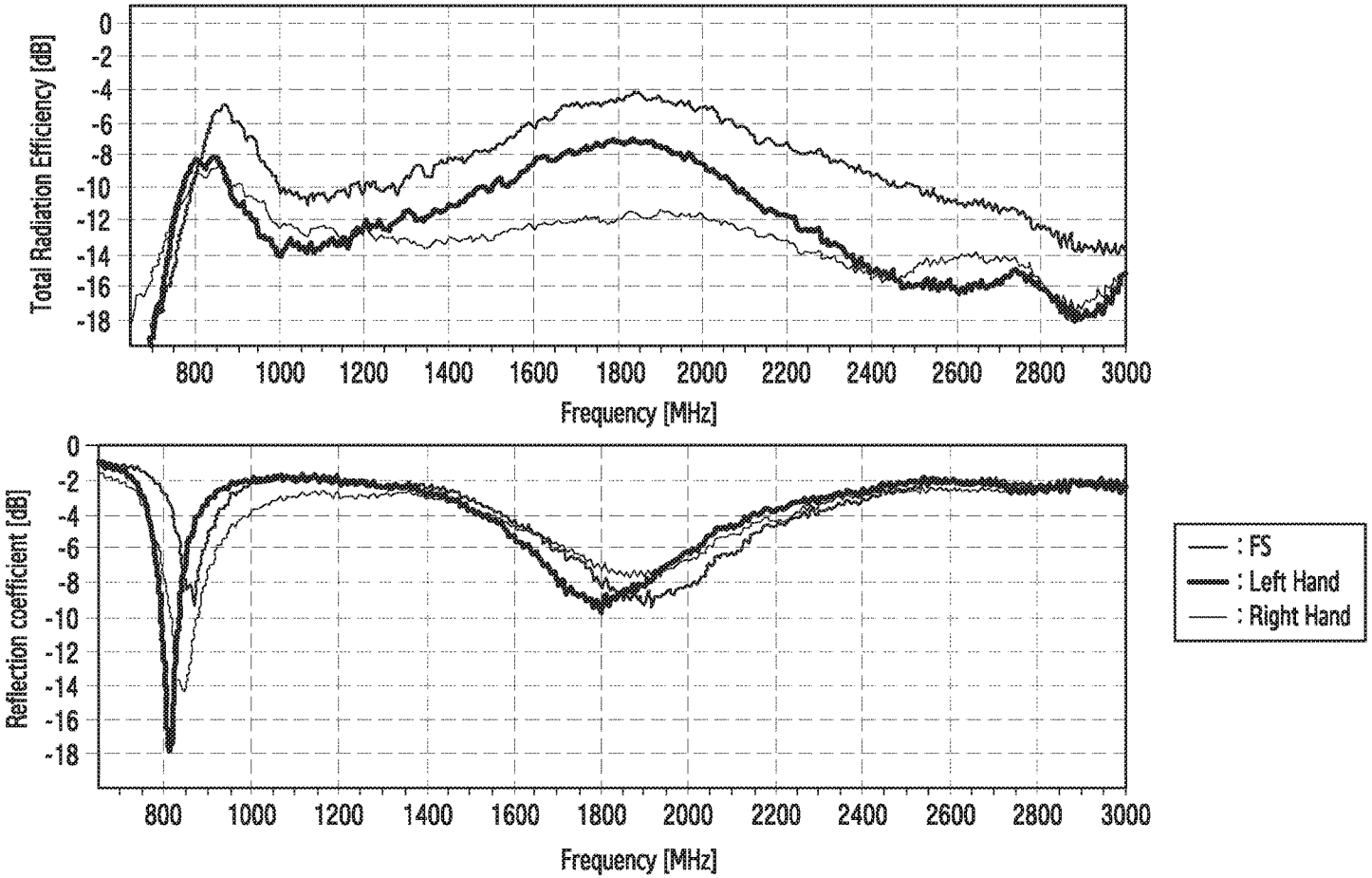
FIGS. 9A,9B, and 9C are graphs representing radiating characteristics according to a hand effect of a first antenna unit of FIG. 8 according to an embodiment of the present disclosure.
Figure 9B:
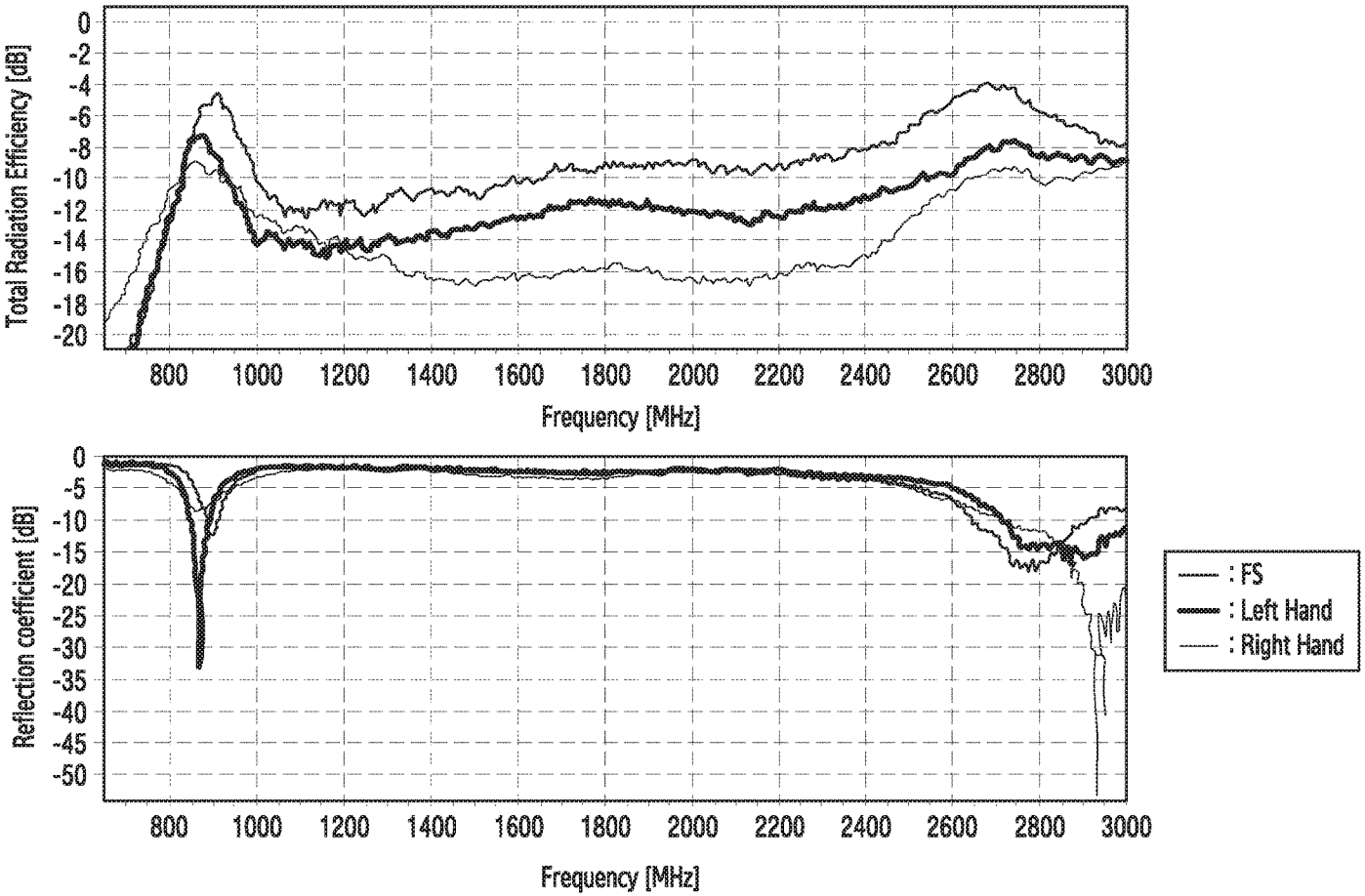
Figure 9C:
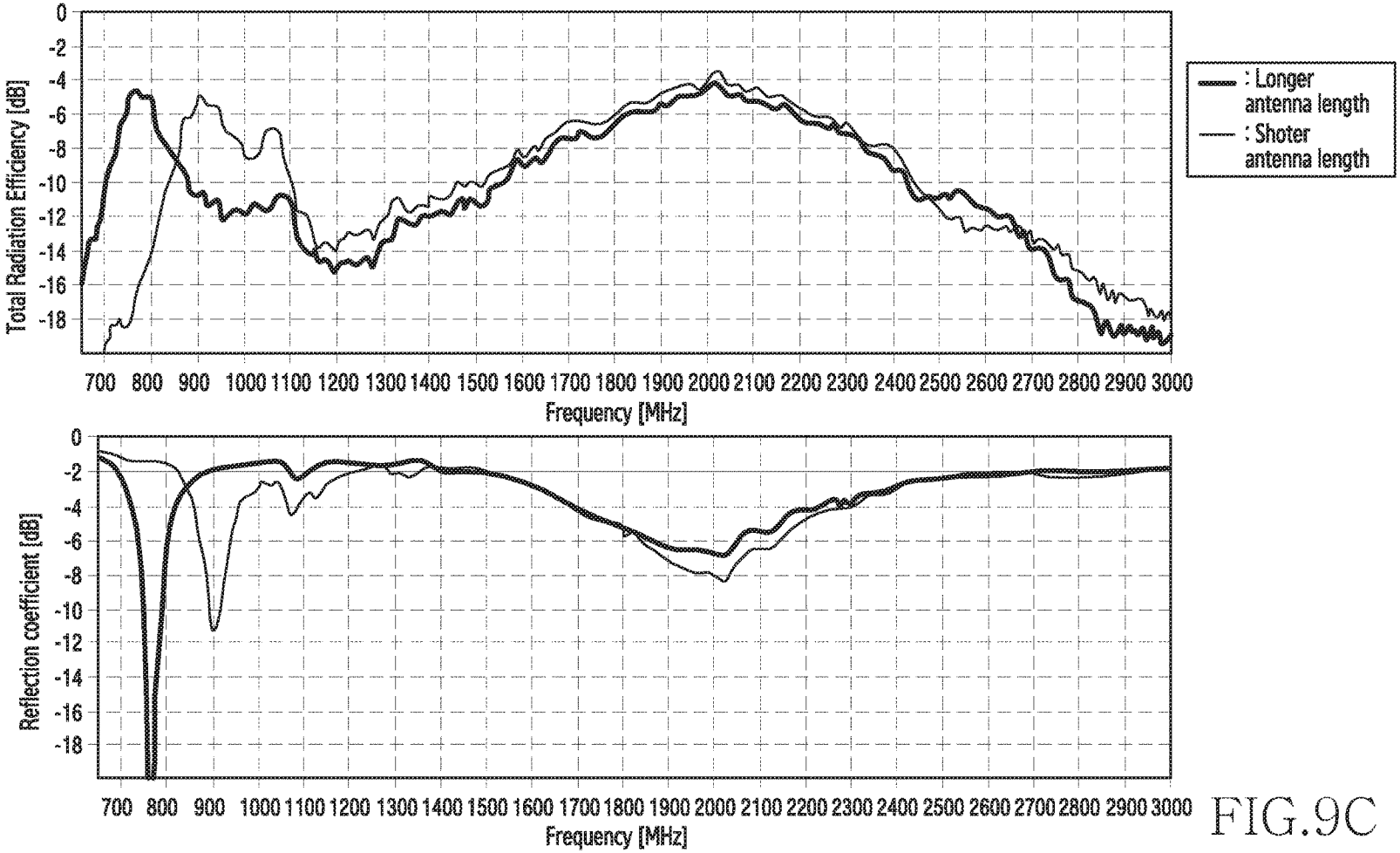

FIGS. 9A to 9C are graphs representing radiating characteristics according to a hand effect of a first antenna unit of FIG. 8 according to various embodiments of the present disclosure.

Referring to FIGS. 9A to 9C, even in the case of the left hand phantom or right hand phantom, the radiation characteristics do not considerably decrease as compared to radiation characteristics on a free space. In the case where the first antenna unit operates in the low band and the mid band, the first antenna unit may smoothly perform a transmission/reception signal process (Tx/Rx), and may smoothly perform a reception signal process (Rx) in the mid band. In the case where the first antenna unit operates in the low band and the high band, the first antenna unit may smoothly perform a transmission/reception signal process (Tx/Rx) in the low band, and may smoothly perform a reception signal process (Rx) in the high band.

The first antenna unit may be implemented to operate in a desired frequency band by adjusting the electric length between the first power feeding piece and the first ground piece. For example, as illustrated in FIG. 9C, when the electric length between the first power feeding piece and the first ground piece of the first antenna unit is formed to be relatively short, the operating frequency band is shifted from the low frequency band to a relatively high frequency band.

Figure 10:
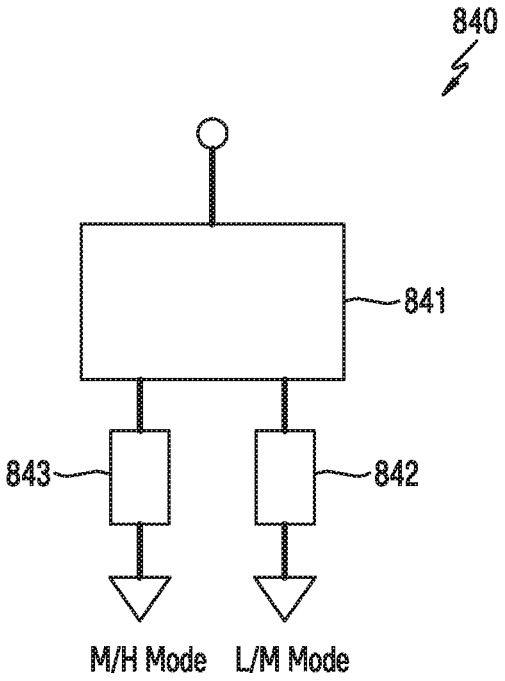
FIG. 10 is a view illustrating a switching unit disposed in the first antenna unit of FIG. 8 according to an embodiment of the present disclosure.

FIG. 10 is a view illustrating a switching unit disposed in the first antenna unit of FIG. 8 according to an embodiment of the present disclosure.

Referring to FIG. 8, a switching unit 840 may further disposed in the above-described radiation path of the first antenna unit. The operating frequency band of the first antenna unit R1 may be changed according to the switching operation of the switching unit 840.

Referring to FIG. 10, the switching unit 840 may include a switch 841 configured to operate under the control of a control unit of the electronic device (e.g., a processor), and at least one first element 842 and at least one second element 843 that are commonly connected to the switch 841. According to one embodiment, the control unit of the electronic device may control the switch 841 so as to selectively electrically connect the first element 842 or the second element 843. The control unit of the electronic device may change the operating frequency of the first antenna unit R1 by selecting the first element 842 or the second element 843. The first element 842 may include at least one inductor having a predetermined inductance value. The second element 843 may include at least one capacitor having a predetermined capacitance value. However, without being limited thereto, the electronic device may actively change the operating frequency band of the first antenna unit according to a peripheral situation by arranging a tunable IC in the above-described radiation path, instead of the switching unit.

Figure 11:
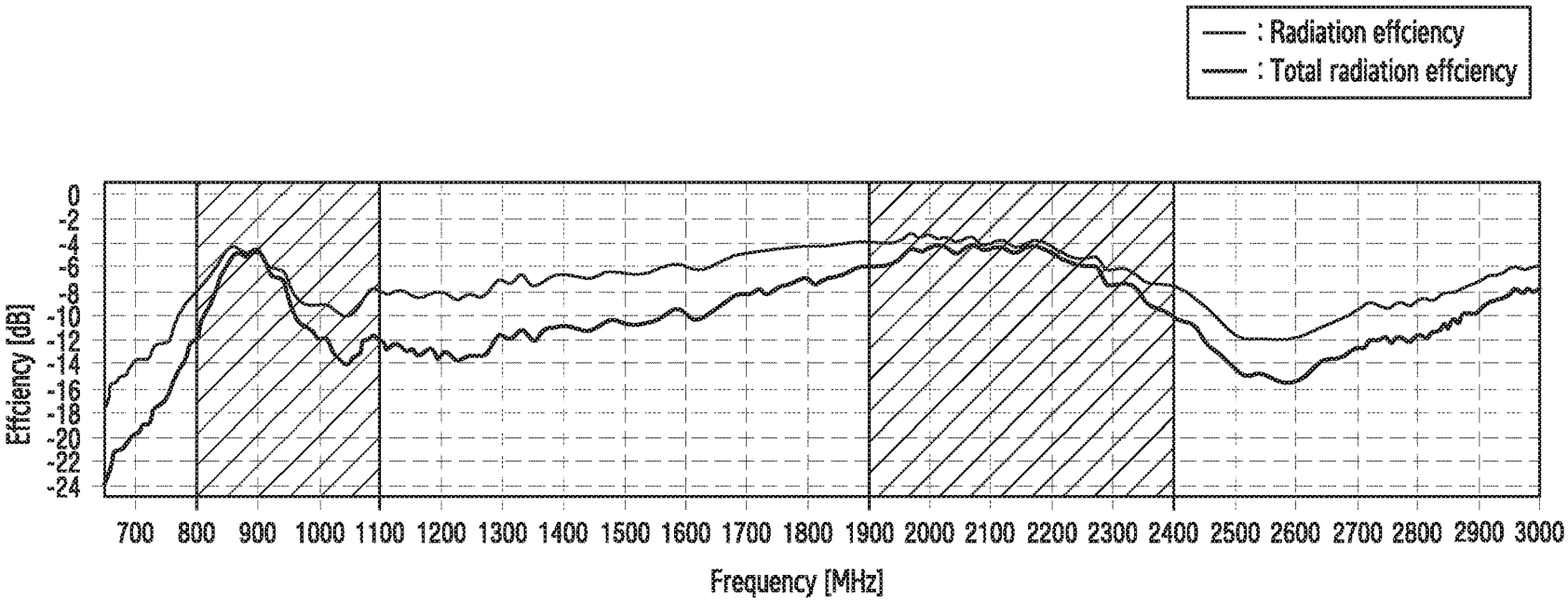
FIGS. 11 and 12 are graphs illustrating radiation characteristics of the first antenna unit according to the operation of the switching units of FIGS. 8 and 10 according to an embodiment of the present disclosure.
Figure 12:
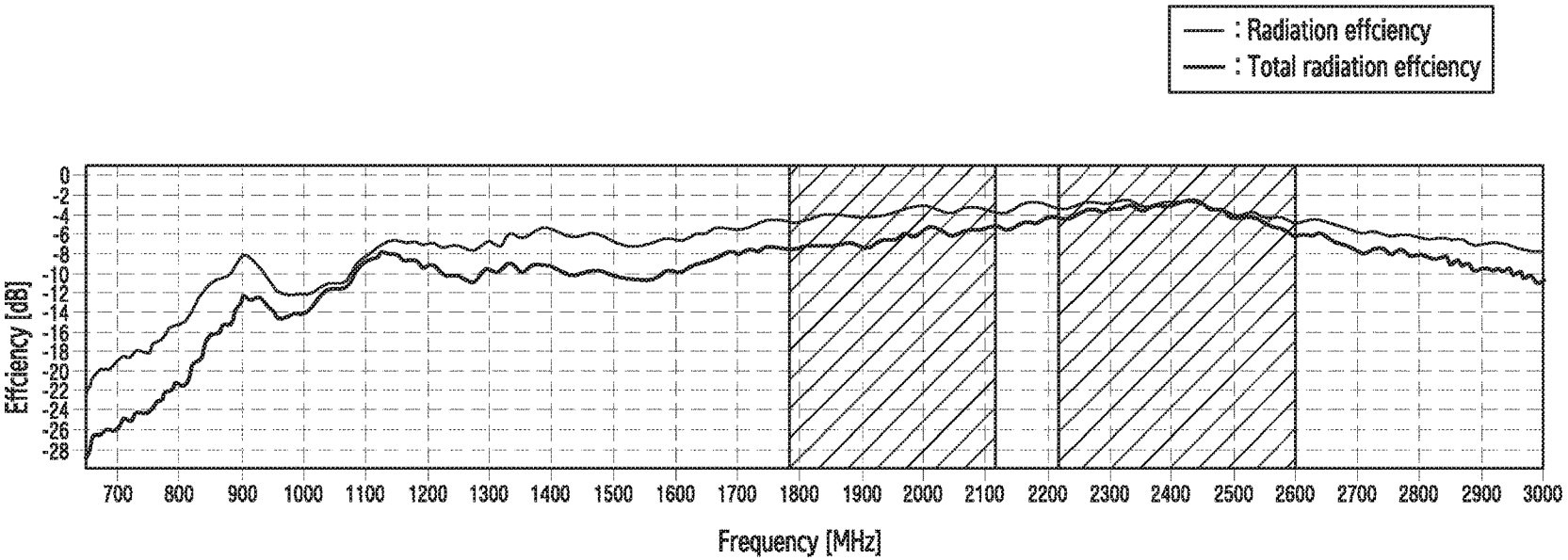

FIGS. 11 and 12 are graphs illustrating radiation characteristics of the first antenna unit according to the operation of the switching units of FIGS. 8 and 10 according to various embodiments of the present disclosure.

Referring to FIG. 11, when the first antenna unit is electrically switched with the first element by the switching unit, the first antenna unit may operate in the low band and mid band.

Referring to FIG. 12, when the first antenna unit is electrically switched with the second element by the switching unit, the operating frequency band may be changed to operate in the mid band and high band.

Referring back to FIG. 8, the second antenna unit R2 may include a second power feeding piece 8122, which protrudes to the inside of the housing 810 from the second side face member 812 and is electrically connected to the second power feeding unit 822 of the board 820, and a second ground piece 8131, which protrudes to the inside of the housing 810 from the third side face member 813 and is electrically connected to the second ground unit 830 of the board 820. The board 820 may be directly electrically connected to the housing 810 through the second power feeding piece 8122 and the second ground piece 8131. The electronic device may further include a flexible electric connection member (e.g., a C-clip, a conductive tape, or a conductive pattern), and the board 820 may be electrically connected to the housing 810 through the second power feeding piece 8122, the second ground piece 8131, and the flexible electric connection member.

The second power feeding piece 8122 disposed in the second side face member 812 may be electrically connected to an electric path 8221 (e.g., a pattern and a conductive pad formed on the board) electrically connected to the second power feeding unit 822 of the board 820. Because the board 820 may be configured to be directly electrically contacted with the housing 810 made of a metallic material, the electric path 8221 may further include an electric shock prevention circuit 8222 configured to prevent electric shock and to perform ESD, and a matching circuit 8223 configured to tune the second antenna unit R2 to a desired frequency band.

The second ground piece 8131, which is spaced apart from the second power feeding piece 8122 by a predetermined distance and disposed in the third side face member 813, may be electrically connected to an electric path 8301 (e.g., a pattern and a conductive pad formed on the board) electrically connected to the second ground unit 830 of the board 820. Because the board 820 may be configured to be directly electrically contacted with the housing 810 made of a metallic material, the electric path 8301 may further include an electric shock prevention circuit 8302 (e.g., a capacitor) in order to prevent electric shock and to perform electrostatic discharge.

The second antenna unit R2 may operate as an antenna radiator that includes a radiation current path (region ② of FIG. 8) in the form of being grounded to the board 820 through the second power feeding piece 8122 of the second side face member 812 and the second ground piece 8131 of the third side face member 813.

The third antenna unit R3 may include a third power feeding piece 8141, which protrudes to the inside of the housing 810 from the fourth side face member 814 and is electrically connected to the third power feeding unit 823 of the board 820, and a third ground piece 8112, which protrudes to the inside of the housing 810 from the first side face member 811 and is electrically connected to the third ground unit 828 of the board 820. The board 820 may be directly electrically connected to the housing 810 through the third power feeding piece 8141 and the third ground piece 8112. The electronic device may further include a flexible electric connection member (e.g., a C-clip, a conductive tape, or a conductive pattern), and the board 820 may be electrically connected to the housing 810 through the third power feeding piece 8141, the third ground piece 8112, and the flexible electric connection member.

The third power feeding piece 8141 disposed on the fourth side face member 814 may be electrically connected to an electric path 8231 (e.g., a pattern and a conductive pad formed on the board) electrically connected to the third power feeding unit 823 of the board 820. Because the board 820 may be configured to be directly electrically contacted with the housing 810 made of a metallic material, the electric path 8231 may further include an electric shock prevention circuit 8232 configured to prevent electric shock and to perform ESD, and a matching circuit 8233 configured to tune the third antenna unit R3 to a desired frequency band.

The third ground piece 8112, which is spaced apart from the third power feeding piece 8141 by a predetermined distance and disposed on the first side face member 811, may be electrically connected to an electric path 8281 (e.g., a pattern and a conductive pad formed on the board) electrically connected to third ground unit 828 of the board 820. Because the board 820 may be configured to be directly electrically contacted with the housing 810 made of a metallic material, the electric path 8281 may further include an electric shock prevention circuit 8282 (e.g., a capacitor) in order to prevent electric shock and to perform electrostatic discharge.

The third antenna unit R3 may operate as an antenna radiator that includes a radiation current path (region ③ of FIG. 8) in the form of being grounded to the board 820 through the third power feeding piece 8141 of the fourth side face member 814 and the third ground piece 8112 of the first side face member 811.

The fourth antenna unit R4 may include a fourth power feeding piece 8142, which protrudes to the inside of the housing 810 from the fourth side face member 814 and is electrically connected to the fourth power feeding unit 824 of the board 820, and a fourth ground piece 8132, which protrudes to the inside of the housing 810 from the third side face member 813 and is electrically connected to the fourth ground unit 829 of the board 820. The board 820 may be directly electrically connected to the housing 810 through the fourth power feeding piece 8142 and the fourth ground piece 8132. The electronic device may further include a flexible electric connection member (e.g., a C-clip, a conductive tape, or a conductive pattern), and the board 820 may be electrically connected to the housing 810 through the fourth power feeding piece 8142, the fourth ground piece 8132, and the flexible electric connection member.

The fourth power feeding piece 8142 disposed on the fourth side face member 814 may be electrically connected to an electric path 8241 (e.g., a pattern and a conductive pad formed on the board) electrically connected to the fourth power feeding unit 824 of the board 820. Because the board 820 is configured to be directly electrically contacted with the housing 810 made of a metallic material, the electric path 8241 may further include an electric shock prevention circuit 8242 configured to prevent electric shock and to perform ESD, and a matching circuit 8243 configured to tune the fourth antenna unit R4 to a desired frequency band.

The fourth ground piece 8132, which is spaced apart from the fourth power feeding piece 8142 by a predetermined distance and disposed on the third side face member 813, may be electrically connected to an electric path 8291 (e.g., a pattern and a conductive pad formed on the board) electrically connected to the fourth power feeding unit 829 of the board 820. Because the board 820 may be configured to be directly electrically contacted with the housing 810 made of a metallic material, the electric path 8291 may further include an electric shock prevention circuit 8292 (e.g., a capacitor) to prevent electric shock and to perform electrostatic discharge.

The fourth antenna unit R4 may operate as an antenna radiator that includes a radiation current path (region ④ of FIG. 8) in the form of being grounded to the board 820 through the fourth power feeding piece 8142 of the fourth side face member 814 and the fourth ground piece 8132 of the third side face member 813.

The fifth antenna unit R5 may include a fifth power feeding piece 8113, which protrudes to the inside of the housing 810 from the first side face member 811, and is electrically connected to the fifth power feeding unit 825 of the board 820. The board 820 may be directly electrically connected to the housing 810 through the fifth power feeding piece 8113. The electronic device may further include a flexible electric connection member (e.g., a C-clip, a conductive tape, or a conductive pad), and the board 820 may be electrically connected to the housing 810 through the fifth power feeding piece 8113 and the flexible electric connection member.

The fifth power feeding piece 8113 disposed on the first side face member 811 may be electrically connected to an electric path 8251 (e.g., a pattern and a conductive pad formed on the board) electrically connected to the fifth power feeding unit 825 of the board 820. Because the board 820 may be configured to be directly electrically contacted with the housing 810 made of a metallic material, the electric path 8251 may further include an electric shock prevention circuit 8252 configured to prevent electric shock and to perform ESD, and a matching circuit 8253 configured to tune the fifth antenna unit R5 to a desired frequency band.

The fifth antenna unit R5 may be configured such that only the fifth power feeding piece 8113 of the first side face member 811 feeds power to the board, and may operate as an antenna radiator that includes a radiation path (region ⑤ of FIG. 8) that causes an electric length of λ/2 to be provided from the fifth power feeding piece 8113.

The sixth antenna unit R6 may include a sixth power feeding piece 8133, which protrudes to the inside of the housing 810 from the third side face member 813, and is electrically connected to the sixth power feeding unit 826 of the board 820. The board 820 may be directly electrically connected to the housing 810 through the sixth power feeding piece 8133. The electronic device may further include a flexible electric connection member (e.g., a C-clip, a conductive tape, or a conductive pad), and the board 820 may be electrically connected to the housing 810 through the sixth power feeding piece 8133 and the flexible electric connection member.

The sixth power feeding piece 8133 disposed on the third side face member 813 may be electrically connected to an electric path 8261 (e.g., a pattern and a conductive pad formed on the board) electrically connected to the sixth power feeding unit 826 of the board 820. Because the board 820 may be configured to be directly electrically contacted with the housing 810 made of a metallic material, the electric path 8261 may further include an electric shock prevention circuit 8262 configured to prevent electric shock and to perform ESD, and a matching circuit 8263 configured to tune the sixth antenna unit R6 to a desired frequency band.

The sixth antenna unit R6 is configured such that only the sixth power feeding piece 8133 of the third side face member 813 feeds power to the board 820, and may operate as an antenna radiator that includes a radiation path (region ⑥ of FIG. 8) that causes an electric length of λ/2 to be provided from the sixth power feeding piece 8133.

The board 820 may include additional ground protrusions 831 to 834 configured to strengthen the ground with a metal plate to be adjacent to the ground units 827 to 830, respectively. The ground protrusions may be formed to extend from the metal plate, or a flexible electric connection member (e.g., a C-clip) may be applied as each ground protrusion.

The second to sixth antenna units R2 to R6 may include a switching unit and/or a tunable IC (not illustrated), which are added for the purpose of changing or expanding the operating frequency band. The electronic device may be implemented to include six or more antenna units by additionally arranging a plurality of power feeding pieces and ground pieces when a space for each of the side face members 811 to 814 of the housing 810 is allowed.

Figure 13A:
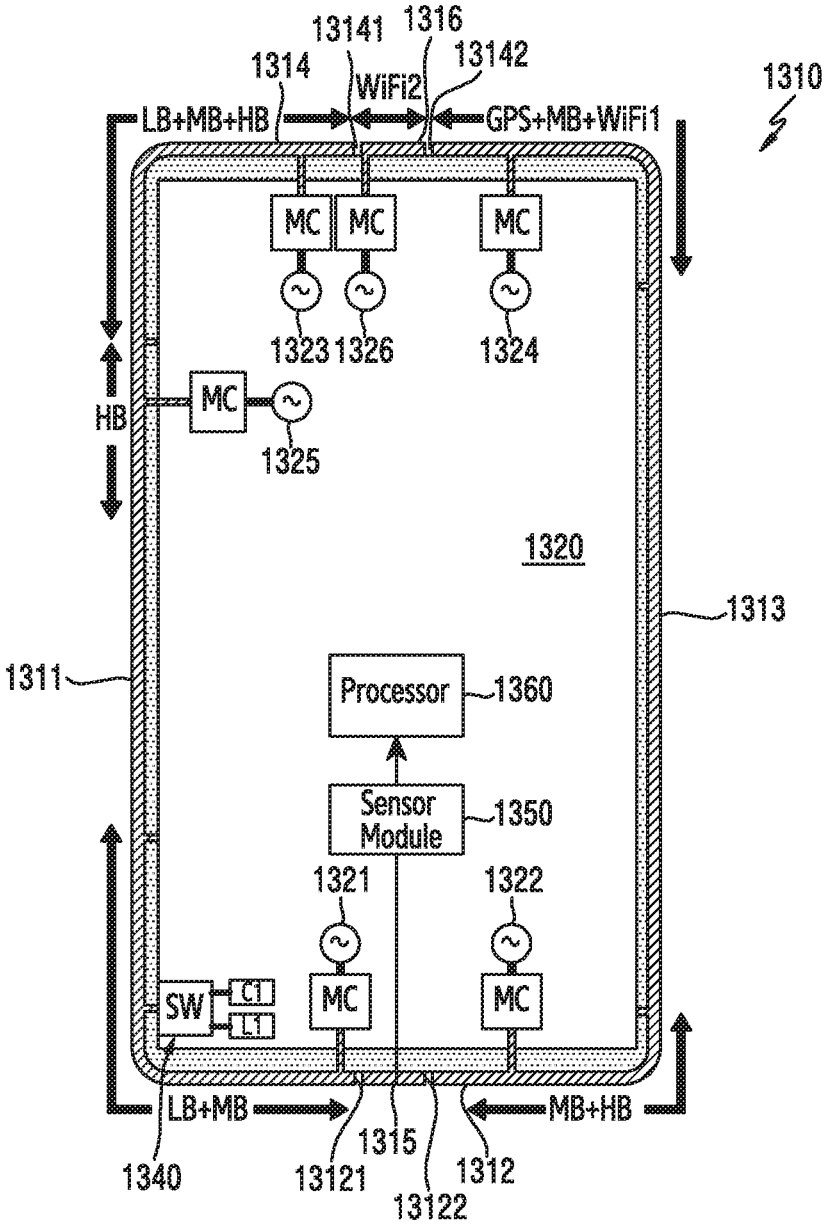
FIG. 13A is a view illustrating a housing split into four portions by non-conductive strips according to an embodiment of the present disclosure.

FIG. 13A is a view illustrating a housing split into four portions by non-conductive strips according to various embodiments of the present disclosure.

Figure 13B:
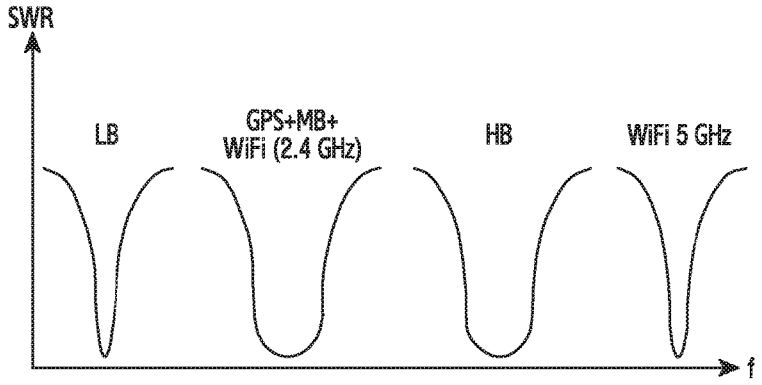
FIG. 13B is a graph illustrating radiation characteristics of respective antenna units according to the splitting of FIG. 13A according to an embodiment of the present disclosure.

FIG. 13B is a graph illustrating radiation characteristics of respective antenna units according to the splitting of FIG. 13A according to various embodiments of the present disclosure.

Referring to FIGS. 13A and 13B, the figures illustrate the four-split state obtained by applying four split portions and a protrusion formed by a non-conductive strip extending in each of the split portions. The non-conductive strips and protrusions are omitted, and only one pair of split portions formed on each of the second and fourth side face members of the housing are shown.

The housing 1310 may include first to fourth side face members 1311 to 1314 such that the housing 1310 may be formed to extend in a substantially rectangular shape. Each of the side members 1311 to 1314 may be arranged along the rim of the metal plate that occupies a greater region of the central portion. A non-conductive strip may be interposed between the metal plate and at least a partial region of the side face members. At least a partial region of at least one of the side face members may be electrically or physically connected by at least one conductive connection part.

The second side face member 1312 may be divided into three unit members by a pair of split portions 13121 and 13122. The fourth side face member 1314 may also be divided into three unit members by a pair of split portions 13141 and 13142. The side face members 1311 to 1314 of the housing 1310 may be divided into four portions by four split portions 13121, 13122, 13141, and 13142. Each of the divided unit members may be electrically connected to corresponding power feeding units 1321 to 1326 of the board 1320 in at least one region. Because the electric connection relationship is the same as, or similar to, the configuration of FIG. 8, the descriptions thereof will be omitted.

The left region of the second side face member 1312 split by the first split portion 13121 may operate in the Low Band (LB) and Mid Band (MB) as illustrated in FIG. 13B together with a partial region of the third side face member 1313. The right region of the second side face member 1312 split by the second split portion 13122 may operate in the Mid Band (MB) and High Band (HB) as illustrated in FIG. 13B together with a partial region of the first side face member 1311. The left region of the fourth side face member 1314 split by the third split portion 13141 may operate in the Low Band (LB), Mid Band (MB), and the High Band (HB) as illustrated in FIG. 13B together with a partial region of the third side face member 1313. At least a partial region of the third side face member 1313 is fed with power from a proper place, and may operate in the HB having an electric length of λ/2. The right region of the fourth side face member 1314 split by the fourth split portion 13142 may operate in the GPS band, Mid Band (MB), and WiFi1 band as illustrated in FIG. 13B together with a partial region of the first side face member 1311. According to one embodiment, the unit member 1316, which is disposed in the central portion of the fourth side face member 1314 divided by the third split portion 13141 and the fourth split portion 13142, may operate in the WiFi2 band as illustrated in FIG. 13B.

The unit member 1315, which is disposed in the central portion of the second side face member 1312 divided by the first split portion 13121 and the second split portion 13122, may operate as a sensor member. A sensor module 1350 controlled by a processor 1360 of the electronic device may be electrically connected to the unit member 1315, which operates as a sensor member. Alternatively, the unit member 1315 may be used as an antenna radiator.

The sensor module 1350 may be electrically connected to the unit member 1315 that operates as a grip sensor configured to detect the gripping of the electronic device by the user. The sensor module 1350 may include a grip sensor module. When the grip sensor operates by an approach of a human body, the processor 1360 may determine that the human body comes close to the electronic device, and may operate to automatically lower the power to a level that is not harmful to the human body (Specific Absorption Rate (SAR)) (SAR power limit backoff). When the grip sensor operates by an approach of a human body, the processor 1360 may determine that the human body comes close to the electronic device, and may control a switching member 1340 and or a tunable IC in order to tune the resonance frequency of an antenna device that suffers from degradation of performance to a frequency band where the electronic device is performing communication. When the access of a human body is detected, the processor 1360 may use another antenna to which no human body comes close. For example, when the access of a human body to the antenna disposed in the lower portion (e.g., the second side face member) is sensed, the processor may control the electronic device to transmit a signal through an antenna disposed in the upper portion (the fourth side face member) of the electronic device rather than transmitting the signal through the lower antenna of the electronic device.

The unit member 1315 may be used as an electrocardiography sensor member to check a heart rate of the human body. The unit member 1315 may be used as a temperature sensor member. The unit member 1315 may be used as an underwater recognition sensor (water infiltration sensor) configured to sense that it is under water by sensing the dielectric constant of a liquid.

Figure 14A:
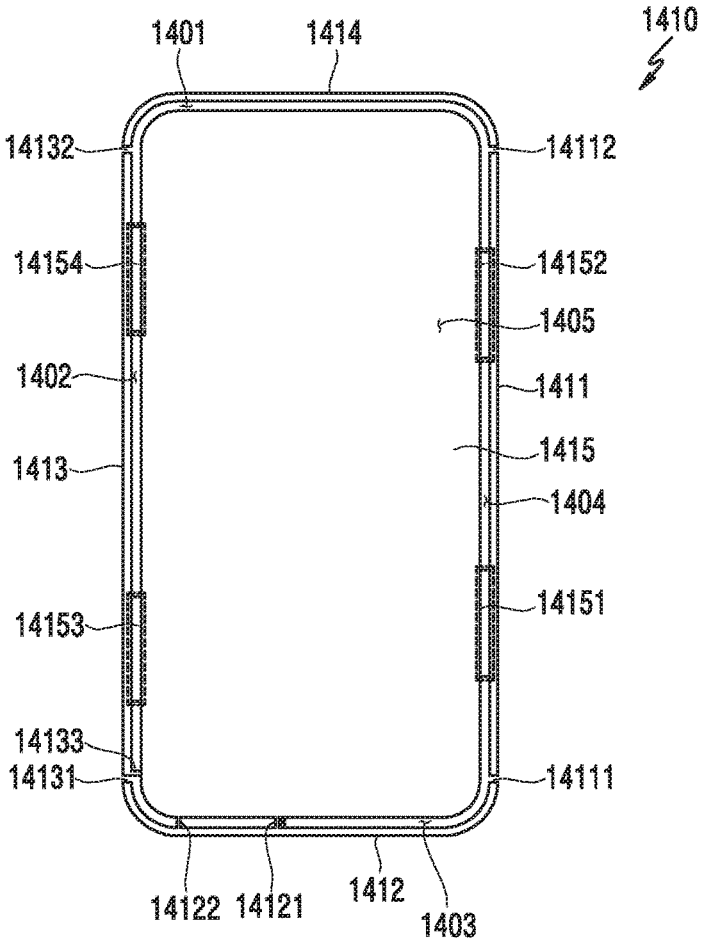
FIG. 14A is a view illustrating a configuration of a housing, in which left and right side face members are split into four portions, according to an embodiment of the present disclosure.

FIG. 14A is a view illustrating a configuration of a housing, in which left and right side face members are split into four portions, according to various embodiments of the present disclosure.

Figure 14B:
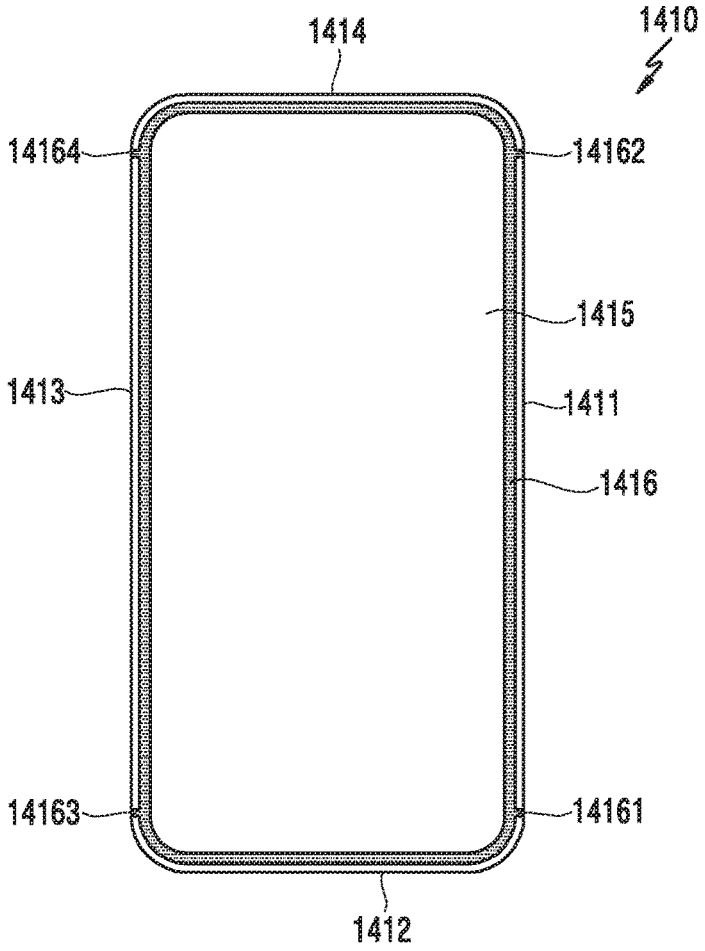
FIG. 14B is a view illustrating a state in which a non-conductive strip is applied to slits of FIG. 14A according to an embodiment of the present disclosure.

FIG. 14B is a view illustrating a state in which a non-conductive strip is applied to slits of FIG. 14A according to various embodiments of the present disclosure.

Referring to FIGS. 14A and 14B, the housing 1410 is illustrated in a state in which the housing 1410 is divided into four portions as four split portions 14111, 14112, 14131, and 14132 (a pair of split portions in each of the first side face member 1411 and the third side face member 1413).

The housing 1410 may be formed in a relatively rectangular shape, and, when viewed from above the rear face 1405, the housing 1410 may include first to fourth side face members 1411 to 1414, which are formed along the rim of the conductive plate 1415, with the slits 1401 to 1404 being interposed therebetween, respectively. The first to fourth side face members 1411 to 1414 of the housing 1410 may be maintained in a state in which at least a partial region of the first to fourth side face members 1411 to 1414 are electrically insulated from the conductive plate 1415. The first side face member 1411 may be electrically or physically connected with the conductive plate 1415 by the first and second conductive connection parts 14151 and 14152, which are spaced apart from each other by a predetermined distance. The third side face member 1413 may be electrically or physically connected with the conductive plate 1415 by the third and fourth conductive connection parts 14153 and 14154, which are spaced apart from each other by a predetermined distance. The conductive plate 1415 may be physically divided into four (4) slits 1401 to 1404 along the rim thereof by the first to fourth conductive connection parts 14151 to 14154. The conductive plate 1415 may physically maintain a predetermined gap with the side face members 1411 to 1414 in the region of the slits 1401 to 1404 by the four slits 1401 to 1404. A non-conductive strip 1416 may be filled in at least each of the slits 1401 to 1404 or the conductive connection parts 14151 to 14154 in an injection molding manner. The non-conductive strip 1416 may be filled to extend to each of the split portions 14111, 14112, 14131, and 14132. The non-conductive strip 1416 may be filled to the first split portion 14111 to the fourth split portion 14132 so as to form the first to fourth protrusions 14161 to 14164, respectively.

At least one of the side face members 1411, 1412, 1413, and 1414 may include at least one connection piece 14121, 14122, or 14133 that is formed toward the metal plate 1415. Each of the connection pieces 14121 to 14133 is electrically connected to a corresponding connection part (e.g., a power feeding unit or a ground unit) of the board disposed inside the housing 1410 such that the corresponding side face member may operate as an antenna radiator.

Figure 14C:
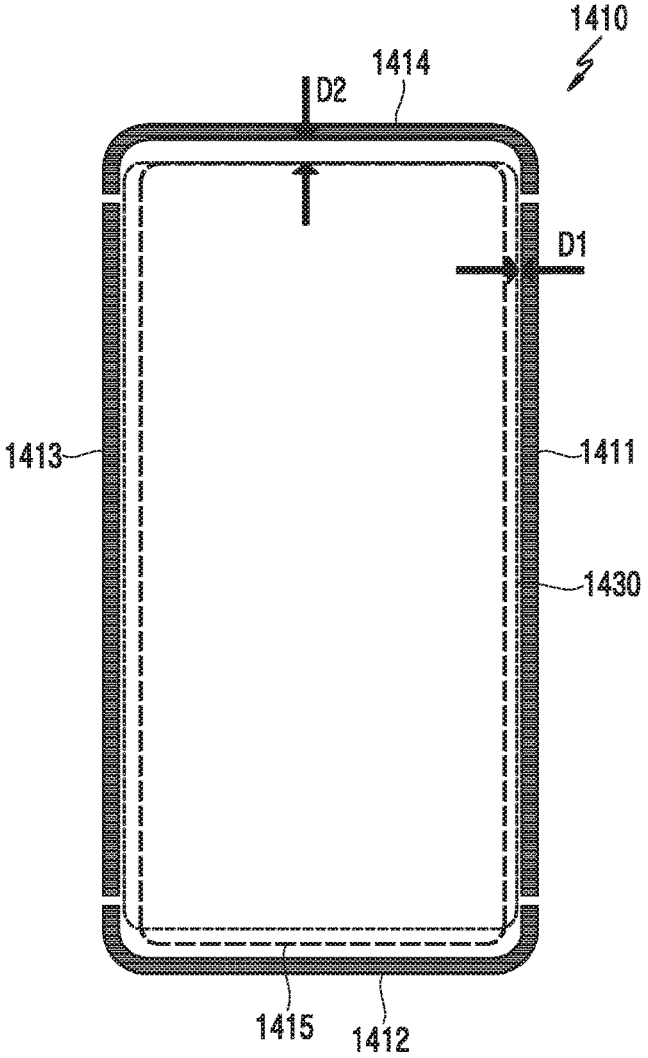
FIG. 14C is a view illustrating an arrangement relationship between a conductive plate of a housing and a display module according to an embodiment of the present disclosure.

FIG. 14C is a view illustrating an arrangement relationship between a conductive plate of a housing and a display module according to an embodiment of the present disclosure.

Referring to FIG. 14C, a slit (so-called a "U-slit") D2 may be arranged between the side face members 1411 to 1414, which have a predetermined thickness and practically form the side face regions of the electronic device, and the rim of the metal plate 1415 that forms the whole region of the front face or the rear face of the electronic device, and may be filled with a non-conductive strip. Electronic components (e.g., a display module) disposed inside the electronic device may be designed not to interfere with the operation of an antenna device by using at least a portion of the non-conductive strip.

Figure 30A:
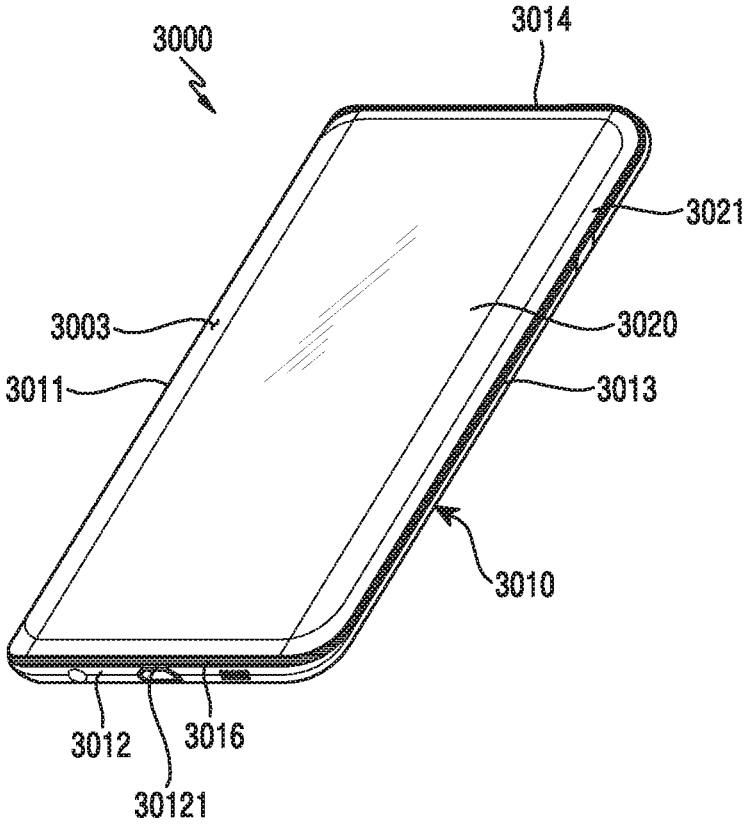
FIGS. 30A, 30B, and 30C are views each illustrating an arrangement relationship of the non-conductive strips arranged along the rim of an electronic device according to various embodiments of the present disclosure.

The electronic device may include a display module 1430 disposed to occupy a greater part of the front face of the electronic device (e.g., disposed as illustrated in FIG. 30A). According to one embodiment, because the gap D1 between the display module 1430 and the side face members 1411 to 1414 and the gap D2 between the conductive plate 1415 and the side face members 1411 to 1414 at least partially overlap with each other, at least one of the side face members of the housing may perform a smooth radiation operation as an antenna radiator.

Figure 15A:
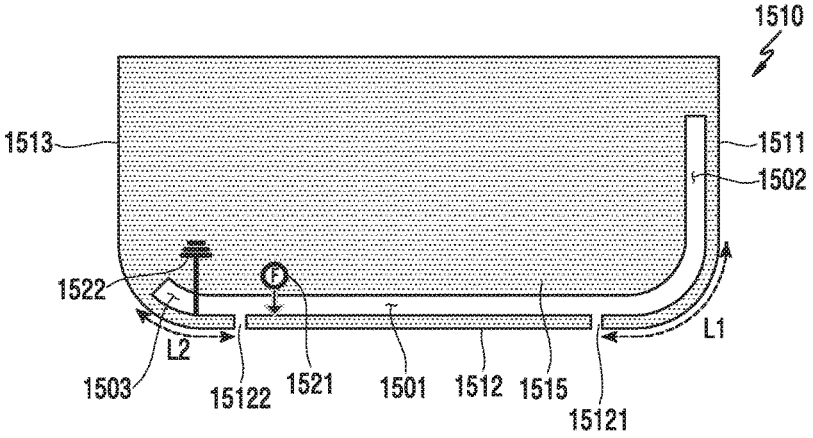
FIG. 15A is a view illustrating a configuration in which a housing, which has a two-split lower end structure, is used as an antenna radiator according to an embodiment of the present disclosure.

FIG. 15A is a view illustrating a configuration in which a housing, which has a two-split structure, is used as an antenna radiator according to an embodiment of the present disclosure.

Figure 15B:
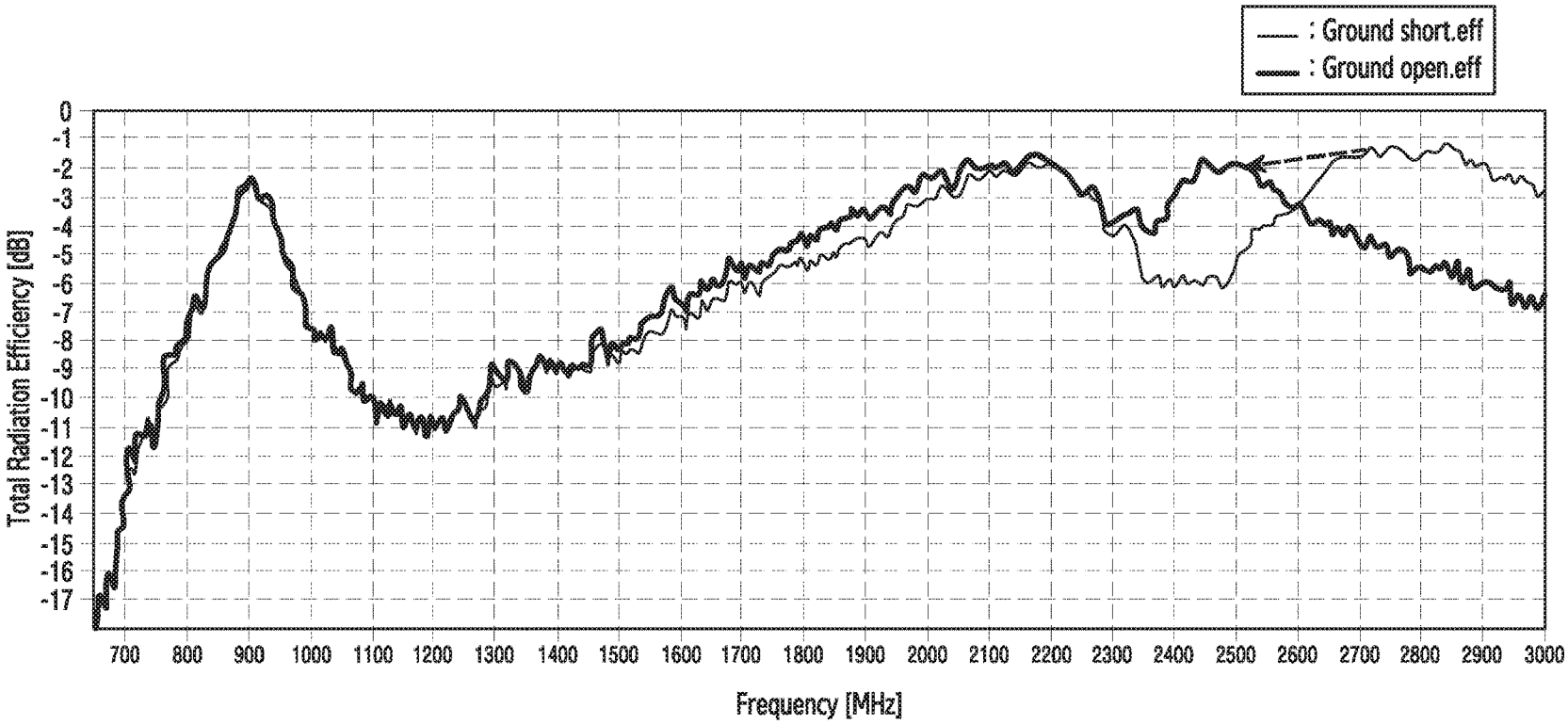
FIG. 15B is a graph illustrating radiation characteristics of the configuration according to an embodiment of the present disclosure.

FIG. 15B is a graph illustrating radiation characteristics of the configuration according to various embodiments of the present disclosure.

Referring to FIGS. 15A and 15B, the housing 1510 may be formed in such a manner in which first to third side face members 1511 to 1513 extend. Slit regions 1501 to 1503 may be formed between the respective side face members 1511 to 1513 and a central conductive plate 1515. According to one embodiment, a first split portion 15121 and a second split portion 15122 may be formed at proper locations of the second side face member 1512 to be spaced apart from each other by a predetermined interval. The slit regions 1501 to 1503 or the split portions 15121 and 15122 may be filled with a non-conductive strip.

The slit regions 1501 to 1503 may be formed to extend from the first side face member 1511 to the second side face member 1512. A partial region of the second side face member 1512 may be divided into unit members by the first and second split portions 15121 and 15122 so as to operate as antenna radiators. For example, at least a partial region of the second side face member 1512 may be electrically connected to a power feeding unit 1521 of a board such that the second side face member 1512 may operate as a multi-band antenna radiator that operates in a plurality of frequency bands having electric lengths L1 (mid band) and L2 (high band) in the slit regions 1501 to 1503. A partial region of the second side face member 1512 or the third side face member 1513 may be electrically connected with a ground unit 1522 of the board across the slit region 1503 adjacent to the second split portion 15122.

Referring to FIG. 15B, when a partial region of the second side face member 1512 or the third side face member 1522 is electrically connected to the ground unit 1522 of the board, it can be seen that the frequency band of the antenna radiator of L2 is shifted to a relatively low frequency band.

Figure 15C:
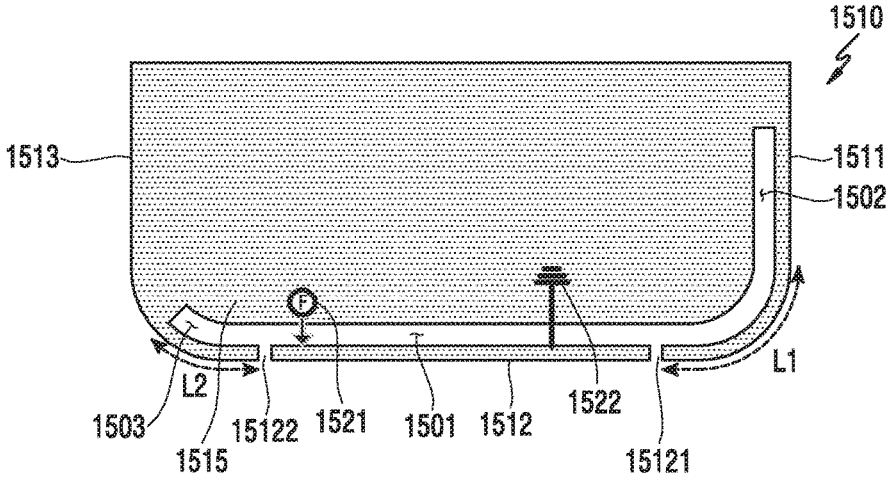
FIG. 15C is a view illustrating a configuration in which a housing, which is formed with slits at different positions and has a two-split structure, is used as an antenna radiator according to an embodiment of the present disclosure.
Figure 15C:
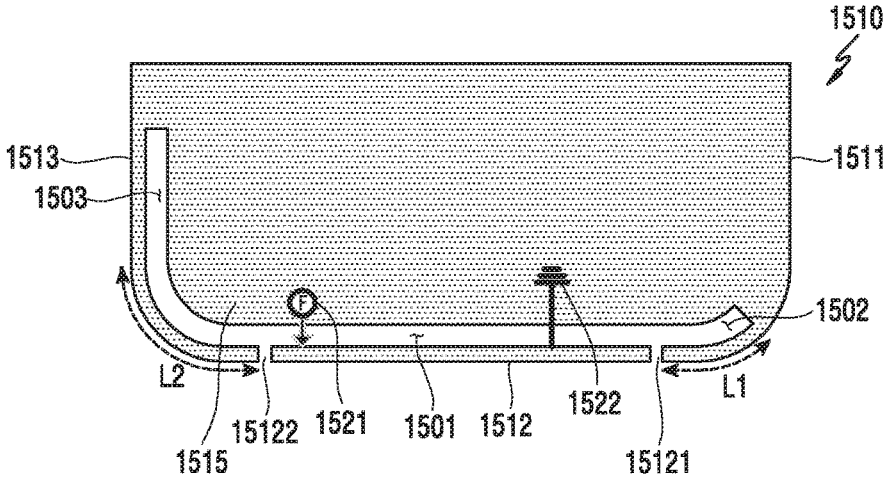
Figure 15D:
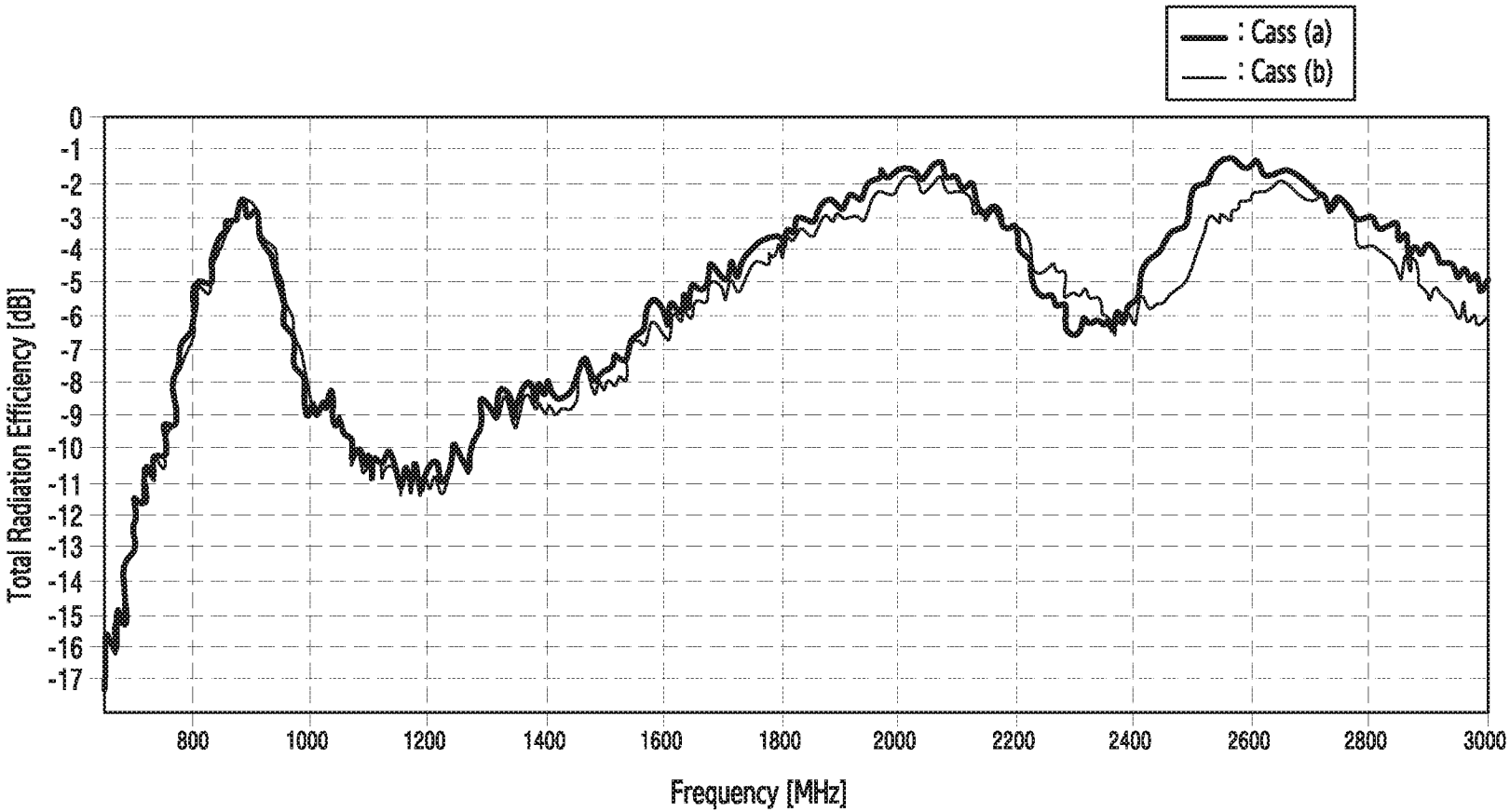
FIG. 15D is a graph illustrating radiation characteristics of the configuration according to an embodiment of the present disclosure.

FIG. 15C is a view illustrating a configuration in which a housing, which is formed with slits at different positions and has a two-split structure, is used as an antenna radiator according to various embodiments of the present disclosure, and FIG. 15D is a graph illustrating radiation characteristics of the configuration according to various embodiments of the present disclosure.

Referring to FIG. 15C(a), the housing 1510 may be formed in such a manner in which first to third side face members 1511 to 1513 extend. The slit regions 1501 and 1502 may be formed between the respective side face members 1511 to 1513 and the central conductive plate 1515. The slit regions 1501 and 1502 may be configured to be filled with the non-conductive strip up to the split portions 15121 and 15122 as described above, and detailed descriptions thereof will be omitted.

The slit regions 1501 and 1502 may be formed to extend from the first side face member 1511 to the second side face member 1512. The first split portion 15121 and the second split portion 15122 may be formed at proper locations of the second side face member 1512 to be spaced apart from each other by a predetermined interval. A partial region of the second side face member 1512 may be divided into unit members by the first and second split portions 15121 and 15122 so as to operate as antenna radiators.

Referring to FIG. 15C(b), the housing 1510 has a substantially similar constitution to that illustrated in FIG. 15C(a). However, the slit region 1502 adjacent to the first side face member is reduced, and the housing 1510 may include slit regions 1501 and 1503, which extend from at least a partial region from the second side face member to the third side face member.

In such a case, as illustrated in FIG. 15D, it can be seen that the operating frequency band of an antenna radiator may vary depending on a position or shape (e.g., a length) of a slit in the same power feeding and ground conditions. For example, in FIG. 15C(a), the antenna radiator may operate in the frequency bands of L1 (mid band) and L2 (high band). In FIG. 15C(b), the antenna radiator may be modified to operate in the frequency bands of L1 (high band) and L2 (mid band).

Figure 15E:
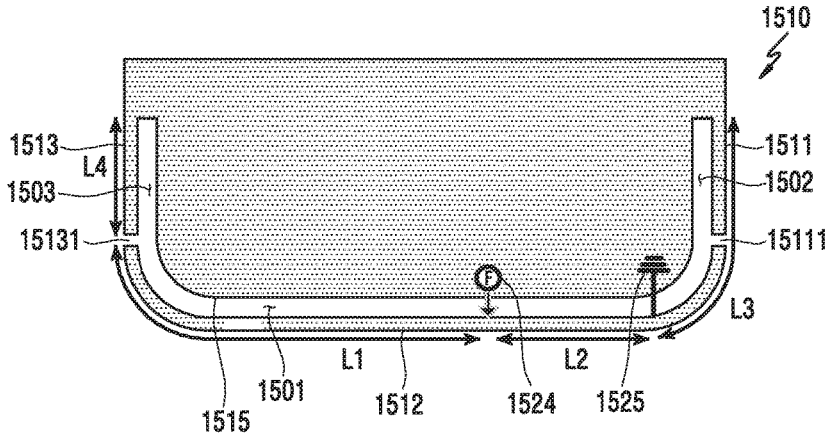
FIG. 15E is a view illustrating a configuration in which a housing, which has a split structure in each of the left and right side faces, is used as an antenna radiator according to an embodiment of the present disclosure.

FIG. 15E is a view illustrating a configuration in which a housing, which has a split structure in each of the left and right side faces, is used as an antenna radiator according to an embodiment of the present disclosure.

Referring to FIG. 15E, the housing 1510 may be formed in such a manner in which first to third side face members 1511 to 1513 extend. Slit regions 1501 to 1503 may be formed between the respective side face members 1511 to 1513 and a central conductive plate 1515. The slit regions 1501 to 1503 may accommodate a non-conductive strip, which is filled up to the split portions 15111 and 15131.

The slit regions 1501 to 1503 may be formed to extend from the first side face member 1511 to the third side face member 1513. The first split portion 15111 may be formed at a proper location of the first side face member 1511. The second split portion 15131 may be formed at a proper location of the third side face member 1513. A partial region of the second side face member 1512, the first side face member 1511, and the third side face member 1513 may be divided into unit members by the first and second split portions 15111 and 15131 so as to operate as antenna radiators.

A partial region of the second side face member 1512 may be electrically connected to a power feeding unit 1524 and a ground unit 1525 of a board such that the second side face member 1512 may serve as a multi-band antenna radiator that operates in a plurality of frequency bands having electric lengths L1 and L2 in the first slit region 1501. The second side face member 1512 may operate in a frequency band having an electric length L3 by the first side face member 1511, which is coupled by the first split portion 15111 and has the second slit region 1502. The second side face member 1512 may operate in a frequency band having an electric length L4 by the third side face member 1513, which is coupled by the second split portion 15131 and has the third slit region 1503.

In the above-described drawings, the housing 1510 is electrically connected one power feeding unit 1524 and one ground unit 1525 of the board, but is not limited thereto. For example, the housing 1510 may be electrically connected to each of a plurality of power feeding units and/ground units to operate in different frequency bands.

Figure 16A:
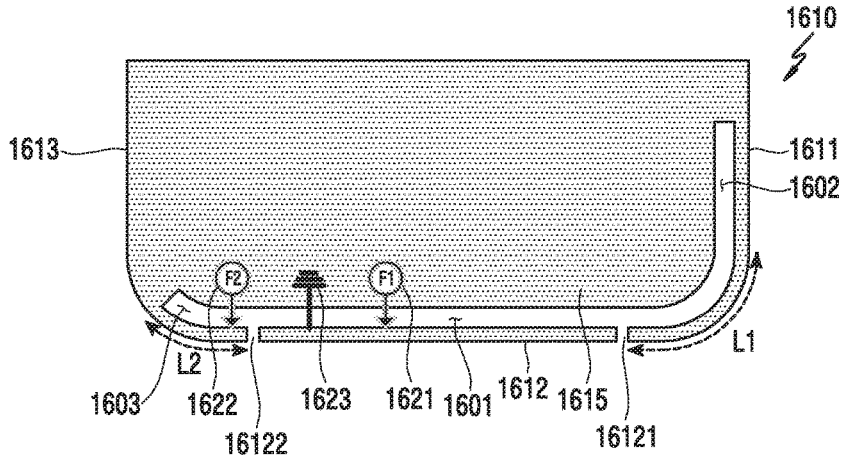
FIG. 16A is a view illustrating a configuration in which a housing, which is fed with power at two positions and has a two-split lower end structure, is used as an antenna radiator according to an embodiment of the present disclosure.

FIG. 16A is a view illustrating a configuration in which a housing, which is fed with power at two positions and has a two-split lower end structure, is used as an antenna radiator according to an embodiment of the present disclosure.

Figure 16B:
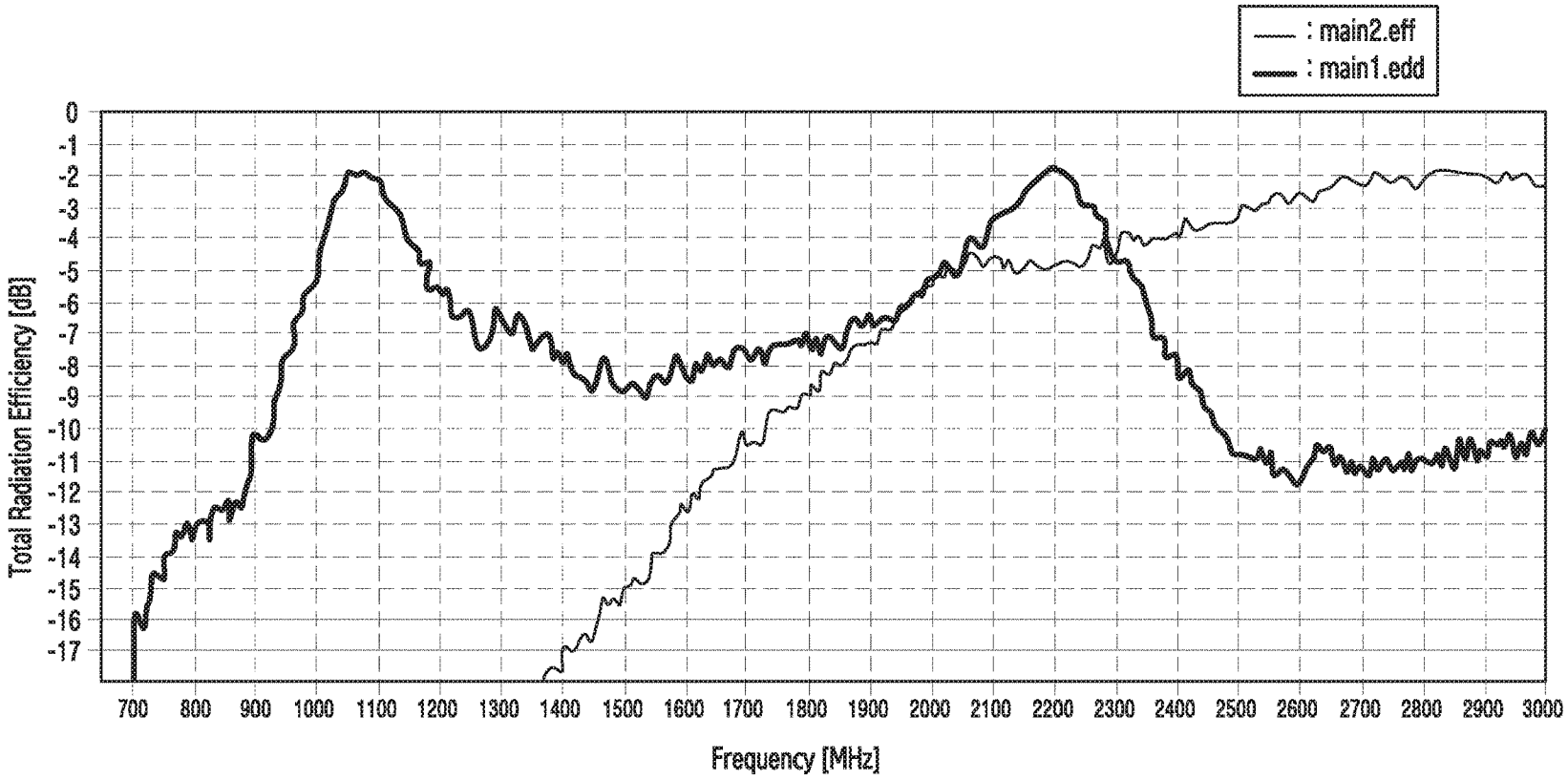
FIG. 16B is a graph illustrating radiation characteristics of the configuration according to an embodiment of the present disclosure.

FIG. 16B is a graph illustrating radiation characteristics of the configuration according to an embodiment of the present disclosure.

Referring to FIG. 16A, the housing 1610 may be formed in such a manner in which first to third side face members 1611 to 1613 extend. Slit regions 1601 and 1602 may be formed between the respective side face members 1611 to 1613 and a central conductive plate 1615. The slit regions 1601 and 1602 may be configured to be filled with the non-conductive strip up to the split portions 16121 and 16122 as described above, and detailed descriptions thereof will be omitted.

The slit regions 1601 to 1603 may be formed to extend from the first side face member 1611 to the second side face member 1612. The first split portion 16121 and the second split portion 16122 may be formed at proper locations of the second side face member 1612 to be spaced apart from each other by a predetermined interval. A partial region of the second side face member 1612 may be divided into unit members by the first and second split portions 16121 and 16122 so as to operate as antenna radiators.

A partial region of the second side face member 1612 may be electrically connected to a first power feeding unit 1621 and a ground unit 1623 of the board, and a partial region of the third side face member 1613 may also be electrically connected to a second power feeding unit 1622 of the board. Although not illustrated, at least a partial region of the third side face member 1613 may be electrically connected to the ground unit of the board.

Referring to FIG. 16B, the second side face member 1612, which is fed with power from the first power feeding unit 1621, may operate in a frequency band having an electric length L1. The third side face member 1613, which is fed with power from the second power feeding unit 1622, may operate in a frequency band having an electric length L2. Accordingly, the second and third side face members may be used as antenna radiators that operate in a desired frequency band by regions where the second and third side face members are electrically insulated from the conductive plate 1615 by the slit region 1601.

Figure 16C:
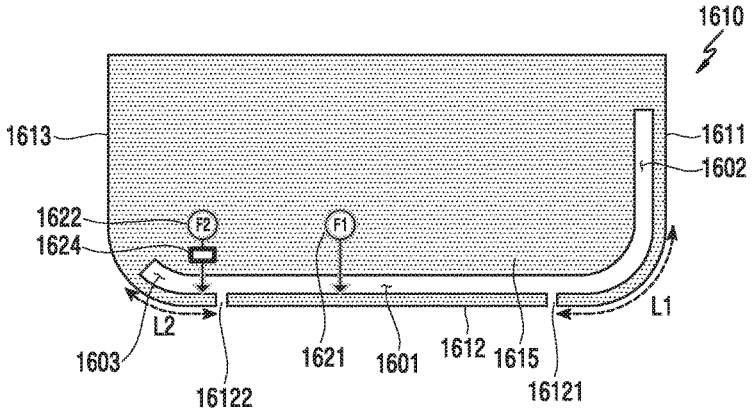
FIG. 16C is a view illustrating a configuration in which a housing, which is fed with power at two positions and has a two-split lower end structure in which a matching element is applied to at least one power feeding position, is used as an antenna radiator according to an embodiment of the present disclosure.

FIG. 16C is a view illustrating a configuration in which a housing, which is fed with power at two positions and has a two-split lower end structure, and in which a matching element is applied to at least one power feeding position, is used as an antenna radiator according to an embodiment of the present disclosure.

Figure 16D:
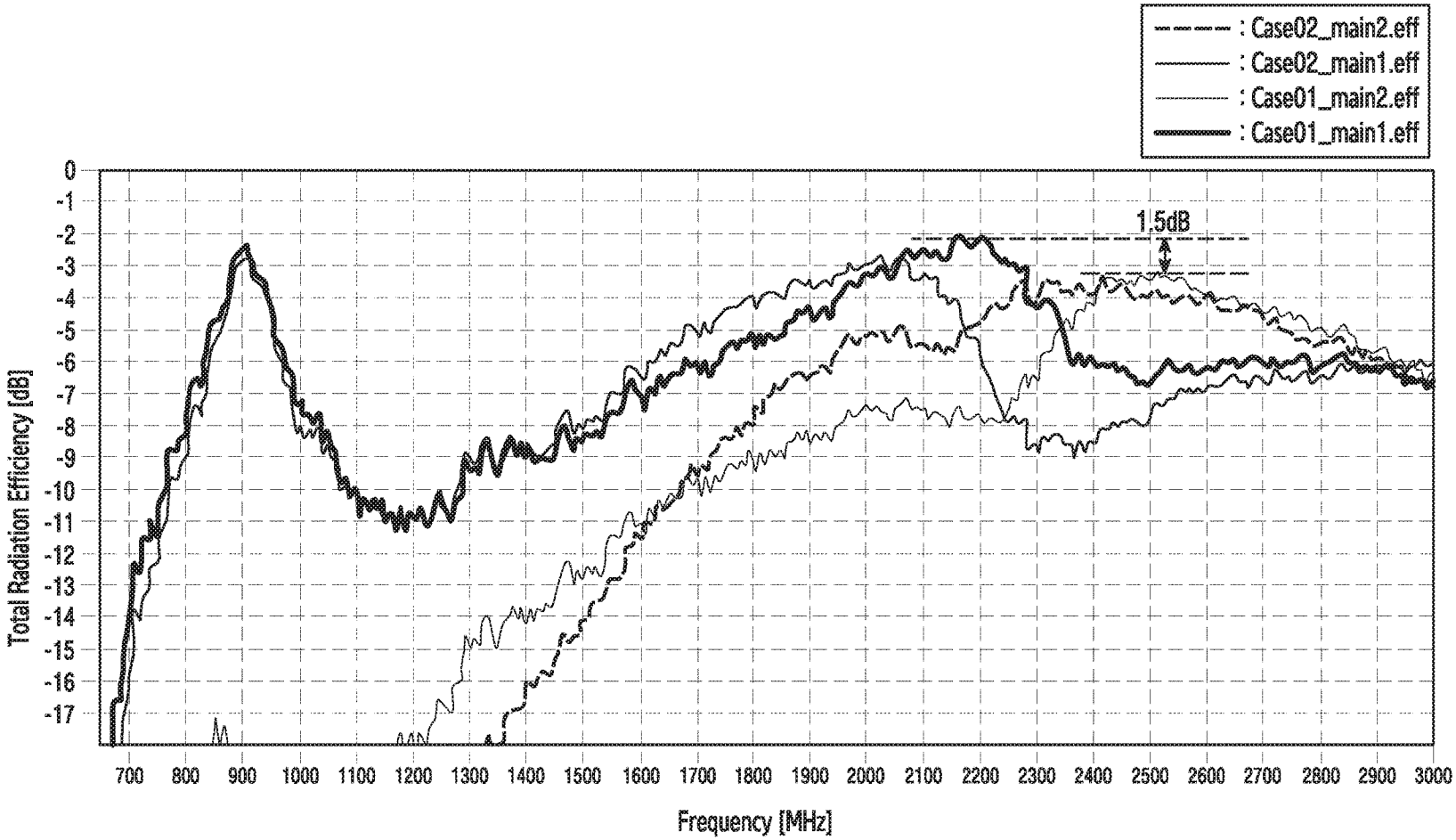
FIG. 16D is a graph illustrating radiation characteristics of the configuration according to an embodiment of the present disclosure.

FIG. 16D is a graph illustrating radiation characteristics of the configuration according to an embodiment of the present disclosure.

Referring to FIG. 16C, the housing 1610 may be formed in such a manner in which first to third side face members 1611 to 1613 extend. Slit regions 1601 and 1602 may be formed between the respective side face members 1611 to 1613 and a central conductive plate 1615. The slit regions 1601 and 1602 may be configured to be filled with the non-conductive strip up to the split portions 16121 and 16122 as described above, and detailed descriptions thereof will be omitted.

The slit regions 1601 and 1602 may be formed to extend from the first side face member 1611 to the second side face member 1612. The first split portion 16121 and the second split portion 16122 may be formed at proper locations of the second side face member 1612 to be spaced apart from each other by a predetermined interval. A partial region of the second side face member 1612 may be divided into unit members by the first and second split portions 16121 and 16122 so as to operate as antenna radiators.

A partial region of the second side face member 1612 may be electrically connected to a first power feeding unit 1621 of the board, and a partial region of the third side face member 1613 may also be electrically connected to a second power feeding unit 1622 of the board. Although not illustrated, at least a partial region of the third side face member 1613 may be electrically connected to the ground unit of the board.

The third side face member 1613, which is located adjacent to the slit region 1601 and is used as an antenna radiator, may include at least one matching element 1624, which is disposed on an electric connection path that is connected with the second power feeding unit 1622. The band width of each antenna radiator may be expanded by the matching element 1624.

Referring to FIG. 16D, the third side face member 1613, which is fed with power by a matching circuit interposed in the electric path of the second power feeding unit 1622, has an expanded band width as compared to the band width before the matching element is applied, which may cause the second side face member, which is electrically connected to the first power feeding unit 1621, to suffer from a performance degradation in a relatively low band and a mid band. Accordingly, it is possible to provide an antenna radiator that operates in a desired frequency band by properly selecting and applying an element value of the applied matching element (e.g., an inductor or a capacitor).

Figure 17A:
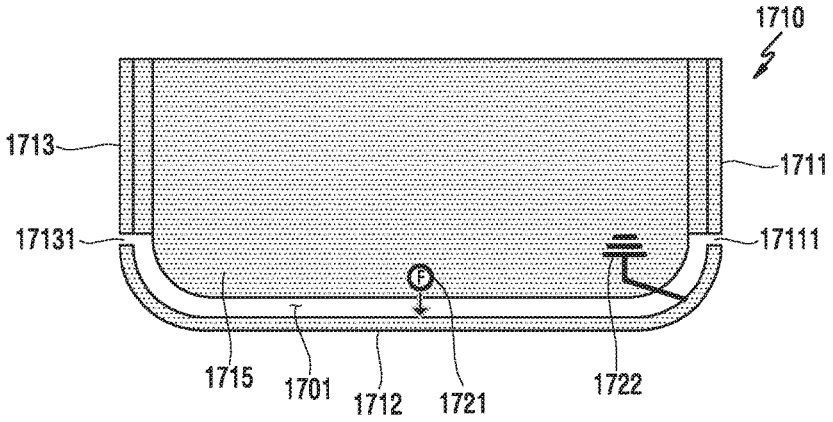
FIGS. 17A, 17B, and 17C are views each illustrating a configuration of a housing according to a slit length according to various embodiments of the present disclosure.
Figure 17B:
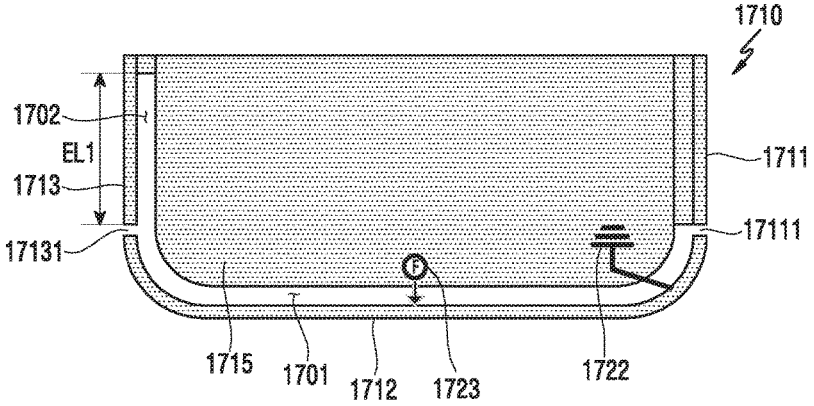
Figure 17C:
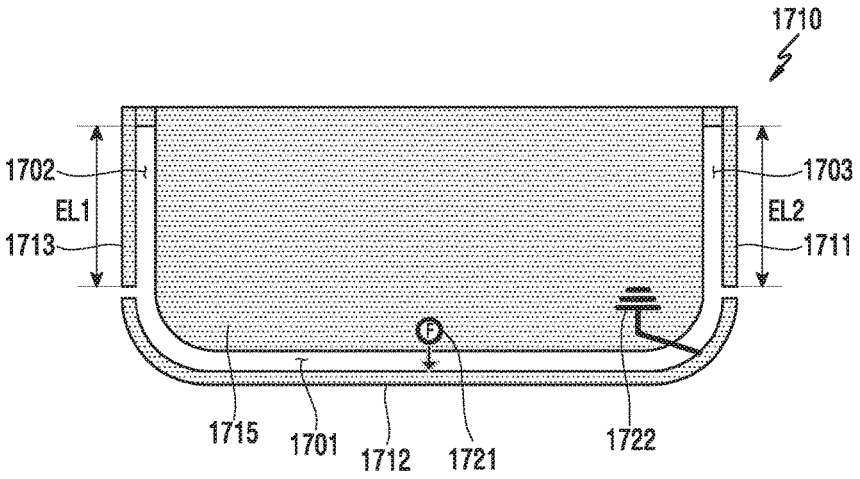
Figure 17D:
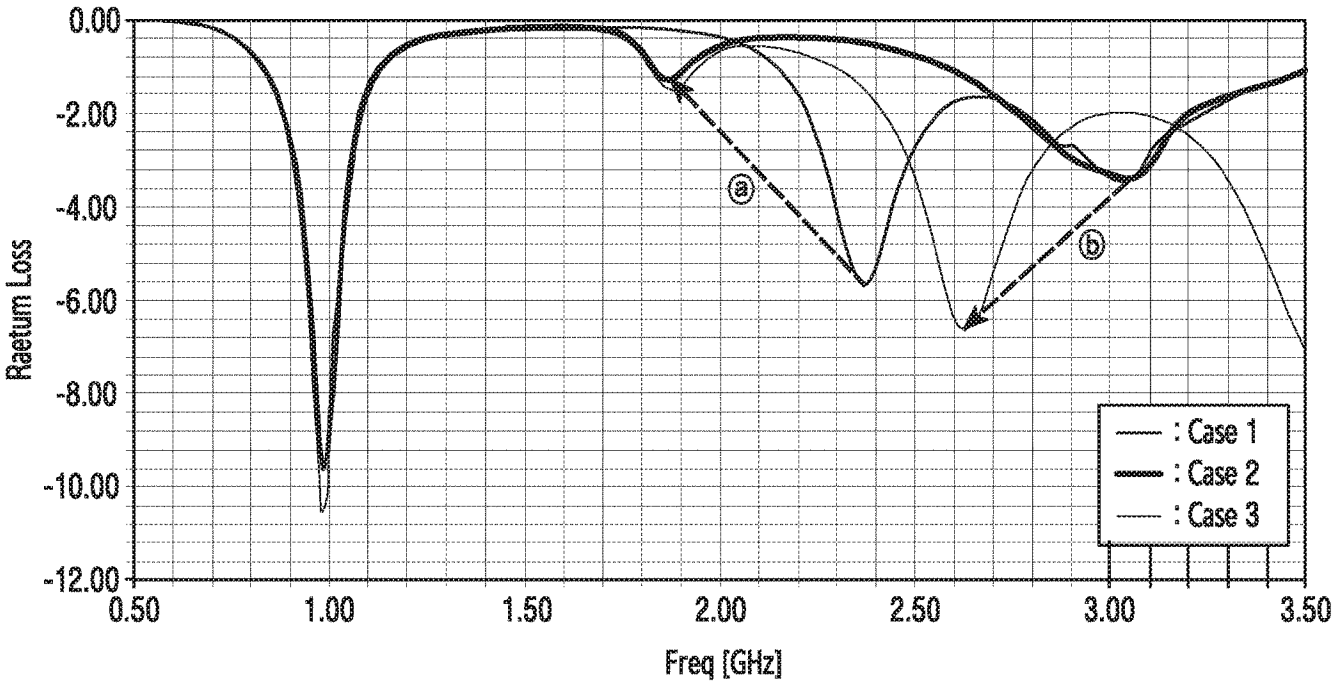
FIG. 17D is a graph illustrating changes in radiation characteristics of the antennas of FIGS. 17A to 17C according to an embodiment of the present disclosure.

FIGS. 17A, 17B, and 17C are views each illustrating a configuration of a housing according to a slit length according to various embodiments of the present disclosure. FIG. 17D is a graph illustrating changes in radiation characteristics of the antennas of FIG. 17A to 17C according to various embodiments of the present disclosure.

Referring to FIGS. 17A to 17C, the housing 1710 of FIGS. 17A, 17B, and 17C may be an embodiment of a housing that is similar to, or different from, the housing 1410 of FIG. 14A, the housing 1510 of FIG. 15A, or the housing 1610 of FIG. 16A.

FIG. 17D illustrates changes in a frequency characteristic of an antenna radiator in a case where a first slit region 1701 formed in a second side face member 1712 is expanded over first and second split portions 17111 and 17131 formed in the first side face member 1711 and a third side face member 1713.

Referring to FIG. 17A, the housing 1710 may be formed in such a manner in which first to third side face members 1711 to 1713 extend. The first slit region 1701 may be formed from a first slit portion 17111 formed between the second side face member 1712 and the first side face member 1711 to a second split portion 17131 formed in the third side face member 1713.

A partial region of the second side face member 1712 may be electrically connected to a power feeding unit 1721 and a ground unit 1722 of a board 1715 such that the second side face member 1712 may serve as an antenna radiator that operates in a plurality of frequency bands having a plurality of electric lengths in the first slit region 1701.

Referring to FIG. 17B, when an expanded slit region 1702 is formed to have an electric length EL1 from the second split portion 17131 of the third side face member 1713 toward the third side face member 1713 in the same condition as FIG. 17A, it can be seen that the operating frequency band of the second side face member 1712, which operates as an antenna radiator, is shifted from a high frequency band to a low frequency band as ⓐ illustrated in FIG. 17D.

Referring to FIG. 17C, when an expanded slit region 1703 is additionally formed to have an electric length EL2 from the first split portion 17111 of the first side face member 1711 toward the first side face member 1711 in the same condition as FIG. 17B, it can be seen that the operating frequency band of the second side face member 1712, which operates as an antenna radiator, is also shifted from a high frequency band to a low frequency band as ⓑ illustrated in FIG. 17D.

According to various embodiments, when at least one of the side face members serves as an antenna radiator that operates in at least one frequency band, the operating frequency band may vary depending on the electric length from a power feeding position of the corresponding side face member according to the formation of a peripheral slit. Without being limited thereto, however, the radiation characteristics of a side face member, which is used as an antenna radiator, may vary depending on various peripheral conditions, such as the length of the slit therearound, the width of the slit from a conductive plate, and a position of a split portion.

FIGS. 18A,18B, 18C, 19A, 19B, 19C, 20A, 20B, 20C, 21A, 21B, and 21C are views each illustrating a configuration of a housing according to a slit and a split state according to various embodiments of the present disclosure. Hereinafter, various shapes of a housing, which are obtained depending on a shape of a slit and a split form, will be described with reference to the figures.

Figure 18A:
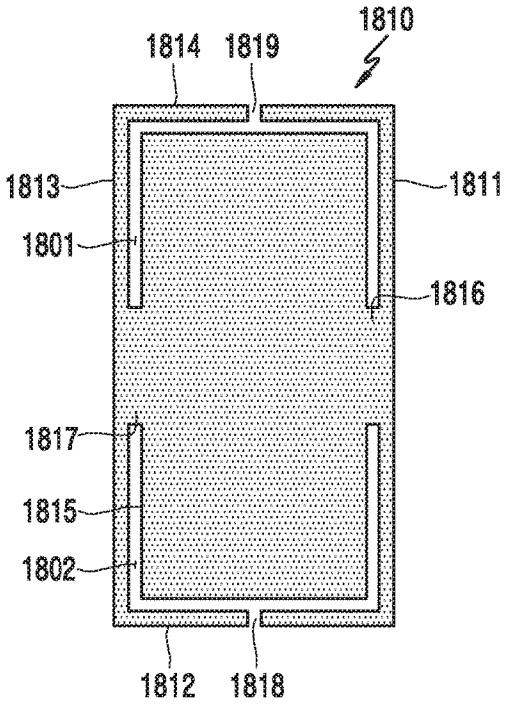
FIGS. 18A, 18B, 18C, 19A, 19B, 19C, 20A, 20B, 20C, 21A, 21B, and 21C are views each illustrating a configuration of a housing according to a slit and a split state according to various embodiments of the present disclosure.
Figure 18B:
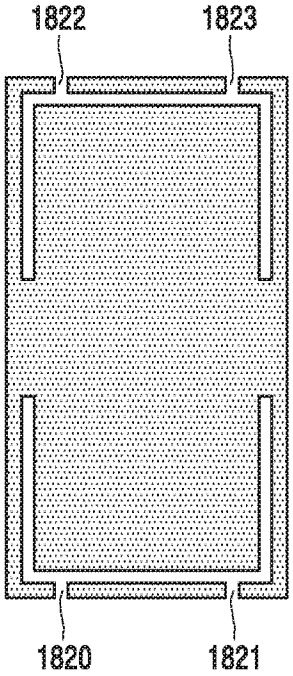
Figure 18C:
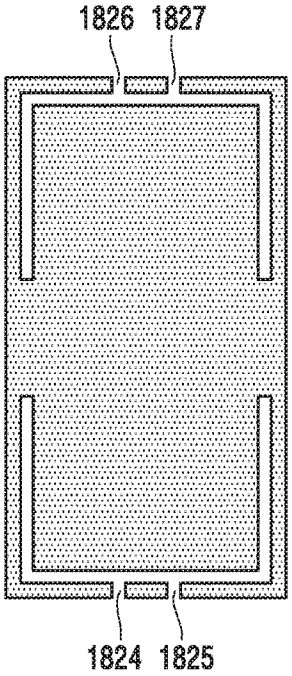

Referring to FIGS. 18A to 18C, the housing 1810 may include a conductive plate 1815, which occupies a greater portion of the central area, and first to fourth side face members 1811 to 1814, which are formed along the rim of the conductive plate 1815, with slits 1801 and 1802 being interposed therebetween. The slits 1801 and 1802 may be divided by first and second conductive connection parts 1816 and 1817, each of which is physically connected with the conductive plate 1815.

Referring to FIG. 18A, the first and third side face members 1811 and 1813 may be physically connected with the conductive plate 1815 by the first and second conductive connection parts 1816 and 1817, which are formed in the central portions of the first and third side face members 1811 and 1813, respectively, to be symmetric to each other in the left and right direction. The second side face member 1812 and the fourth side face member 1814 may be divided by split portions 1818 and 1819, which are formed in at least a portion of the second side face member 1812 and at least a portion of the fourth side face member 1814, respectively. Referring to FIG. 18B, in the same condition as FIG. 18C, the second side face member 1812 and the fourth side face member 1814 may be divided by a pair of split portions 1820 and 1821 and a pair of split portions 1822 and 1823, which are formed in at least a portion of the second side face member 1812 and at least a portion of the fourth side face member 1814, respectively. Referring to FIG. 18C, a pair of split portions 1824 and 1825 and a pair of split portions 1826 and 1827, which are formed in the second side face member 1812 and the fourth side face member 1814, respectively, may be formed in such a manner that the spacing between the split portions in each pair is smaller than the spacing between the split portions in each pair illustrated in FIG. 18B.

Figure 19C:
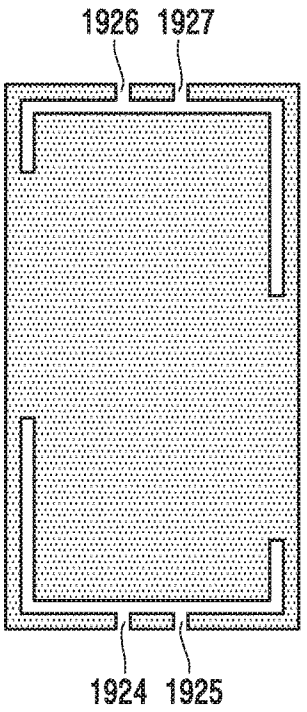
Figure 19B:
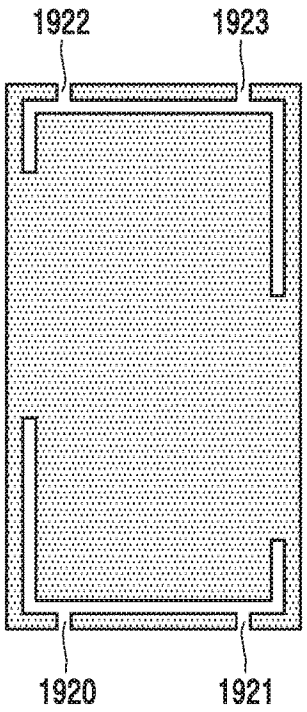
Figure 19A:
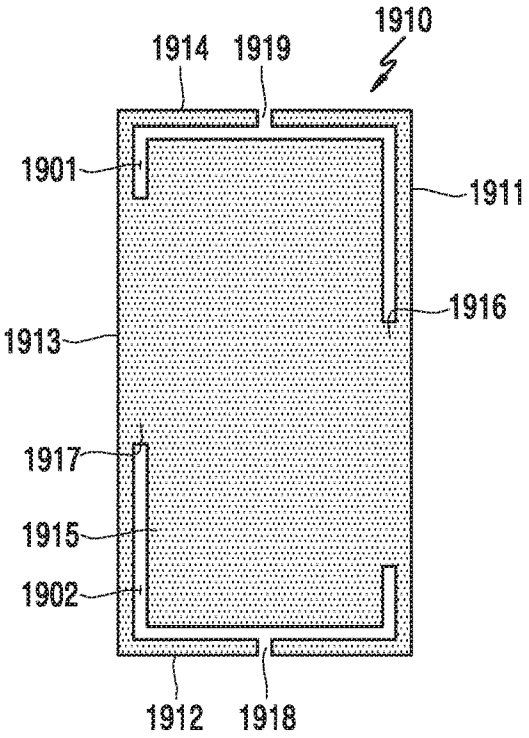

Referring to FIGS. 19A to 19C, the housing 1910 may include a conductive plate 1915, which occupies a greater portion of the central area, and first to fourth side face members 1911 to 1914, which are formed along the rim of the conductive plate 1915, with slits 1901 and 1902 being interposed therebetween. The slits 1901 and 1902 may be divided by first and second conductive connection parts 1916 and 1917, each of which is physically connected with the conductive plate 1915. The slits 1901 and 1902 may be formed to have different shapes (e.g., to be asymmetric to each other in the left and right direction).

Referring to FIG. 19A, the first and third side face members 1911 and 1913 may be physically connected with the conductive plate 1915 by the first and second conductive connection parts 1916 and 1917, which are formed in the first and third side face members 1911 and 1913, respectively, to be asymmetric to each other in the left and right direction. The second and fourth side face members 1912 and 1914 may be divided by split portions 1918 and 1919, which are formed in the central portions of the second and fourth side face members 1912 and 1914, respectively. Referring to FIG. 19B, in the same condition as FIG. 19A, the second side face member 1912 and the fourth side face member 1914 may be divided by a pair of split portions 1920 and 1921 and a pair of split portions 1922 and 1923, respectively. Referring to FIG. 19C, a pair of split portions 1924 and 1925 and a pair of split portions 1926 and 1927, which are formed in the second side face member 1912 and the fourth side face member 1914, respectively, may be formed in such a manner that the spacing between the split portions in each pair is smaller than the spacing between the split portions in each pair illustrated in FIG. 18B.

Figure 20A:
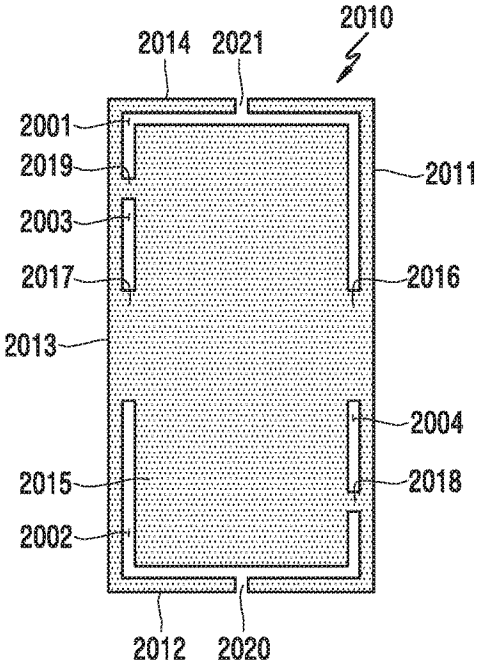
Figure 20B:
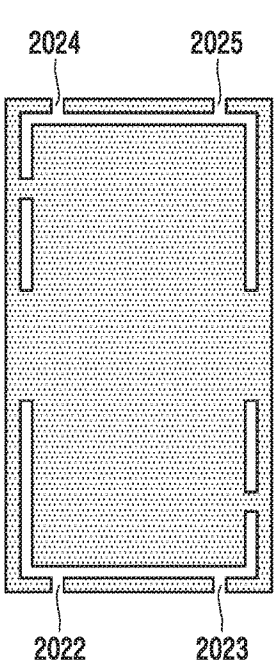
Figure 20C:
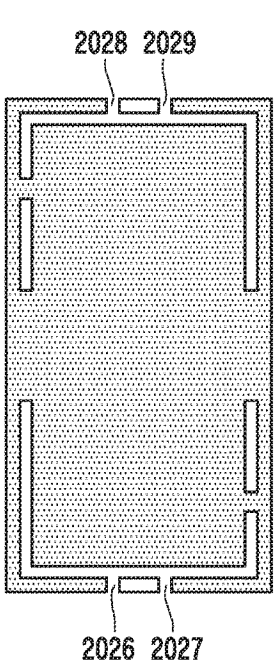

Referring to FIGS. 20A to 20C, the housing 2010 may include a conductive plate 2015, which occupies a greater portion of the central area, and first to fourth side face members 2011 to 2014, which are formed along the rim of the conductive plate 2015 with four slits 2001, 2002, 2003, and 2004 being interposed therebetween. The slits 2001 to 2004 may be separated from each other by first to fourth conductive connection parts 2016 to 2019, each of which is physically connected with the conductive plate 2015.

Referring to FIG. 20A, the first and third side face members 2011 and 2013 may be physically connected with the conductive plate 2015 by the first and second conductive connection parts 2016 and 2018 and the third and fourth conductive connection parts 2017 and 2019, which are formed to be asymmetric to each other in the left and right direction. The second and fourth side face members 2012 and 2014 may be divided by split portions 2020 and 2021, which are formed in the central portions of the second and fourth side face members 2012 and 2014, respectively. Referring to FIG. 20B, in the same condition as FIG. 20A, the second side face member 2012 and the fourth side face member 2014 may be divided by a pair of split portions 2022 and 2023 and a pair of split portions 2024 and 2025, respectively. Referring to FIG. 20C, a pair of split portions 2026 and 2027 and a pair of split portions 2028 and 2029, which are formed in the second side face member 2012 and the fourth side face member 2014, respectively, may be formed in such a manner that the spacing between the split portions in each pair is smaller than the spacing between the split portions in each pair illustrated in FIG. 18B.

Figure 21A:
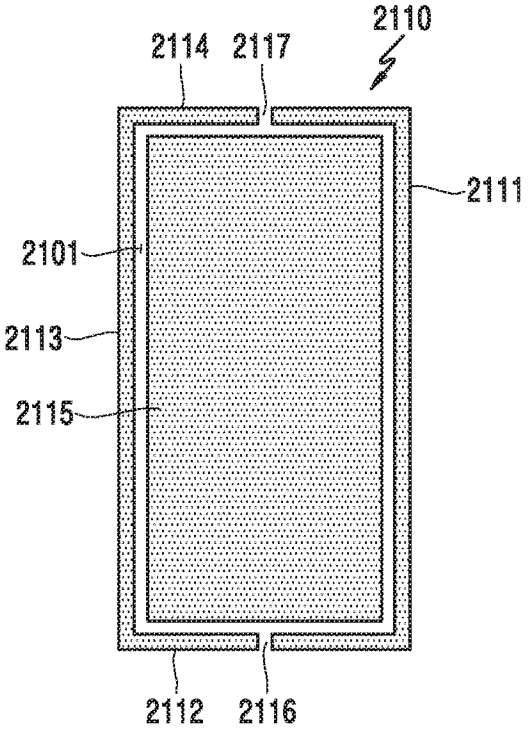
Figure 21B:
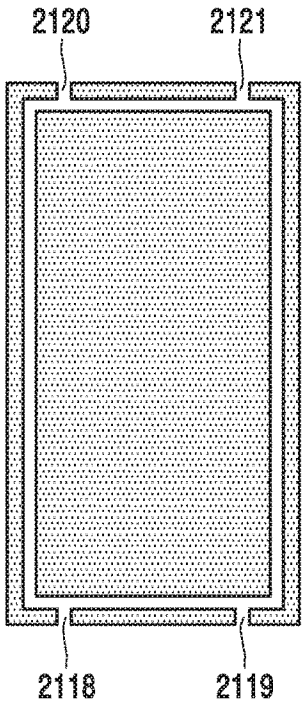
Figure 21C:
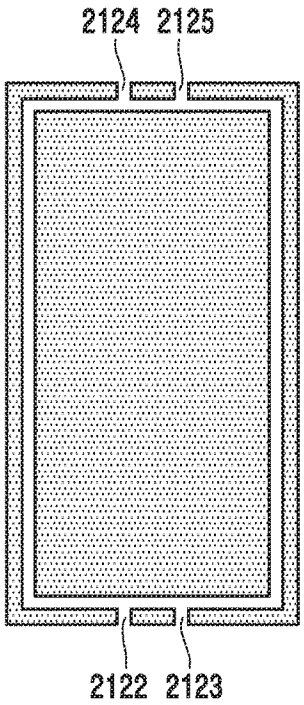

Referring to FIGS. 21A to 21C, the housing 2110 may include a conductive plate 2115, which occupies a greater portion of the central area, and first to fourth side face members 2111 to 2114, which are formed along the rim of the conductive plate 2115, with one slit 2101, which extends in a closed loop shape, being interposed therebetween.

In the case of FIG. 21A, the first to fourth side face members 2111 to 2114 may be electrically insulated from the conductive plate 2115 by a slit 2101. The slit 2101 may be filled with a non-conductive strip. The second and fourth side face members 2112 and 2114 may be divided by split portions 2116 and 2117, which are formed in the central portions of the second and fourth side face members 2112 and 2114, respectively.

Referring to FIG. 21B, in the same condition as FIG. 21A, the second side face member 2112 and the fourth side face member 2114 may be divided by a pair of split portions 2118 and 2119 and a pair of split portions 2120 and 2121, respectively. Referring to FIG. 21C, a pair of split portions 2122 and 2123 and a pair of split portions 2124 and 2125, which are formed in the second side face member 2112 and the fourth side face member 2114, respectively, may be formed in such a manner that the spacing between the split portions in each pair is smaller than the spacing between the split portions in each pair illustrated in FIG. 21B.

FIGS. 22A, 22B, 22C, 22D, 23A, 23B, 23C, 24A, 24B, 24C, 25A, 25B, 25C, 26A, 26B, 26C, 27A, 27B, 27C, 28A, 28B, 28C, 29A, 29B, and 29C are views each illustrating a configuration of a housing according to a slit formed along a side face and a split state according to various embodiments of the present disclosure.

Although each of the above-described figures illustrates a configuration of a housing, which is disposed at a position where slits can be confirmed when viewed from above the front face or rear face of the housing, each of the figures illustrating various embodiments to be described later illustrates a configuration of a housing that is disposed at a position where slits can be confirmed when viewed from a lateral side of the housing.

Figure 22A:
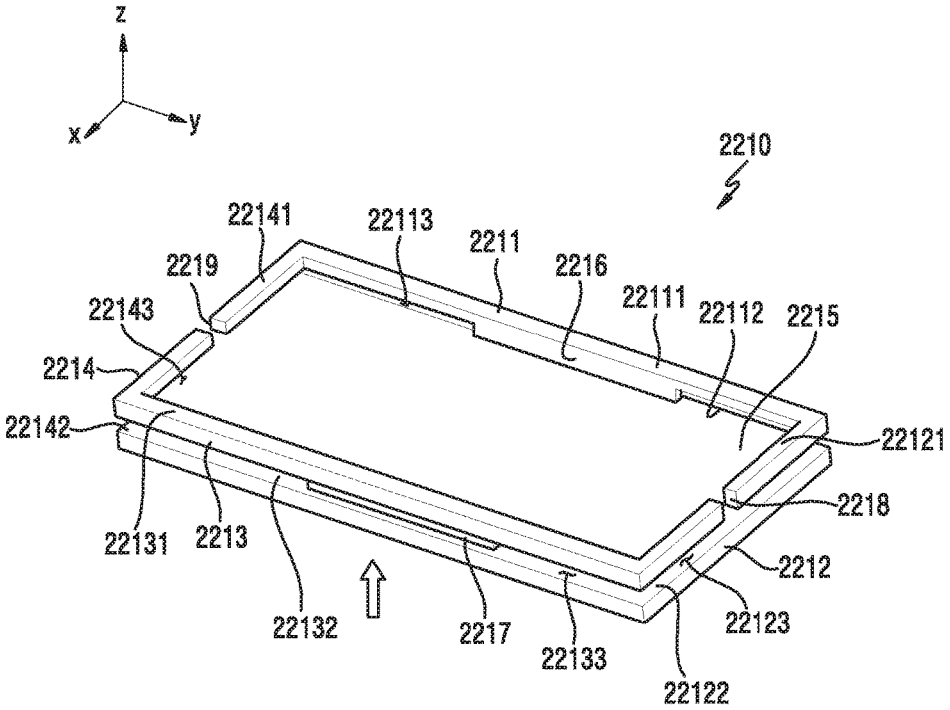
FIGS. 22A, 22B, 22C, 22D, 23A, 23B, 23C, 24A, 24B, 24C, 25A, 25B, 25C, 26A, 26B, 26C, 27A, 27B, 27C, 28A, 28B, 28C, 29A, 29B, and 29C are views each illustrating a configuration of a housing according to a slit formed along a side face and a split state according to various embodiments of the present disclosure.
Figure 22D:
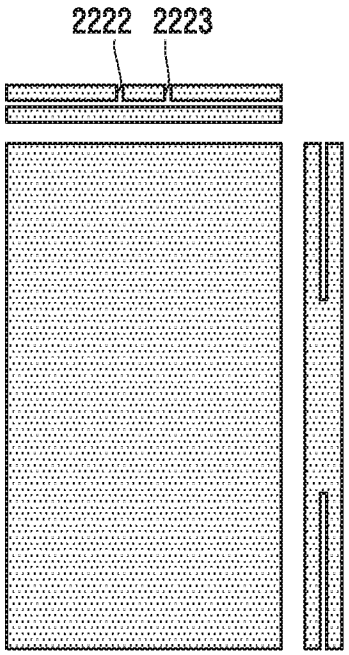
Figure 22C:
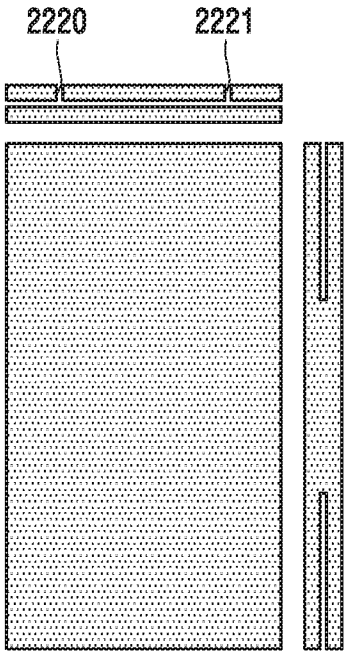
Figure 22B:
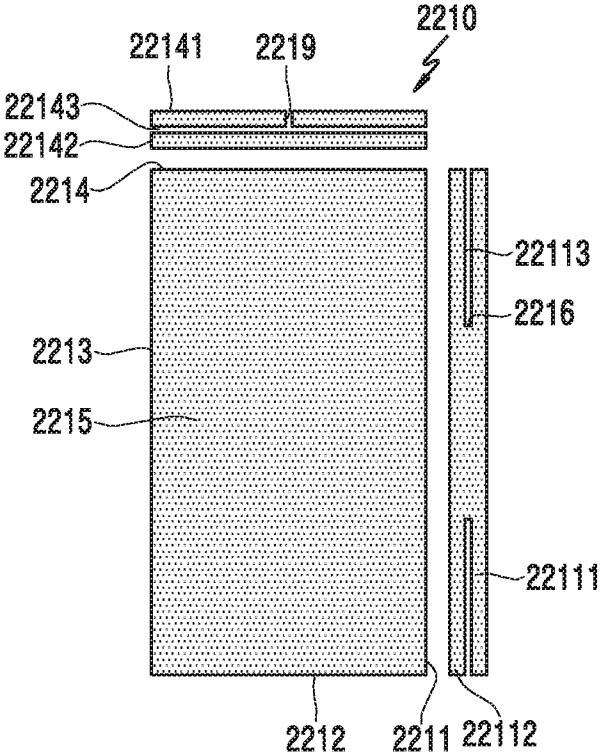

Referring to FIGS. 22A and 22B, the housing 2210 may include a front face having a substantially rectangular shape and facing in a first direction (z axis direction), a rear face having a substantially rectangular shape and facing in a second direction (−z axis direction) that is opposite to the first direction, and first to fourth side face members 2211 to 2214 that enclose together a space between the front face and the rear face. The housing may include a substantially flat conductive plate 2215 that forms a considerable portion of the rear face. Each of the first and third side face members 2211 and 2213 has a first length in a third direction (y-axis direction) perpendicular to the first direction (z axis direction). Each of the second and fourth side face members 2212 and 2214 has a second length, which is shorter than the first length, in a fourth direction (x-axis direction) perpendicular to the third direction (y axis direction).

The first side face member 2211 may include a first conductive structure 22111 elongated in the third direction (y-axis direction), a second conductive structure 22112 spaced apart from the first conductive structure 22111 and elongated in the third direction, and a first non-conductive structure 22113 interposed between the first and second conductive structures 22111 and 22112 and elongated in the third direction (y-axis direction). The first side member 2211 may include a first conductive portion 2216 configured to electrically connect the first conductive structure 22111 to the second conductive structure 22112.

The second side face member 2212 may include a third conductive structure 22121 elongated in the fourth direction (x-axis direction) from the first conductive structure 22111, a fourth conductive structure 22122 spaced apart from the third conductive structure 22121 and elongated in the fourth direction (x-axis direction) from the second conductive structure 22112, and a second non-conductive structure 22123 interposed between the third and fourth conductive structures 22121 and 22122 and elongated in the fourth direction (x-axis direction) from the first non-conductive structure 22113. The second side face member 2212 may include at least one first non-conductive protrusion 2218 that splits the third conductive structure 22121 or the fourth conductive structure 22122 into two or more portions and extends from the first non-conductive structure 22113 in the first direction or the second direction.

The third side face member 2213 may include a fifth conductive structure 22131 elongated in the third direction (y-axis direction) from the third conductive structure 22121, a sixth conductive structure 22132 spaced apart from the fifth conductive structure 22131 and elongated in the third direction from the fourth conductive structure 22131, and a third non-conductive structure 22133 interposed between the fifth and sixth conductive structures 22131 and 22132 and elongated in the third direction from the second non-conductive structure 22133. The third side member 2213 may include a second conductive portion 2217 configured to electrically connect the fifth conductive structure 22131 to the sixth conductive structure 22132.

The fourth side face member 2214 may include a seventh conductive structure 22141 elongated in the fourth direction (x-axis direction) from the first conductive structure 22111, an eighth conductive structure 22142 spaced apart from the seventh conductive structure 22141 and elongated in the fourth direction from the second conductive structure 22112, and a fourth non-conductive structure 22143 interposed between the seventh and eighth conductive structures 22141 and 22142 and elongated in the fourth direction from the first non-conductive structure 22133. The fourth side face member 2214 may include at least one second non-conductive protrusion 2219 that splits the seventh conductive structure 22141 or the eighth conductive structure 22142 into two or more portions and extends from the first non-conductive structure 22113 in the first direction or the second direction.

Each of FIG. 22C to FIG. 22D illustrates a front view in which the housing 2210 is viewed from the front side, a right side view which is illustrated at the right side of the front view, and a plan view which is illustrated on the top side of the front view, all together.

Referring to FIG. 22C, in the same condition as FIG. 22B, the seventh conductive structure 22141 of the fourth side face member 2214 may be divided by a pair of non-conductive protrusions 2220 and 2221. Referring to FIG. 22C, split portions 2222 and 2223, each of which is formed in the first conductive structure 22141 of the fourth side face member 2214, may be formed to have a spacing therebetween, which is smaller than the spacing between the split portions illustrated in FIG. 22C. Although not illustrated, the third conductive structure of the second side face member 2212 may also be divided by a pair of non-conductive protrusions in the same condition or different conditions.

Figure 23C:
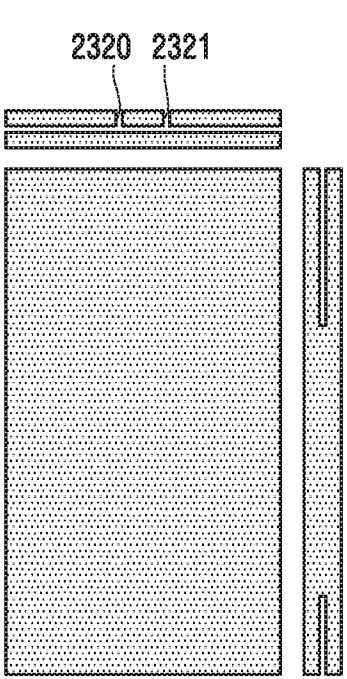
Figure 23B:
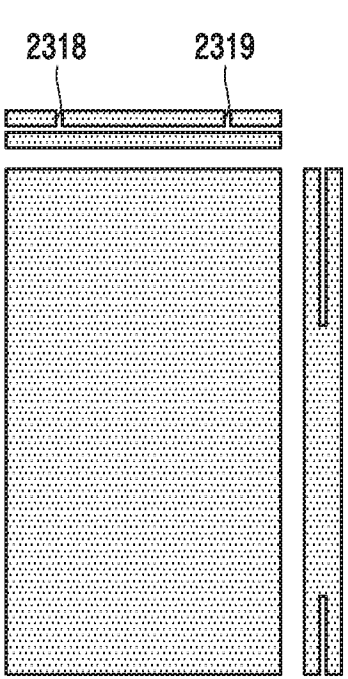
Figure 23A:
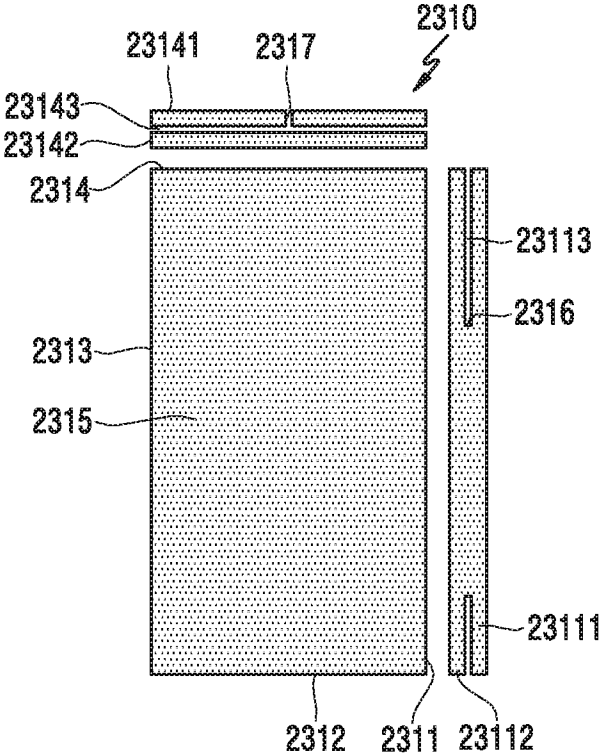

Each of FIG. 23A, FIG. 23B and FIG. 23C illustrates a front view in which the housing 2310 is viewed from the front side, a right side view which is illustrated at the right side of the front view, and a plan view which is illustrated on the top side of the front view, all together.

Referring to FIGS. 23A, 23B, and FIG. 23C, the housing 2310 may include first to fourth side face members 2311 to 2314, a conductive plate 2315, and a plurality of non-conductive structures 22113 and 23143, which may be formed in the conditions that are the same as, or different from, the conditions of FIG. 22A.

Referring to FIG. 23A, the first and second conductive structures 23111 and 23112 of the first side face member 2311 may be formed in such a manner in which a first conductive portion 2316, which is connected through a first non-conductive structure 23113 between the first and second conductive structures 23111 and 23112, is biased to the lower side from the central portion of the first side face member 2311. The first non-conductive structure 23113 may be divided into two portions by the first conductive portion 2316. Although not illustrated, the third side face member 2313 may also be formed to have a configuration that is the same as, or similar to, the above-described first side face member 2311. The fourth side face member 2314 may include a fourth non-conductive structure 23143 interposed between the seventh conductive structure 23141 and the eighth conductive structure 23142, and a non-conductive protrusion 2317 extending from the fourth non-conductive structure 23143. Although not illustrated, the second side face member 2312 may also be formed to have a configuration that is the same as the above-described fourth side face member 2314.

In the case of FIG. 23B, the seventh conductive structure 23141 of the fourth side face member 2314 may be divided by a pair of non-conductive protrusions 2318 and 2319 in a condition that is the same as, or similar to, the condition of FIG. 23A. In the case of FIG. 23C, non-conductive protrusions 2320 and 2321, each of which is formed in the seventh conductive structure 23141 of the fourth side member 2314, may be formed to have a spacing therebetween, which is smaller than the spacing between the split portions illustrated in FIG. 23B.

Figure 24C:
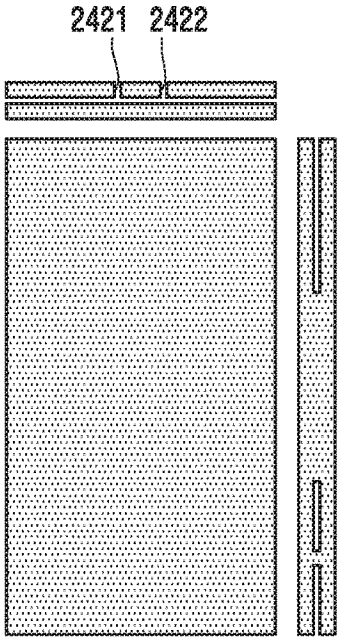
Figure 24B:
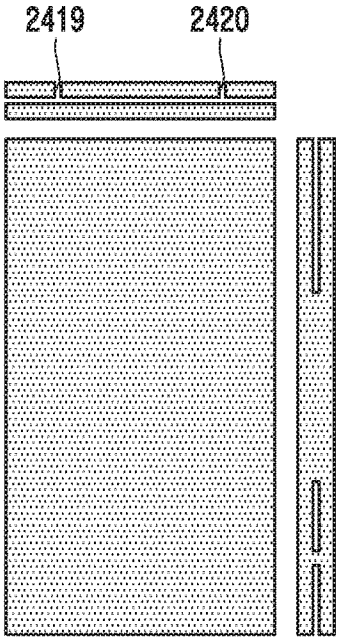
Figure 24A:
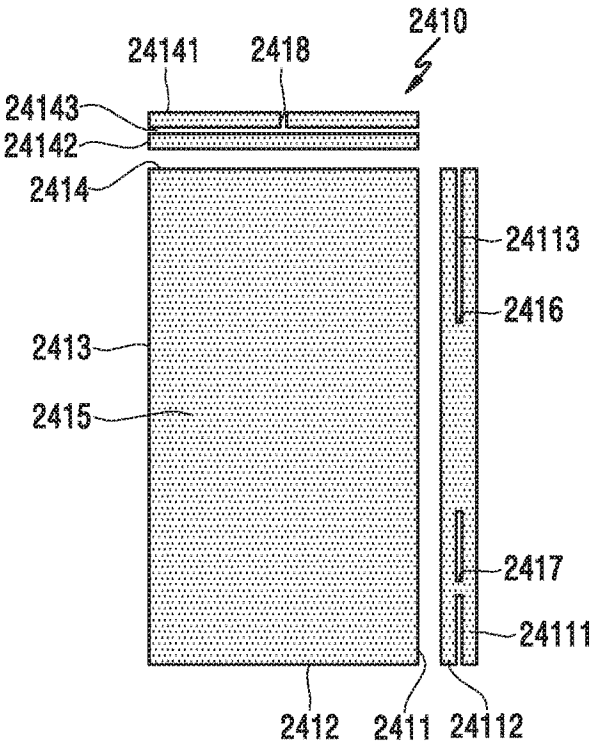

Each of FIGS. 24A, 24B, and 24C illustrates a front view in which the housing 2410 is viewed from the front side, a right side view which is illustrated at the right side of the front view, and a plan view which is illustrated on the top side of the front view, all together.

Referring to FIGS. 24A, 24B, and 24C, the housing 2410 may include first to fourth side face members 2411 to 2414 and a conductive plate 2415, which may be formed in the conditions that are the same as, or similar to, the conditions of FIG. 22A.

In the case of FIG. 24A, the first and second conductive structures 24111 and 24112 of the first side face member 2411 may include a pair of conductive portions 2416 and 2417 that are connected to each other through the first non-conductive structure 24113 between the first and second conductive structures 23111 and 23112. The first non-conductive structure 24113 may be divided into three portions by the pair of conductive portions 2416 and 2417. Although not illustrated, the third side face member 2413 may also be formed to have a configuration that is the same as, or similar to, the above-described first side face member 2411. The fourth side face member 2414 may include a fourth non-conductive structure 24143 interposed between the seventh conductive structure 24141 and the eighth conductive structure 24142, and a non-conductive protrusion 2418 extending from the fourth non-conductive structure 24143. Although not illustrated, the second side face member 2412 may also be formed to have a configuration that is the same as the above-described fourth side face member 2414.

In the case of FIG. 24B, the seventh conductive structure 24141 of the fourth side face member 2414 may be divided by a pair of non-conductive protrusions 2419 and 2420 in a condition that is the same as, or similar to, the condition of FIG. 24A. In the case of FIG. 24C, non-conductive protrusions 2421 and 2422, each of which is formed in the seventh conductive structure 24141 of the fourth side member 2414, may be formed to have a spacing therebetween, which is smaller than the spacing between the split portions illustrated in FIG. 24B.

Figure 25C:
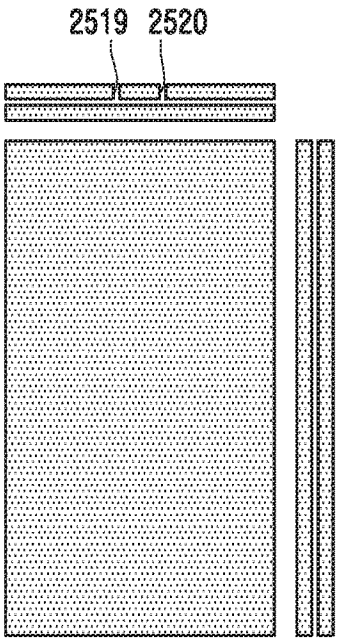
Figure 25B:
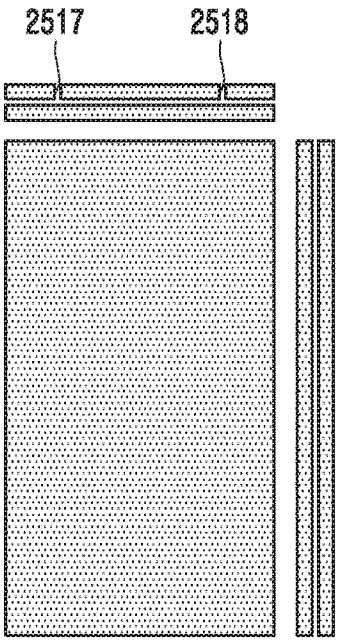
Figure 25A:
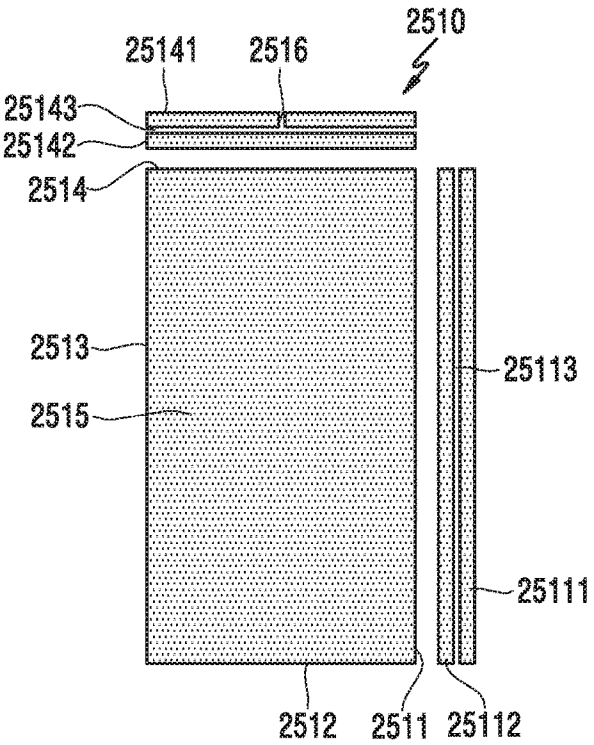

Each of FIGS. 25A, 25B, and 25C illustrates a front view in which the housing 2510 is viewed from the front side, a right side view which is illustrated at the right side of the front view, and a plan view which is illustrated on the top side of the front view, all together.

Referring to FIGS. 25A, 25B, and 25C, the housing 2510 may include first to fourth side face members 2511 to 2514 and a conductive plate 2515, which may be formed in the conditions that are the same as, or similar to, the conditions of FIG. 22A.

In the case of FIG. 25A, the first and second conductive structures 25111 and 25112 of the first side face member 2511 may include a first non-conductive structure 25113 interposed therebetween. No conductive portion may exist in the first side face member 2511, and the first non-conductive structure may be filled with a non-conductive strip. Although not illustrated, the third side face member 2513 may also be formed to have a configuration that is the same as, or similar to, the above-described first side face member 2511. The fourth side face member 2514 may include a fourth non-conductive structure 25143 interposed between the seventh conductive structure 25141 and the eighth conductive structure 25142, and a non-conductive protrusion 2516 extending from the fourth non-conductive structure 25143. Although not illustrated, the second side face member 2512 may also be formed to have a configuration that is the same as the above-described fourth side face member 2514.

In the case of FIG. 25B, the seventh conductive structure 25141 of the fourth side face member 2514 may be divided by a pair of non-conductive protrusions 2517 and 2518 in a condition that is the same as, or similar to, the condition of FIG. 25A. In the case of FIG. 25C, non-conductive protrusions 2519 and 2520, each of which is formed in the seventh conductive structure 25141 of the fourth side member 2514, may be formed to have a spacing therebetween, which is smaller than the spacing between the split portions illustrated in FIG. 25B.

Figure 26C:
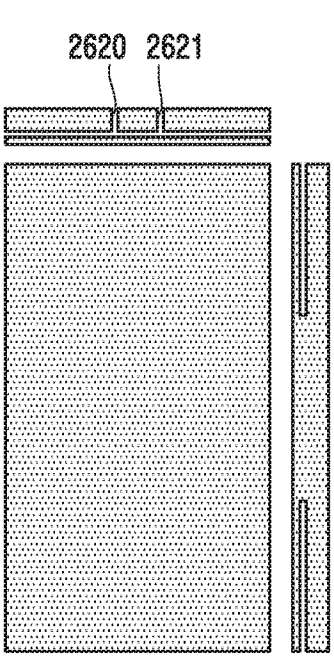
Figure 26B:
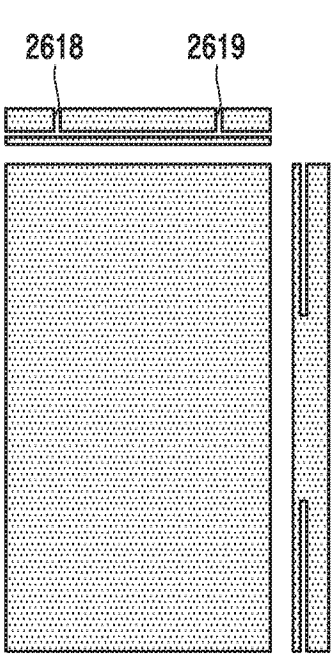
Figure 26A:
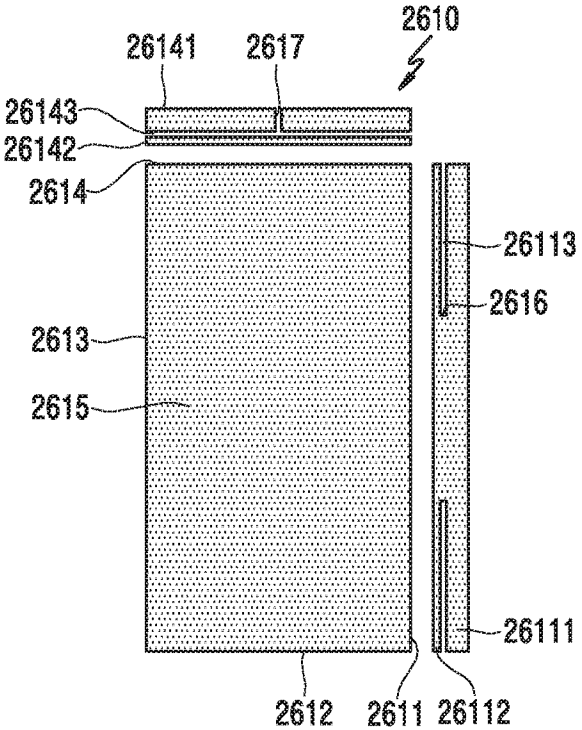

Each of FIGS. 26A, 26B, and 26C illustrates a front view in which the housing 2610 is viewed from the front side, a right side view which is illustrated at the right side of the front view, and a plan view which is illustrated on the top side of the front view, all together.

Referring to FIGS. 26A, 26B, and 26C, although, in the above-described embodiments, each housing is configured in such a manner in which a pair of conductive structures interposed between the upper and lower portions of a conductive plate and a non-conductive structure have the same thickness, a housing in the present embodiment may be configured such that the thicknesses of conductive structures have different thicknesses.

The housing 2610 may include first to fourth side face members 2611 to 2614, a conductive plate 2615, and a plurality of non-conductive structures 26113 and 26143. The housing 2610 may be formed in such a manner in which the thickness of the conductive structures disposed at the upper side is larger than the thickness of the conductive structures disposed at the lower side.

In the case of FIG. 26A, the first and second conductive structures 26111 and 26112 of the first side face member 2611 may be formed with a first conductive portion 2616 on the first side face member 2611, which is connected through the first non-conductive structure 26113 between the first and second conductive structures 26111 and 26112. The first conductive structure 26111 may be formed to have a thickness that is larger than that of the second conductive structure 26112. The first non-conductive structure 26113 may be divided into two portions by the first conductive portion 2616. Although not illustrated, the third side face member 2613 may also be formed to have a configuration that is the same as, or similar to, the above-described first side face member 2611. According to one embodiment, the fourth side face member 2614 may include a fourth non-conductive structure 26143 interposed between the seventh conductive structure 26141 and the eighth conductive structure 26142, and a non-conductive protrusion 2617 extending from the fourth non-conductive structure 24143. The thicknesses of the seventh conductive structure 26141 and the eighth conductive structure 26142 may be different from each other. For example, the thicknesses of the seventh conductive structure 26141 may be larger than that of the eighth conductive structure 26142. Although not illustrated, the second side face member 2612 may also be formed to have a configuration that is the same as, or similar to, the above-described fourth side face member 2614.

In the case of FIG. 26B, the seventh conductive structure 26141 of the fourth side face member 2614 may be divided by a pair of non-conductive protrusions 2618 and 2619 in a condition that is the same as, or similar to, the condition of FIG. 26A. In the case of FIG. 26C, non-conductive protrusions 2620 and 2621, each of which is formed in the seventh conductive structure 26141 of the fourth side member 2614, may be formed to have a spacing therebetween, which is smaller than the spacing between the split portions illustrated in FIG. 26B.

Figure 27C:
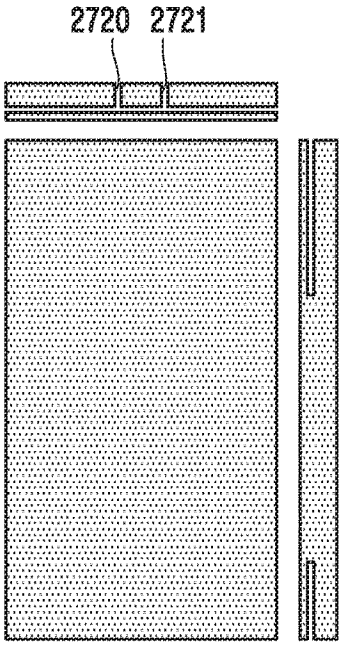
Figure 27B:
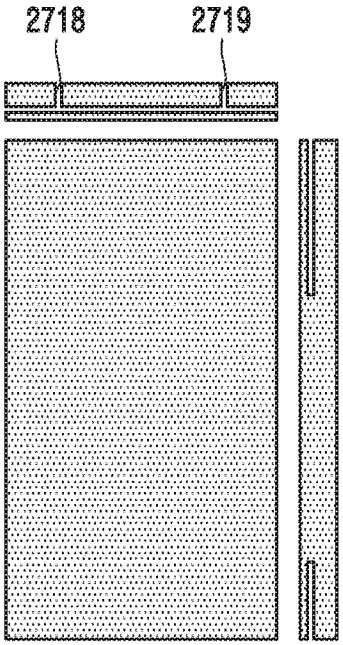
Figure 27A:
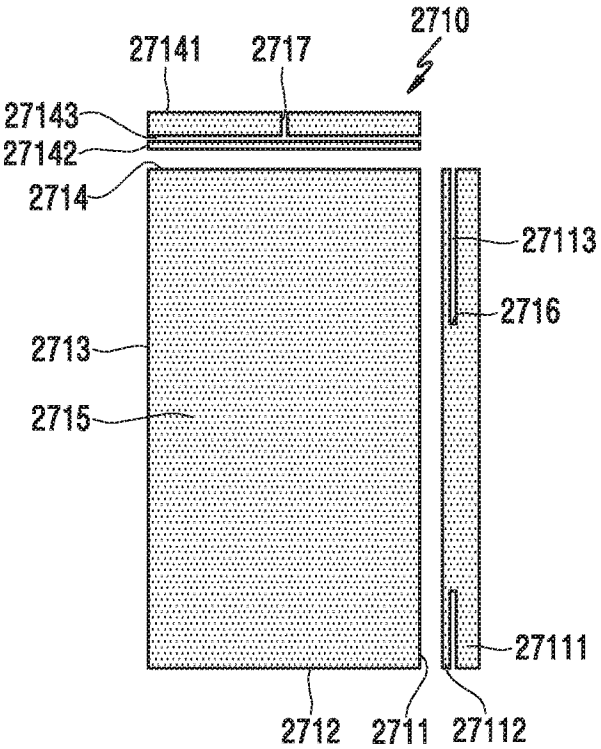

Each of FIGS. 27A, 27B, and 27C illustrates a front view in which the housing 2710 is viewed from the front side, a right side view which is illustrated at the right side of the front view, and a plan view which is illustrated on the top side of the front view, all together.

Referring to FIGS. 27A, 27B, and 27C, the housing 2710 may include first to fourth side face members 2711 to 2714 and a conductive plate 2715, which may be formed in the conditions that are the same as, or similar to, the conditions of FIGS. 26A, 26B, and 26C.

In the case of FIG. 27A, the first and second conductive structures 27111 and 27112 of the first side face member 2711 may be formed with a first conductive portion 2716, which is connected through the first non-conductive structure 27113 between the first and second conductive structures 27111 and 27112, to be biased to one side (e.g., the lower side) from the center of the first side face member 2711. The first conductive structure 27111 may be formed to have a thickness that is larger than that of the second conductive structure 27112. The first non-conductive structure 27113 may be divided into two portions by the first conductive portion 2716. Although not illustrated, the third side face member 2713 may also be formed to have a configuration that is the same as, or similar to, the above-described first side face member 2711. The fourth side face member 2714 may include a fourth non-conductive structure 27143 interposed between the seventh conductive structure 27141 and the eighth conductive structure 27142, and a non-conductive protrusion 2717 extending from the fourth non-conductive structure 24143. The thicknesses of the seventh conductive structure 27141 and the eighth conductive structure 27142 may be different from each other. For example, the thicknesses of the seventh conductive structure 27141 may be larger than that of the eighth conductive structure 27142. Although not illustrated, the second side face member 2712 may also be formed to have a configuration that is the same as, or similar to, the above-described fourth side face member 2714.

In the case of FIG. 27B, the seventh conductive structure 27141 of the fourth side face member 2714 may be divided by a pair of non-conductive protrusions 2718 and 2719 in a condition that is the same as, or similar to, the condition of FIG. 27A. In the case of FIG. 27C, non-conductive protrusions 2720 and 2721, each of which is formed in the seventh conductive structure 27141 of the fourth side member 2714, may be formed to have a spacing therebetween, which is smaller than the spacing between the split portions illustrated in FIG. 27B.

Figure 28C:
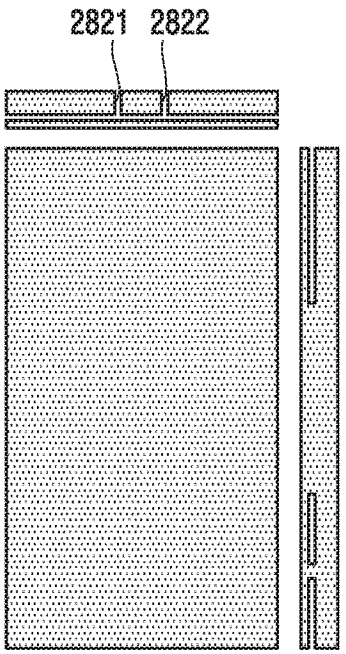
Figure 28B:
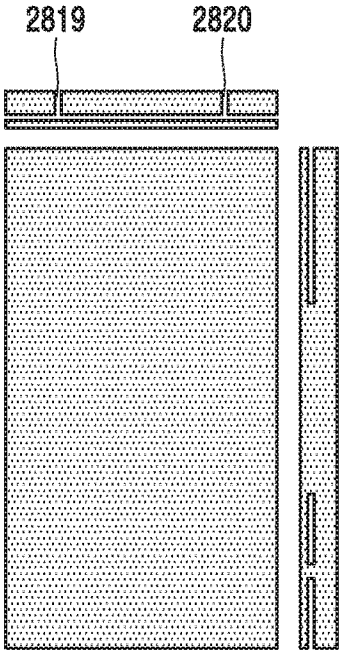
Figure 28A:
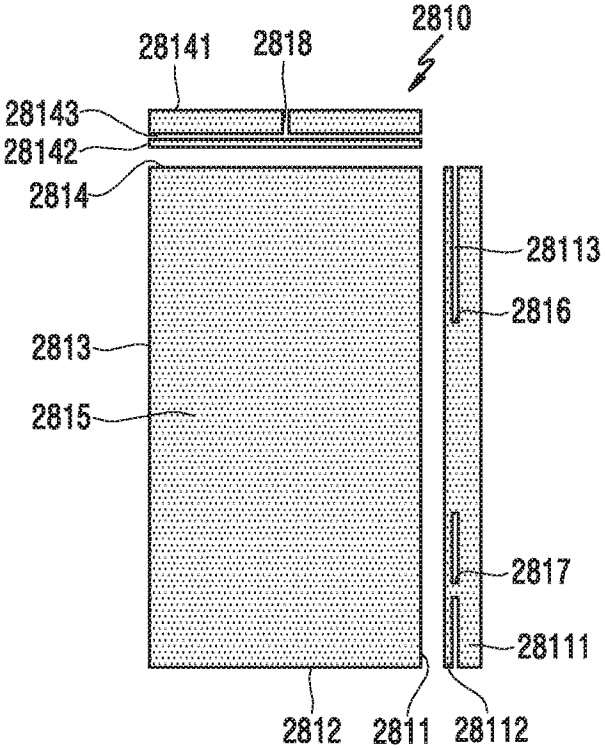

Each of FIGS. 28A, 28B, and 28C illustrates a front view in which the housing 2810 is viewed from the front side, a right side view which is illustrated at the right side of the front view, and a plan view which is illustrated on the top side of the front view, all together.

Referring to FIGS. 28A, 28B, and 28C, the housing 2810 may include first to fourth side face members 2811 to 2814 and a conductive plate 2815, which may be formed in the conditions that are the same as, or similar to, the conditions of FIGS. 26A, 26B, and 26C.

In the case of FIG. 28A, the first and second conductive structures 28111 and 28112 of the first side face member 2811 may include a pair of conductive portions 2816 and 2817 that are connected to each other through the first non-conductive structure 28113 between the first and second conductive structures 23111 and 23112. The first conductive structure 28111 may be formed to have a thickness that is larger than that of the second non-conductive structure 28112. The first non-conductive structure 28113 may be divided into three portions by a plurality of conductive portions 2816 and 2817. Although not illustrated, the third side face member 2813 may also be formed to have a configuration that is the same as, or similar to, the above-described first side face member 2811. The fourth side face member 2814 may include a fourth non-conductive structure 28143 interposed between the seventh conductive structure 28141 and the eighth conductive structure 28142, and a non-conductive protrusion 2818 extending from the fourth non-conductive structure 28143. The thicknesses of the seventh conductive structure 28141 and the eighth conductive structure 28142 may be different from each other. For example, the thicknesses of the seventh conductive structure 28141 may be larger than that of the eighth conductive structure 28142. Although not illustrated, the second side face member 2812 may also be formed to have a configuration that is the same as, or similar to, the above-described fourth side face member 2814.

In the case of FIG. 28B, the seventh conductive structure 28141 of the fourth side face member 2814 may be divided by a pair of non-conductive protrusions 2819 and 2820 in a condition that is the same as, or similar to, the condition of FIG. 28A. In the case of FIG. 28C, non-conductive protrusions 2821 and 2822, each of which is formed in the seventh conductive structure 28141 of the fourth side member 2814, may be formed to have a spacing therebetween, which is smaller than the spacing between the split portions illustrated in FIG. 28B.

Figure 29C:
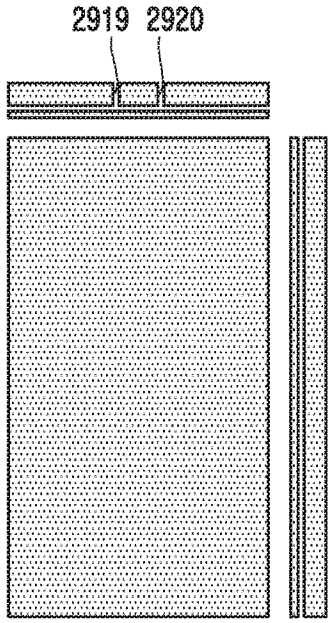
Figure 29B:
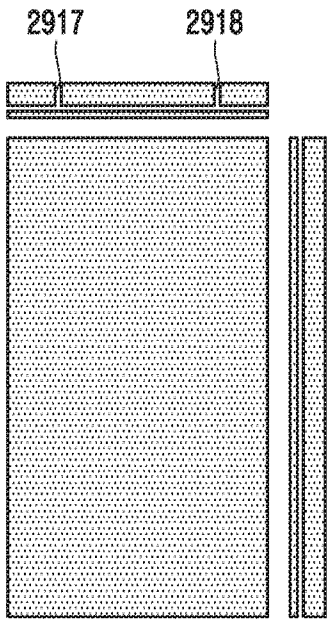
Figure 29A:
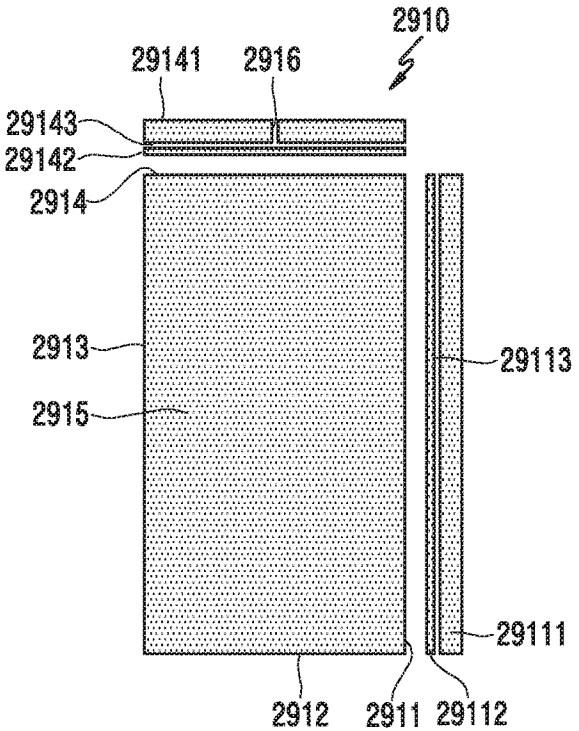

Each of FIGS. 29A, 29B, and 29C illustrates a front view in which the housing 2910 is viewed from the front side, a right side view which is illustrated at the right side of the front view, and a plan view which is illustrated on the top side of the front view, all together.

Referring to FIGS. 29A, 29B, and 29C, the housing 2910 may include first to fourth side face members 2911 to 2914 and a conductive plate 2915, which may be formed in the conditions that are the same as, or similar to, the conditions of FIG. 26A to FIG. 26C.

In the case of FIG. 29A, the first and second conductive structures 29111 and 29112 of the first side face member 2911 may include a non-conductive structure 29113 interposed therebetween. The first conductive structure 29111 may be formed to have a thickness that is larger than that of the second conductive structure 29112. Any conductive portion may not exist in the first side face member 2911, and the first non-conductive structure 29113 may be filled with a non-conductive strip. Although not illustrated, the third side face member 2913 may also be formed to have a configuration that is the same as, or similar to, the above-described first side face member 2911. The fourth side face member 2914 may include a fourth non-conductive structure 29143 interposed between the seventh conductive structure 29141 and the eighth conductive structure 29142, and a non-conductive protrusion 2916 extending from the fourth non-conductive structure 29143. The thicknesses of the seventh conductive structure 29141 and the eighth conductive structure 29142 may be different from each other. For example, the thicknesses of the seventh conductive structure 29141 may be larger than that of the eighth conductive structure 29142. Although not illustrated, the second side face member 2912 may also be formed to have a configuration that is the same as, or similar to, the above-described fourth side face member 2914.

In the case of FIG. 29B, the seventh conductive structure 29141 of the fourth side face member 2914 may be divided by a pair of non-conductive protrusions 2917 and 2918 in a condition that is the same as, or similar to, the condition of FIG. 29A. In the case of FIG. 29C, non-conductive protrusions 2919 and 2920, each of which is formed in the seventh conductive structure 29141 of the fourth side member 2914, may be formed to have a spacing therebetween, which is smaller than the spacing between the split portions illustrated in FIG. 29B.

Figure 30B:
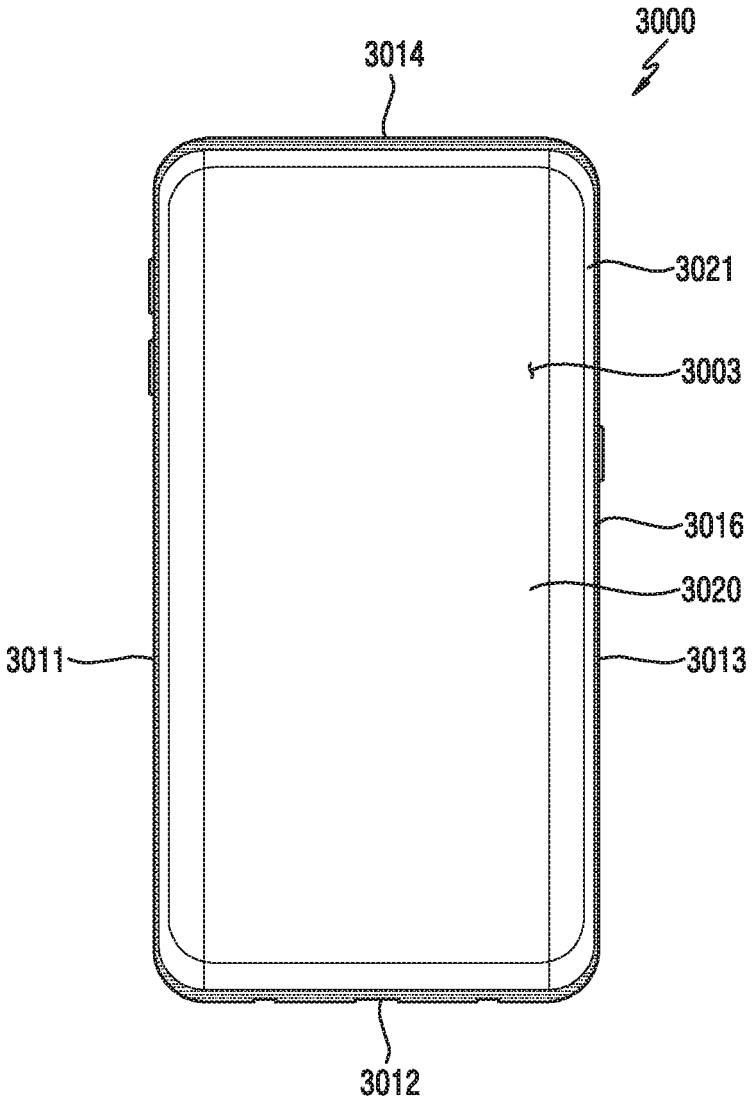
Figure 30C:
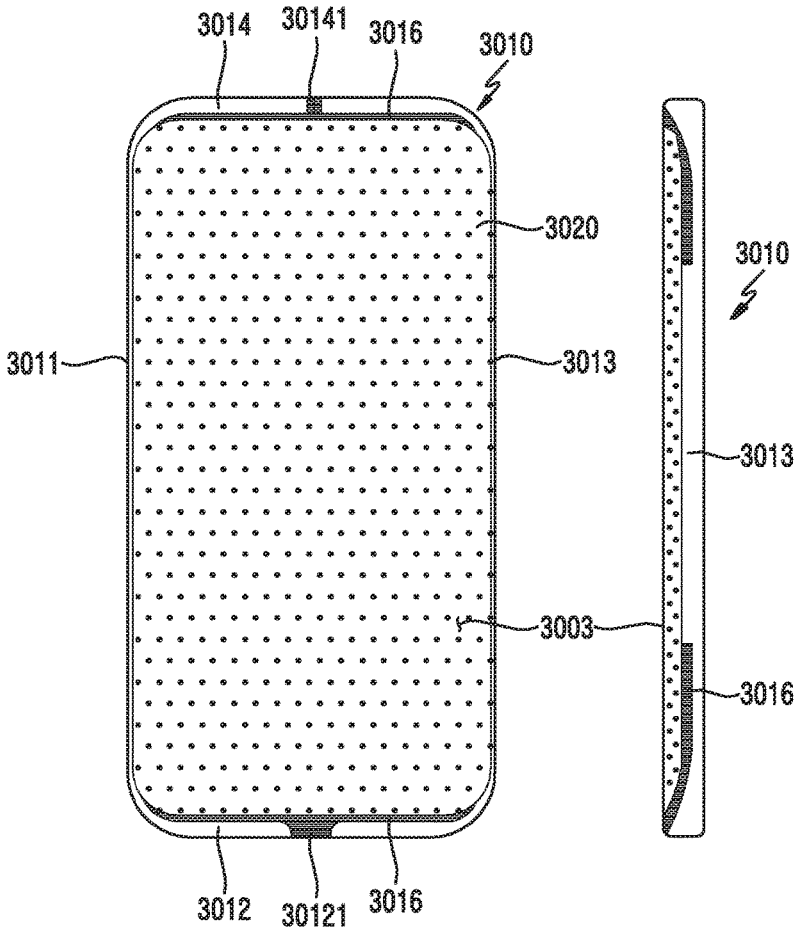

FIGS. 30A to 30C are views each illustrating an arrangement relationship of the non-conductive strips in arranged along the rim of an electronic device according to various embodiments of the present disclosure.

Referring to FIGS. 30A and 30B, an electronic device 3000 may include a housing 3010 and a display 3020 disposed to occupy a greater portion of the front face 3003 of the housing 3010. The configuration of the housing 3010 may be similar to the configuration of the housing 310 of FIG. 3A, the housing 410 of FIG. 4, the housing 510 of FIGS. 5A to 5B and 6A to 6D, the housing 710 of FIGS. 7A to 7C, the housing 810 of FIG. 8, the housing 1310 of FIG. 13A, the housing 1410 of FIG. 14A, the housing 1510 of FIG. 15A, the housing 1610 of FIG. 16A, or another embodiment of a housing.

The housing 3010 may include first to fourth side face members 3011 to 3014. The display 3020 may include a black matrix (BM) region 3021, which is arranged along the rim of the display 3020. A non-conductive strip 3016 may be interposed between the display 3020 and the first to fourth side face members 3011 to 3014. The non-conductive strip 3016 may be formed to extend to at least a portion of the side face and the front face of the electronic device.

Referring to FIG. 30C, the second and fourth side face members 3012 and 3014 of the housing 3010 may respectively include first and second protrusions 30121 and 30141, from which the non-conductive strip 3016 extends so that the side face members are split. Each of the side face members 3012 and 3014 may be electrically connected to a board inside the electronic device so as to operate an antenna radiator that operates in at least one frequency band.

A slit (so-called a "U-slit") may be arranged between the side face members 3011 to 3014 and the rim of the metal plate that forms the whole region of the front face or the rear face of the electronic device, and may be filled with (or by) the non-conductive strip 3016. The display 3020 disposed on the front face of the electronic device may be designed not to interfere with the operation of the antenna device when the display 3020 may share at least a partial region of the non-conductive strip 3016 with the BM region 3021.

According to various embodiments of the present disclosure, it is possible to prevent the degradation in antenna radiation performance due to the use of a metallic member by providing a radiation space of an antenna radiator by arranging a non-conductive slit between a metallic member used as an antenna radiator and a neighboring metallic member (e.g., the conductive plate).

According to various embodiments of the present disclosure, it is possible to provide an electronic device including a housing including a front face having a substantially rectangular shape and facing in a first direction, a rear face having a substantially rectangular shape and facing in a second direction that is opposite to the first direction, and first to fourth side face members that enclose together a space between the front face and the rear face, wherein at least a portion of the first to fourth side face members is formed of a conductive material; a touch screen display exposed through the front face; and at least one wireless communication circuit arranged within the housing. The rear face includes a substantially flat conductive plate that constitutes a substantial portion of the rear face; and an elongated non-conductive strip that encloses the conductive plate when viewed from above the rear face, and extends along the first to fourth side face members.

According to various embodiments of the present disclosure, each of the first and third side face members may have a first length in a third direction perpendicular to the first direction, and each of the second and fourth side face members may have a second length, which is shorter than the first length, in a fourth direction perpendicular to the third direction. The electronic device may further include a first conductive connection part configured to electrically connect a portion of the first side face member to the conductive plate; and a second conductive connection part configured to electrically connect a portion of the third side face member to the conductive plate. The first conductive connection part and the second conductive connection part may be interposed between the front face and the rear face within the housing.

According to various embodiments of the present disclosure, the wireless communication circuit may be electrically connected to at least one of a first position on the first side face member, which is spaced apart from the first conductive connection part; a second position on the third side face member, which is spaced apart from the second conductive connection part; a third position on the second side face member; and a fourth position on the second side face member, which is spaced apart from the third position.

According to various embodiments of the present disclosure, the wireless communication circuit may be further electrically connected to at least one of a fifth position on the fourth side face member and a sixth position on the fourth side face member, which is spaced apart from the fifth position.

According to various embodiments of the present disclosure, the first conductive connection part may electrically connect a central portion of the first side face member to the conductive plate, and the second conductive connection part may electrically connect a central portion of the third side face member to the conductive plate.

According to various embodiments of the present disclosure, the elongated non-conductive strip may include at least one of a first protrusion that splits the second side face member into two electrically separated portions, and a second protrusion that splits the fourth side face member into two electrically separated portions.

According to various embodiments of the present disclosure, the at least one wireless communication circuit may include at least one circuit configured to support cellular wireless communication, Wi-Fi, GPS, GNSS, Bluetooth communication, and NFC communication.

According to various embodiments of the present disclosure, the first conductive connection part and the second conductive connection part may be arranged asymmetrically with reference to the conductive plate.

According to various embodiments of the present disclosure, a connection piece may be formed to protrude inwardly from at least a partial region of the first to fourth side face members, and electrically connected to the wireless communication circuit.

According to various embodiments of the present disclosure, the connection piece may be connected to the wireless communication circuit configured on the board arranged within the electronic device via a flexible electric connection member.

According to various embodiments of the present disclosure, the flexible electric connection member may include at least one of a C-clip, a conductive film, and a conductive pad.

According to various embodiments of the present disclosure, it is possible to provide an electronic device including a housing including a front face having a substantially rectangular shape and facing in a first direction, a rear face having a substantially rectangular shape and facing in a second direction that is opposite to the first direction, and first to fourth side face members that enclose together a space between the front face and the rear face, in which the rear face includes a substantially flat conductive plate that forms a considerable portion of the rear face; a touch screen display exposed through the front face; and at least one wireless communication circuit arranged within the housing. Each of the first and third side face members has a first length in a third direction (y) perpendicular to the first direction, each of the second and fourth side face members has a second length, which is shorter than the first length, in a fourth direction (x) perpendicular to the third direction. The first side face member includes a first conductive structure elongated in the third direction, a second conductive structure spaced apart from the first conductive structure, and elongated in the third direction, and a first non-conductive structure interposed between the first conductive structure and the second conductive structure, and elongated in the third direction. The second side face member includes a third conductive structure elongated in the fourth direction from the first conductive structure, a fourth conductive structure spaced apart from the third conductive structure, and elongated in the fourth direction from the second conductive structure, and a second non-conductive structure interposed between the third conductive structure and the fourth conductive structure, and elongated in the fourth direction from the first non-conductive structure.

According to various embodiments of the present disclosure, the second side face member may include at least one non-conductive protrusion that splits the third conductive structure or the fourth conductive structure into two or more portions and extends from the first non-conductive structure in the first direction or the second direction.

According to various embodiments of the present disclosure, the first side face member may include a conductive portion configured to electrically connect the first conductive structure to the second conductive structure.

According to various embodiments of the present disclosure, the third side face member may include a fifth conductive structure elongated in the third direction from the third conductive structure, a sixth conductive structure spaced apart from the fifth conductive structure, and elongated in the third direction from the fourth conductive structure, and a third non-conductive structure interposed between the fifth conductive structure and the sixth conductive structure, and elongated in the third direction from the second non-conductive structure.

According to various embodiments of the present disclosure, the third side face member may include a conductive portion configured to electrically connect the fifth conductive structure to the six conductive structure.

According to various embodiments of the present disclosure, the fourth side face member may include a seventh conductive structure elongated in the fourth direction (x) from the first conductive structure, an eighth conductive structure spaced apart from the seventh conductive structure, and elongated in the fourth direction from the second conductive structure, and a fourth non-conductive structure interposed between the seventh conductive structure and the eighth conductive structure, and elongated in the fourth direction from the first non-conductive structure.

According to various embodiments of the present disclosure, a connection piece may be formed to protrude inwardly from at least a partial region of the first to fourth side face members, and electrically connected to the wireless communication circuit.

According to various embodiments of the present disclosure, the connection piece may be connected to the wireless communication circuit configured on the board arranged within the electronic device via a flexible electric connection member.

According to various embodiments of the present disclosure, it is possible to provide an electronic device including a housing including a front face having a substantially rectangular shape and facing in a first direction, a rear face having a substantially rectangular shape, facing in a second direction that is opposite to the first direction, and including a non-conductive material, and first to fourth side face members that enclose together a space between the front face and the rear face, in which at least a portion of the first to fourth side face members is formed of a conductive material; a touch screen display exposed through the front face; at least one wireless communication circuit arranged within the housing; a substantially flat conductive ground plane arranged within the housing, being substantially parallel to the rear face, and having an area substantially equal to an area of the rear face; and a non-conductive extension structure arranged within the housing, extending from the first side face member along the fourth side surface member when viewed from above the rear face, and enclosing a considerable portion of the ground plane. Each of the first and third side face members has a first length in a third direction perpendicular to the first direction, and each of the second and fourth side face members has a second length, which is shorter than the first length, in a fourth direction perpendicular to the third direction. The electronic device further includes a first conductive connection part configured to electrically connect a portion of the first side face member to the ground plane; and a second conductive connection part configured to electrically connect a portion of the third side face member to the ground plane.

While the present disclosure has been shown and described with reference to various embodiments thereof, it will be understood by those skilled in the art that various changes in form and details may be made therein without departing from the spirit and scope of the present disclosure as defined by the appended claims and their equivalents.

The invention claimed is:

1. An electronic device comprising:

a housing including:

a front face having a substantially rectangular shape and facing in a first direction, a rear face having a substantially rectangular shape and facing in a second direction that is opposite to the first direction, and first to fourth side face members that together enclose a space between the front face and the rear face, at least a portion of the first to fourth side face members being formed of a conductive material;

a touch screen display arranged within the housing and exposed through the front face of the housing; and at least one wireless communication circuit arranged within the housing, wherein the rear face includes:

a substantially flat conductive plate that constitutes a substantial portion of the rear face, at least one slit that may be formed along a rim of the substantially flat conductive plate and be disposed between the first to fourth side face and the substantially flat conductive plate, and an elongated non-conductive strip that encloses the conductive plate when viewed from above the rear face, and extends along the first to fourth side face members and disposed in the at least one slit.

2. The electronic device of claim 1, wherein each of the first and third side face members has a first length in a third direction perpendicular to the first direction, wherein each of the second and fourth side face members has a second length, which is shorter than the first length, in a fourth direction perpendicular to the third direction, wherein the electronic device further comprises:

a first conductive connection part configured to electrically connect a portion of the first side face member to the conductive plate; and a second conductive connection part configured to electrically connect a portion of the third side face member to the conductive plate, and wherein the first conductive connection part and the second conductive connection part are interposed between the front face and the rear face within the housing.

3. The electronic device of claim 2, wherein the wireless communication circuit is electrically connected to at least one of:

a first position on the first side face member, which is spaced apart from the first conductive connection part;

a second position on the third side face member, which is spaced apart from the second conductive connection part;

a third position on the second side face member; or a fourth position on the second side face member, which is spaced apart from the third position.

4. The electronic device of claim 3, wherein the wireless communication circuit is further electrically connected to at least one of:

a fifth position on the fourth side face member; or a sixth position on the fourth side face member, which is spaced apart from the fifth position.

5. The electronic device of claim 2, wherein the first conductive connection part electrically connects a central portion of the first side face member to the conductive plate, and wherein the second conductive connection part electrically connects a central portion of the third side face member to the conductive plate.

6. The electronic device of claim 5, wherein the first conductive connection part and the second conductive connection part are arranged asymmetrically with reference to the conductive plate.

7. The electronic device of claim 2, wherein the elongated non-conductive strip includes at least one of:

a first protrusion that splits the second side face member into two electrically separated portions; and a second protrusion that splits the fourth side face member into two electrically separated portions.

8. The electronic device of claim 1, wherein the at least one wireless communication circuit includes at least one circuit configured to support cellular wireless communication, Wi-Fi, global positioning system (GPS), global navigation satellite system (GNSS), Bluetooth communication, or near field communication (NFC).

9. The electronic device of claim 1, wherein a connection piece is formed to protrude inwardly from at least a partial region of the first to fourth side face members, and electrically connected to the wireless communication circuit.

10. The electronic device of claim 9, wherein the connection piece is connected to the wireless communication circuit configured on the board arranged within the electronic device via a flexible electric connection member.

11. The electronic device of claim 10, wherein the flexible electric connection member includes at least one of a C-clip, a conductive tape, or a conductive pad.

12. An electronic device comprising:

a housing including:

a front face having a substantially rectangular shape and facing in a first direction, a rear face having a substantially rectangular shape and facing in a second direction that is opposite to the first direction, and first to fourth side face members that together enclose a space between the front face and the rear face, the rear face including a substantially flat conductive plate that forms a portion of the rear face;

a touch screen display arranged within the housing and exposed through the front face of the housing; and at least one wireless communication circuit arranged within the housing, wherein each of the first and third side face members has a first length in a third direction (y) perpendicular to the first direction, wherein each of the second and fourth side face members has a second length, which is shorter than the first length, in a fourth direction (x) perpendicular to the third direction, wherein the first side face member includes:

a first conductive structure elongated in the third direction, a second conductive structure spaced apart from the first conductive structure, and elongated in the third direction, and a first non-conductive structure interposed between the first conductive structure and the second conductive structure, and elongated in the third direction, and wherein the second side face member includes:

a third conductive structure elongated in the fourth direction from the first conductive structure, a fourth conductive structure spaced apart from the third conductive structure, and elongated in the fourth direction from the second conductive structure, and a second non-conductive structure interposed between the third conductive structure and the fourth conductive structure, and elongated in the fourth direction from the first non-conductive structure.

13. The electronic device of claim 12, wherein the second side face member includes at least one non-conductive protrusion that splits the third conductive structure or the fourth conductive structure into two or more portions and extends from the first non-conductive structure in the first direction or the second direction.

14. The electronic device of claim 12, wherein the first side face member includes a conductive portion configured to electrically connect the first conductive structure to the second conductive structure.

15. The electronic device of claim 12, wherein the third side face member includes:

a fifth conductive structure elongated in the third direction from the third conductive structure, a sixth conductive structure spaced apart from the fifth conductive structure, and elongated in the third direction from the fourth conductive structure, and a third non-conductive structure interposed between the fifth conductive structure and the sixth conductive structure, and elongated in the third direction from the second non-conductive structure.

16. The electronic device of claim 15, wherein the third side face member includes a conductive portion configured to electrically connect the fifth conductive structure to the sixth conductive structure.

17. The electronic device of claim 12, wherein the fourth side face member includes:

a seventh conductive structure elongated in the fourth direction (x) from the first conductive structure, an eighth conductive structure spaced apart from the seventh conductive structure, and elongated in the fourth direction from the second conductive structure, and a fourth non-conductive structure interposed between the seventh conductive structure and the eighth conductive structure, and elongated in the fourth direction from the first non-conductive structure.

18. The electronic device of claim 12, wherein a connection piece is formed to protrude inwardly from at least a partial region of the first to fourth side face members, and electrically connected to the wireless communication circuit, wherein the connection piece is connected to the wireless communication circuit configured on the board arranged within the electronic device via a flexible electric connection member.

19. The electronic device of claim 12, wherein at least one of the first conductive structure, the second conductive structure, the third conductive structure, or the fourth conductive structure has a thickness different from the thickness of a remainder of the first conductive structure, the second conductive structure, the third conductive structure, or the fourth conductive structure.

20. An electronic device comprising:

a housing including:

a front face having a substantially rectangular shape and facing in a first direction, a rear face having a substantially rectangular shape, facing in a second direction that is opposite to the first direction, and including a non-conductive material, and first to fourth side face members that together enclose a space between the front face and the rear face, wherein at least a portion of the first to fourth side face members is formed of a conductive material;

a touch screen display arranged within the housing and exposed through the front face of the housing;

at least one wireless communication circuit arranged within the housing;

a substantially flat conductive ground plane arranged within the housing, being substantially parallel to the rear face, and having an area substantially equal to an area of the rear face;

at least one slit that may be formed along a rim of the substantially flat conductive plate and be disposed between the first to fourth side face and the substantially flat conductive plate; and a non-conductive extension structure arranged within the at least one slit, when viewed from above the rear face, extending from the first side face member along the fourth side surface member, and enclosing a portion of the ground plane, wherein each of the first and third side face members has a first length in a third direction perpendicular to the first direction, wherein each of the second and fourth side face members has a second length, which is shorter than the first length, in a fourth direction perpendicular to the third direction, and wherein the electronic device further comprises:

a first conductive connection part configured to electrically connect a portion of the first side face member to the ground plane; and a second conductive connection part configured to electrically connect a portion of the third side face member to the ground plane.

* * * * *